US006250827B1

(12) United States Patent
Nojima et al.

(10) Patent No.: US 6,250,827 B1
(45) Date of Patent: Jun. 26, 2001

(54) RECORDING DEVICE AND SHEET MATERIAL CONVEYING DEVICE

(75) Inventors: Takashi Nojima, Tokyo; Koh Hasegawa, Yokohama; Shinya Asano, Tokyo; Hiroyuki Inoue, Yokohama; Akira Kida, Kawasaki; Takeshi Iwasaki, Yokohama; Noriko Kawasaki, Tokyo, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/290,406

(22) Filed: Apr. 13, 1999

(30) Foreign Application Priority Data

Apr. 15, 1998 (JP) ..... 10-105170

(51) Int. Cl.[7] ..... B41J 3/39
(52) U.S. Cl. ..... 400/691; 400/88
(58) Field of Search ..... 400/691, 88

(56) References Cited

U.S. PATENT DOCUMENTS

| | | | | |
|---|---|---|---|---|
| 4,455,100 | * | 6/1984 | Bauer | 400/88 |
| 5,236,265 | * | 8/1993 | Saito et al. | 400/88 |
| 5,364,196 | | 11/1994 | Baitz et al. | 400/691 |
| 5,497,701 | * | 3/1996 | Uland | 101/288 |
| 5,829,893 | * | 11/1998 | Kinoshita et al. | 400/88 |

FOREIGN PATENT DOCUMENTS

| | | |
|---|---|---|
| 0 314 140 | 5/1989 | (EP) . |
| 0 540 301 | 5/1993 | (EP) . |
| 5-116427 | 5/1993 | (JP) . |
| 5-307285 | 11/1993 | (JP) . |
| 7-025114 | 1/1995 | (JP) . |
| 8-224937 | 9/1996 | (JP) . |

* cited by examiner

*Primary Examiner*—John S. Hilten
*Assistant Examiner*—Charles H. Nolan, Jr.
(74) *Attorney, Agent, or Firm*—Fitzpatrick, Cella, Harper & Scinto

(57) ABSTRACT

A recording device comprises a drive mechanism section for effecting recording on a recording object material, and an exterior cover for covering the drive mechanism section, the exterior cover having a plurality of cover members separated by at least one partition surface, wherein for two cover members to be combined with each other out of the cover members, a partition surface of one cover member is provided with a projection which functions as a fulcrum when the other cover member pivots on an axis parallel to the partition surface, and partition surfaces of the two cover members are coupled to each other by an engagement structure which engages when the two cover members move away from each other, on one side with respect to the axis, while being coupled by fastening with a screw on the other side.

9 Claims, 40 Drawing Sheets

RECORDING DEVICE AND SHEET MATERIAL CONVEYING DEVICE

BACKGROUND OF THE INVENTION

1. Field of the Invention

The present invention relates to a recording device for effecting recording on a recording object material of a sheet shape and a sheet material conveying device for conveying a sheet material and, particularly, to the structure of an exterior cover for protecting a drive mechanism portion of these devices.

2. Related Background Art

There are recording devices having the functions of a printer, a copying machine, a facsimile machine, and the like or recording devices used as output devices of composite electronic devices including computers, word processors, and so on, and workstations, which are constructed in such structure that an image is formed on a recording object material (a recording medium) such as paper, plastic thin film, or the like, based on image information. These recording devices can be classified under the ink jet type, the wire dot type, the thermal type, the laser beam type, and so on, depending upon their recording methods.

With the recent tendency to downsize the computers, portable computers like notebook type computers are becoming widespread. In connection therewith, compact recording devices with the principal object on portability have been proposed heretofore.

FIG. 47 is an exterior view of a conventional recording device.

As illustrated in FIG. 47, the exterior for protecting the drive mechanism portion of the recording device is generally partitioned into a lower case 1001 and an upper case 1002. During assembling or during disassembling, these cases are attached or detached at this partition part. The upper case 1002 and the lower case 1001 are secured to each other with four screws 1003.

In the conventional exterior structure as described above, however, the screws penetrate the cases vertically, so that the drive mechanism portion cannot be placed in the screw-penetrating areas. Therefore, the size of the exterior had to be designed with consideration to the screw-penetrating areas, which was hindrance to the scale reduction of the entire device. Use of the many screws also caused increase in the number of assembling steps and in the number of parts and in turn caused increase in the cost.

A snap fit fastening method is one of methods for coupling the upper case with the lower case without use of screws. The coupling by the snap fit method, however, is less rugged than that by fastening with screws and the coupling by the snap fit method cannot be resistant to use if consideration is given to impact on the recording devices with the principal object on portability while being carried and to cases in which another device, a book, or the like can be mounted on the recording device because of its compactness.

SUMMARY OF THE INVENTION

For solving the problems described above, an object of the present invention is to provide a recording device and a sheet material conveying device that are constructed so as to permit case members composing the exterior to be coupled to each other with strength resistant to portable use, in simple structure, and the decreased number of parts.

Another object of the present invention is to provide a recording device comprising:

a drive mechanism section for effecting recording on a recording object material; and an exterior cover for covering the drive mechanism section, said exterior cover having a plurality of cover members separated by at least one partition surface;

wherein for two cover members to be combined with each other out of said cover members, a partition surface of one cover member is provided with a projection which functions as a fulcrum when the other cover member pivots on an axis parallel to said partition surface, and partition surfaces of said two cover members are coupled to each other by an engagement structure which engages when said two cover members move away from each other, on one side with respect to said axis, while being coupled by fastening with a screw on the other side.

In the recording device of the present invention constructed as described above, the exterior cover is partitioned into the plurality of cover members and, as to two cover members to be combined with each other out of them, they are assembled in such a manner that they are first coupled on one side by the engagement structure and then they are fastened with the screw on the other side. Since there is the projection provided between the engagement structure and the fastening portion with the screw, the fastening with the screw makes the two cover members pivot about the projection, so as to make the coupling by the engagement structure firmer. In addition, the number of screws necessary for the fastening of the cover members can be minimum.

The above engagement structure can be one comprising a claw portion provided in either the one cover member or the other cover member, and a hook portion provided in the counterpart cover member to the cover member provided with the claw portion and arranged to engage with said claw portion.

In this case, the claw portion and the hook portion are arranged to go into close fit to each other when the cover members are fastened with the screw, whereby there becomes no backlash between the cover members, so as to increase rigidity, and whereby there occurs no "chatter sound" due to vibration of the drive mechanism section, either.

When the exterior-cover has the overall thickness not more than 60 mm, the device becomes superior in portability. The exterior cover may be constructed so as to accommodate a battery as a power supply for the drive mechanism section in a detachable state.

Further, the drive mechanism section may comprise conveying means for conveying the recording object material, and head holding means for holding a recording head arranged to discharge ink to effect the recording on said recording object material. In this case, the recording head is preferably one comprising an electro-thermal transducer for generating thermal energy for discharge of the ink.

Still another object of the present invention is to provide a recording device comprising a recording area in which recording is effected on a recording object material, and a first casing and a second casing for covering the recording area, said recording device comprising:

an engagement portion between said first casing and said second casing, said engagement portion having a first engagement structure for engaging said first casing and said second casing with each other by moving said first casing and said second casing in such a direction as to make said two casings closer to each other and a second engagement structure for engaging the casings with each other by moving said first casing and said second casing in such a direction as to make said two casings apart from each other.

In this case, preferably, between said first engagement structure and said second engagement structure there is a fulcrum for converting the movement in the direction to make said first casing and said second casing closer to each other in said first engagement structure, to the movement in the direction to make said first casing and said second casing apart from each other in said second engagement structure.

Still another object of the present invention is to provide a sheet material conveying device comprising:

a conveying mechanism for conveying a sheet material; and an exterior cover for covering the conveying mechanism, said exterior cover having a plurality of cover members separated by at least one partition surface;

wherein for two cover members to be combined with each other out of said cover members, a partition surface of one cover member is provided with a projection which functions as a fulcrum when the other cover member pivots on an axis parallel to said partition surface, and partition surfaces of said two cover members are coupled to each other by an engagement structure on one side with respect to said axis, while being coupled by fastening with a screw on the other side.

Still another object of the present invention is to provide a sheet material conveying device having a conveying mechanism for conveying a sheet material, and a first casing and a second casing for covering the conveying mechanism, said sheet material conveying device comprising:

an engagement portion between said first casing and said second casing, said engagement portion having a first engagement structure for engaging said first casing and said second casing with each other by moving said first casing and said second casing in such a direction as to make said two casings closer to each other and a second engagement structure for engaging the casings with each other by moving said first casing and said second casing in such a direction as to make said two casings apart from each other.

BRIEF DESCRIPTION OF THE DRAWINGS

FIG. 2 is open;

DETAILED DESCRIPTION OF THE PREFERRED EMBODIMENTS

The embodiments of the present invention will be described in detail with reference to the drawings.

[Overall Outside Structure]

Figure 1:
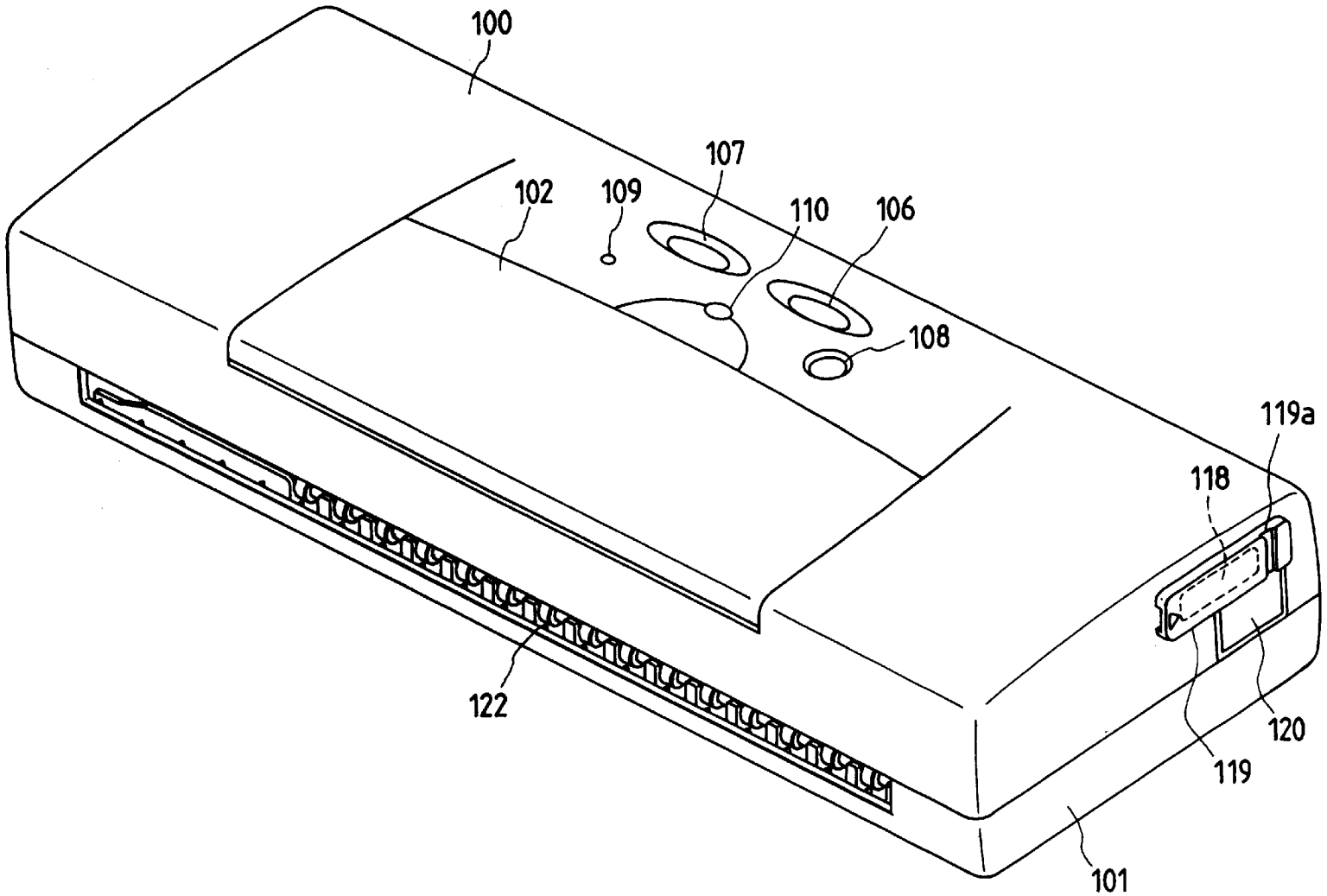
FIG. 1 is a perspective view, seen from the sheet discharge port side, of the appearance of a recording device as an embodiment of the present invention.
Figure 2:
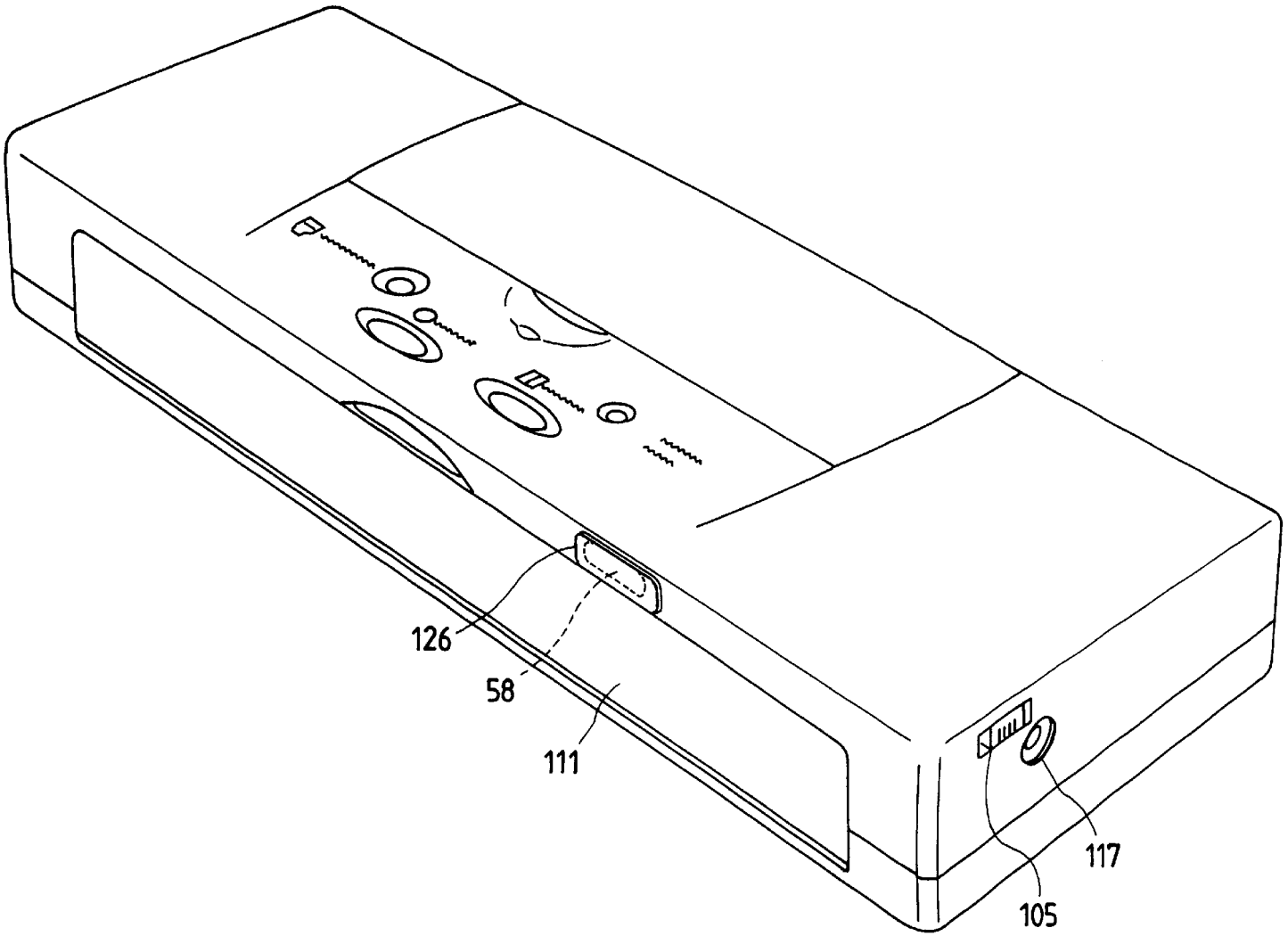
FIG. 2 is a perspective view, seen from the opposite side, of the recording device illustrated in FIG. 1.
Figure 3:
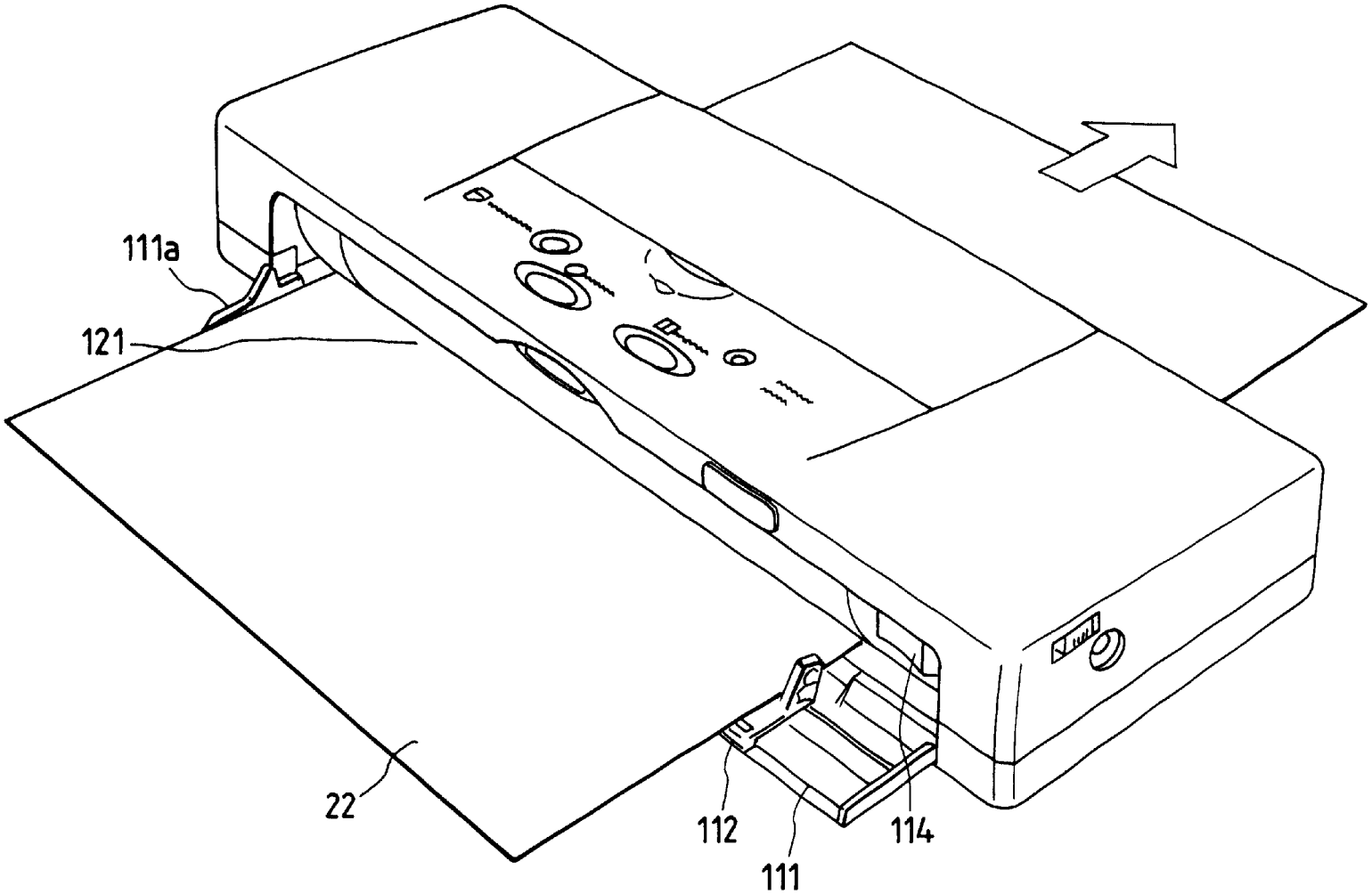
FIG. 3 is a perspective view to show an operating state of the recording device illustrated in FIG. 1 and FIG. 2.

FIG. 1 is a perspective view, which is seen from the sheet discharge port side, of the appearance of the recording device as an embodiment of the present invention, FIG. 2 is a perspective view, which is seen from the opposite side, of the recording device illustrated in FIG. 1, and FIG. 3 is a perspective view to show an operating state of the recording device illustrated in FIG. 1 and FIG. 2.

The recording device of the form illustrated in FIG. 1 and FIG. 2 has a drive mechanism section for effecting recording on a recording object material, including a carrier moving sections, a sheet feed section, a recording section, etc. described hereinafter, and a circuit board etc. for driving the drive mechanism section, and these are covered by an exterior cover of a shape of an approximately rectangular parallelepiped as a whole. The exterior cover is composed of an upper case 100 covering the upper surface and a lower case 101 covering the lower surface and is split by a plane including a sheet path.

Figure 4:
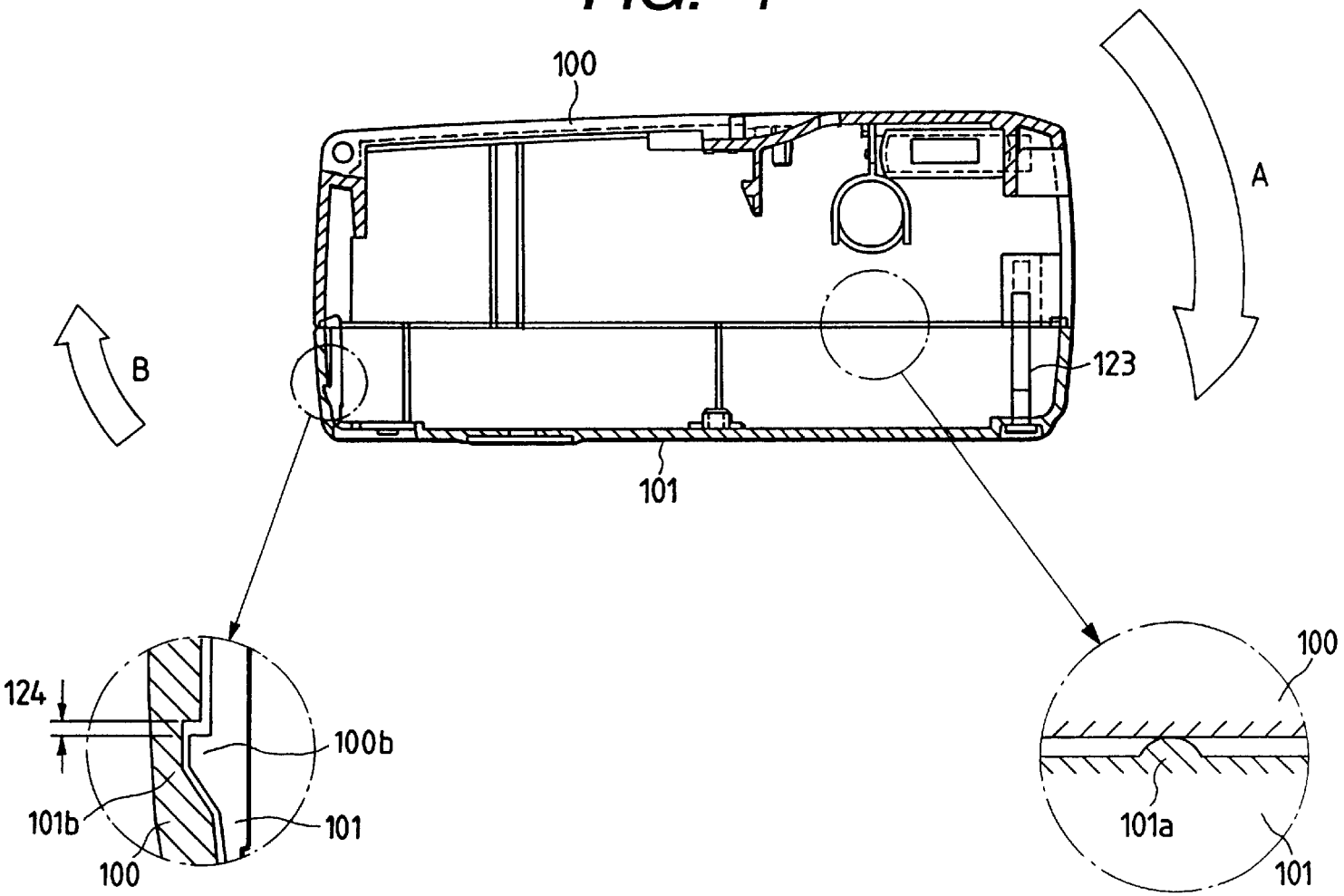
FIG. 4 is a sectional view of housing part of the recording device illustrated in FIG. 1 and FIG. 2.

Now, let us explain a way of assembling the upper case 100 and the lower case 101. FIG. 4 is a sectional view of the exterior case of the recording device illustrated in FIG. 1 and FIG. 2.

As illustrated in FIG. 4, the upper case 100 is provided with claw portions 100*b* and the lower case 101 is provided with hook portions 101*b* corresponding to the claw portions 100*b*. Normally, a clearance 124 is provided between the claw portions 100*b* and the hook portions 101*b*. This clearance 124 is normally set in the range of approximately 0.2 to 0.5 mm, taking variations in dimensions and assembly of parts into consideration.

A projection 101*a* is formed in a joint surface of the lower case 101 to the upper case 100, i.e., in the partition surface of the exterior cover. Since FIG. 4 is a sectional view, it shows the projection 101*a* in the wall on the far side of the lower case 101, but it is noted that a like projection is also provided at a corresponding position in the wall on the near side. In a state in which the upper case 100 is simply put on the lower case 101, there is a gap between the upper case 100 and the lower case 101 and the upper case 100 is capable of pivoting by an amount of the aforementioned gap about an axis normal to the drawing on a fulcrum at the top of the two projections 101*a*.

The claw portions 100*b* and hook portions 101*b* are provided at the end on the left side in the drawing with respect to the aforementioned axis. Further, the upper case 100 and lower case 101 are structured to be fastened with screws 123 at the end on the right side in the drawing with respect to the aforementioned axis.

While the claw portions 100*b* are hooked on the hook portions 101*b*, the upper case 100 is mounted on the lower case 101 and they are fastened with screws 123, whereupon the upper case 100 pivots in the direction of arrow A in the drawing on the projections 101*a*. This pivoting motion makes the clearance 124 smaller and smaller. As the screws 123 are tightened up to the end, the claw portions 100*b* go in close fit with the hook portions 101*b*, so as to make the clearance 124 zero.

Further, since the claw portions 100*b* move in the direction of arrow B in the drawing along an arcuate locus the fulcrum of which is at the top of the projections 101*a*, they move in such a direction as to increase an engagement amount between the hook portions 101*b* and the claw portions 100*b*.

This means that the first engagement structure of the present invention corresponds to the fastening structure with the screws 123 in the present embodiment and the second engagement structure of the present invention to the claw portion 100*b* and hook portion 101*b* in the present embodiment. When the coupling structure is stated simply, the claw portion 100*b* and hook portion 101*b* correspond thereto in the present embodiment.

This structure eliminates the backlash between the upper case 100 and the lower case 101, so as to enhance the rigidity as a housing of the device, and it also eliminates the so-called "chatter sound" due to vibration during the printing operation of the recording device. Since the present embodiment uses both the coupling by the engagement between the claw portions 100*b* and the hook portions 101*b* and the coupling by fastening with the screws 123, the ruggedness of the coupling between the upper case 100 and the lower case 101 is sufficiently higher than in the case of the fixing method by only the snap fit structure of claw, even if consideration is given to the cases in which the recording device is applied to portable use and in which another device etc. is mounted on the exterior cover.

The above assembling method decreases the number of parts and the amount of man-hours, as compared with the normal fixing method using four screws at the four corners, and thus the assembling method of the present embodiment can decrease the cost. In addition, the method of the present embodiment can obviate the need for the spaces of the screws and thus also contributes to the scale reduction of the device.

The example illustrated in FIG. 4 was an example in which the projections 101*a* were provided in the lower case 101, but the projections 101*a* may be provided in the upper case 100 to the contrary. The claw portions 100*b* and hook portions 101*b* may also be arranged so that the claw portions 100*b* are provided in the lower case 100 while the hook portions 101*b* are provided in the upper case 100. Further, the exterior cover does not always have to be limited only to the two-split structure of the upper case 100 and the lower case 101, but may also be constructed in another split structure of three or more case members. In this case, the projections 101*a,* claw portions 100*b,* and hook portions 101*b* described above are provided in each unit of two case members to be combined with each other.

Figure 5:
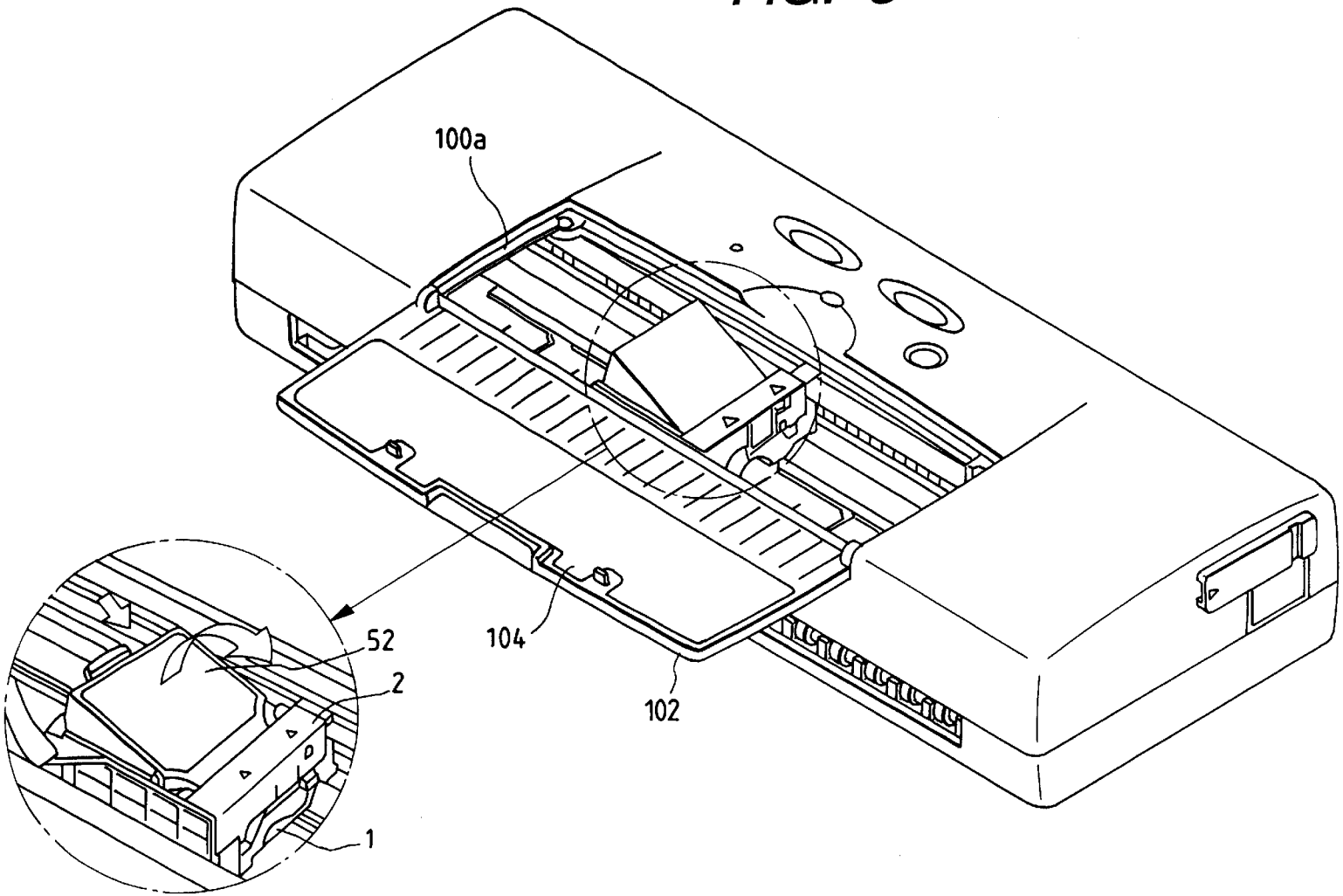
FIG. 5 is a drawing to show a state in which a head replacement lid illustrated in FIG. 1

The upper case 100 illustrated in FIG. 1 and FIG. 2 has a hole portion and the upper case 100 is provided with a head replacement lid 102 which is so arranged as to cover the hole portion. FIG. 5 shows a state in which this head replacement lid 102 is open. As illustrated in this figure, while the head replacement lid 102 is open, a recording head cartridge 1 can be replaced through the hole portion of the upper case 100 or the user can clean the inside or handle a jammed sheet when the sheet is jammed inside the recording device (or printer).

The hole portion covered by the head replacement lid 102 is formed in the approximate center part of the upper case 100 and in a portion where only part of a carrier moving range, described hereinafter, is exposed. Since the hole portion is formed so as to be open only in part of the upper case 100, decrease in the rigidity of the upper case 100 can be suppressed to the minimum.

Since the upper part of a recovery section, described hereinafter, is always covered by the upper case 100, dust or the like can be prevented from attaching to the recovery section and there is also an effect of preventing the user from touching the head accidentally while the carrier 2 is moved to and located at the position of the recovery section for recovery of the head.

The head replacement lid 102 is of a plate-like shape and has a first surface, which is the outside surface when closed, and a second surface, which is opposed to the carrier moving section when closed. The second surface of the head replacement lid 102 is equipped with a head replacement instruction plate 104.

Figure 6:
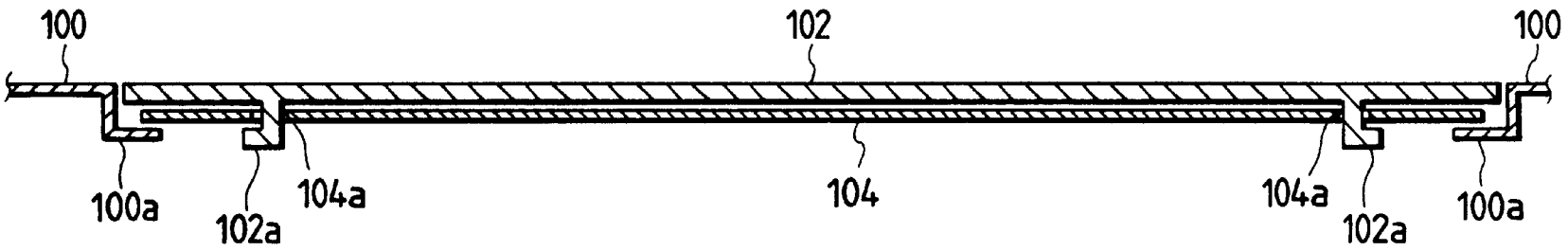
FIG. 6 is a sectional view to show a state in which a head replacement instruction plate is attached to the head replacement lid illustrated in FIG. 5.

The head replacement instruction plate 104 will be explained referring to FIG. 6, FIG. 7, and FIG. 8. FIG. 6 is a sectional view to show a state in which the head replacement instruction plate 104 is attached to the head replacement lid 102, FIG. 7 is a sectional view to show a way of attaching the head replacement instruction plate 104, and FIG. 8 is a detailed diagram to show the details of the head replacement instruction plate.

Figure 8:
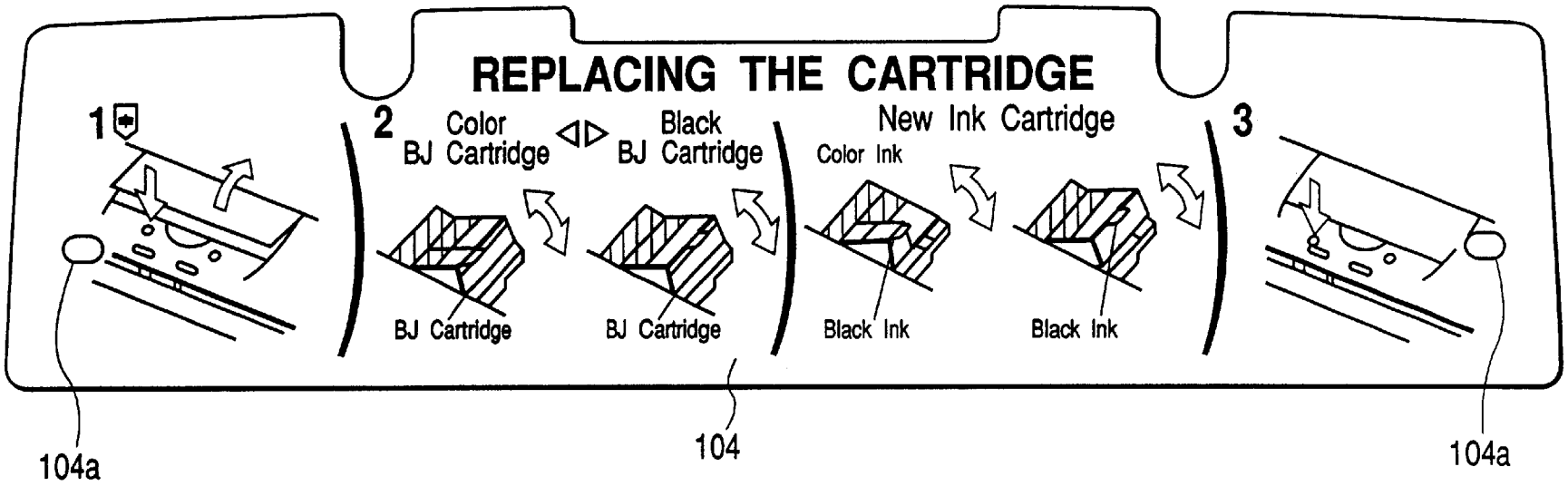
FIG. 8 is a detailed illustration of the head replacement instruction plate illustrated in FIG. 6.

The head replacement plate 104 is a polyester sheet of the thickness of 0.2 mm on which a head replacing method is printed as illustrated in FIG. 8. A reason why the instructions for replacement of head are printed on the separate member is as follows; if the instructions were printed directly on the head replacement lid 102 or if a printed substance were glued thereto they would be foreign matter to constitute hindrance to recycling.

Figure 7:
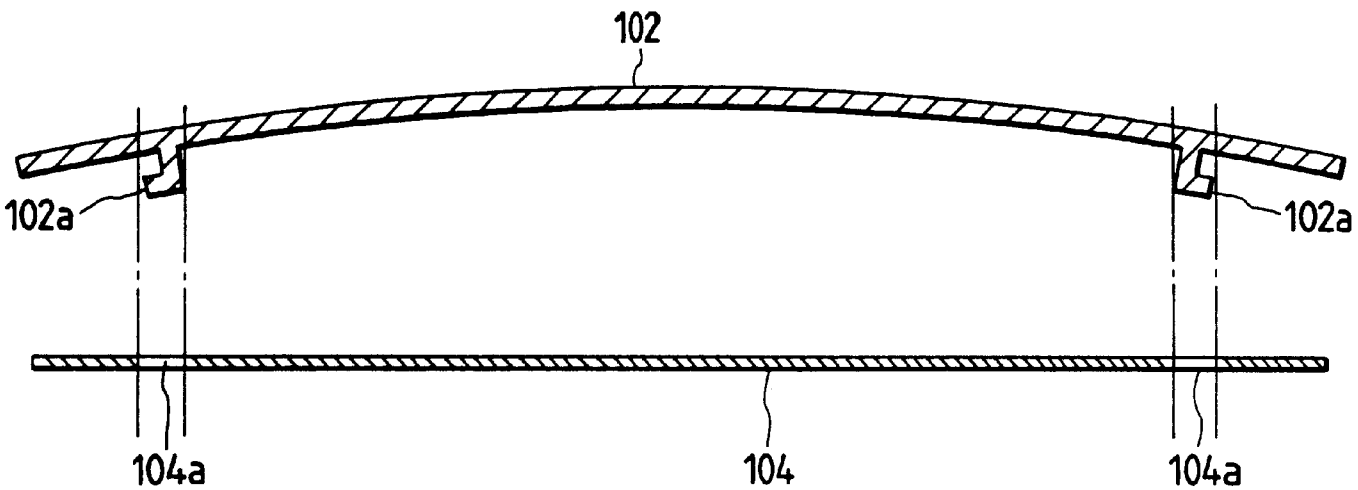
FIG. 7 is a sectional view to show a way of attaching the head replacement instruction plate illustrated in FIG. 6.

The head replacement lid 102 has two hooks 102*a* at two opposite positions as illustrated in FIG. 6 and FIG. 7 and hole portions 104*a* of the head replacement plate 104 are hooked on the hooks 102*a* to be secured. The head replacement instruction plate 104 and the head replacement lid 102 are designed to be about 2 mm larger than the hole portion of the upper case 100, so that they overlap with a step portion 100*a* formed at an opening edge of the hole portion of the upper case 100.

Because of this arrangement, when the head replacement lid 102 is closed, the edge of the head replacement instruction plate 104 is pinched between the head replacement lid 102 and the step portion 100*a* of the upper case, whereby the edge of the head replacement instruction plate 104 is prevented from being suspended and interfering with the carrier 2.

The way of attaching the head replacement instruction plate 104 will be described with reference to FIG. 7.

The head replacement lid 102 is molded of a polycarbonate plastic in 2 mm and is fitted into the holes 104*a* of the head replacement instruction plate 104 while being kept in a bent state as illustrated in FIG. 7. When the head replacement lid 102 is released from the bent state, the head replacement instruction plate 104 is mounted through the hooks 102*a* as illustrated in FIG. 6. The head replacement instruction plate 104 can be detached by the reverse way to the above when it is desired to be separated for recycling.

In the upper surface of this recording device, as illustrated in FIG. 1, FIG. 2, and FIG. 3, there are a power switch 106 for on/off of the power of the device, a power lamp 110 for indicating an on state of the power, an error lamp 109 for indicating an error state of the device, and an error release switch 107 for releasing the error state of the device. The error lamp 109 is turned on when a variety of trouble states occur in the recording device. The error release switch 107 is a switch for releasing an error by being depressed after a trouble state of the recording device is eliminated.

Further, on one side surface of the recording device there are provided a hold switch 105 for disabling the power switch 106 so as to prevent the power from becoming on accidentally under the carrying condition of the recording device (printer), and a power connector 117 through which the power is supplied to the recording device.

On another side surface of the above recording device there are provided an interface connector 118 to which a signal cable from a host computer is connected, and an infrared communication port 120 for infrared communication. The interface connector 118 is covered by an interface connector cover 119. The interface connector cover 119 is molded of an elastic material and one end of the interface connector cover 119 is fixed to the upper case 100 while the other end is a free end. A hinge portion 119*a* of the cover 119 is molded so as to be thinner than the other portions, thereby having the hinge function. The material selected is a thermoplastic polyurethane having excellent tear resistance and having adibate type hardness 85 (Shore A).

In this recording device, a sheet is inserted through the sheet feed port 121 as illustrated in FIG. 3 and is discharged through the sheet discharge port 122 (see FIG. 1).

In the unused state the sheet feed tray 111 is closed as illustrated in FIG. 2; in the used state the sheet feed tray 111 is opened as illustrated in FIG. 3 and in that state the sheet feed tray 111 guides a recording sheet 22 to be fed.

The sheet feed tray 111 is equipped with an integral left guide portion 111*a* which is a reference for insertion of sheet. The left reference position in the sheet feed direction is always constant, irrespective of the sizes of sheets. On the other hand, a right guide 112 for guiding the right edge of recording sheet 22 is used in such a manner that the user slides the right guide 112 so as to match with the size of each sheet.

Figure 9:
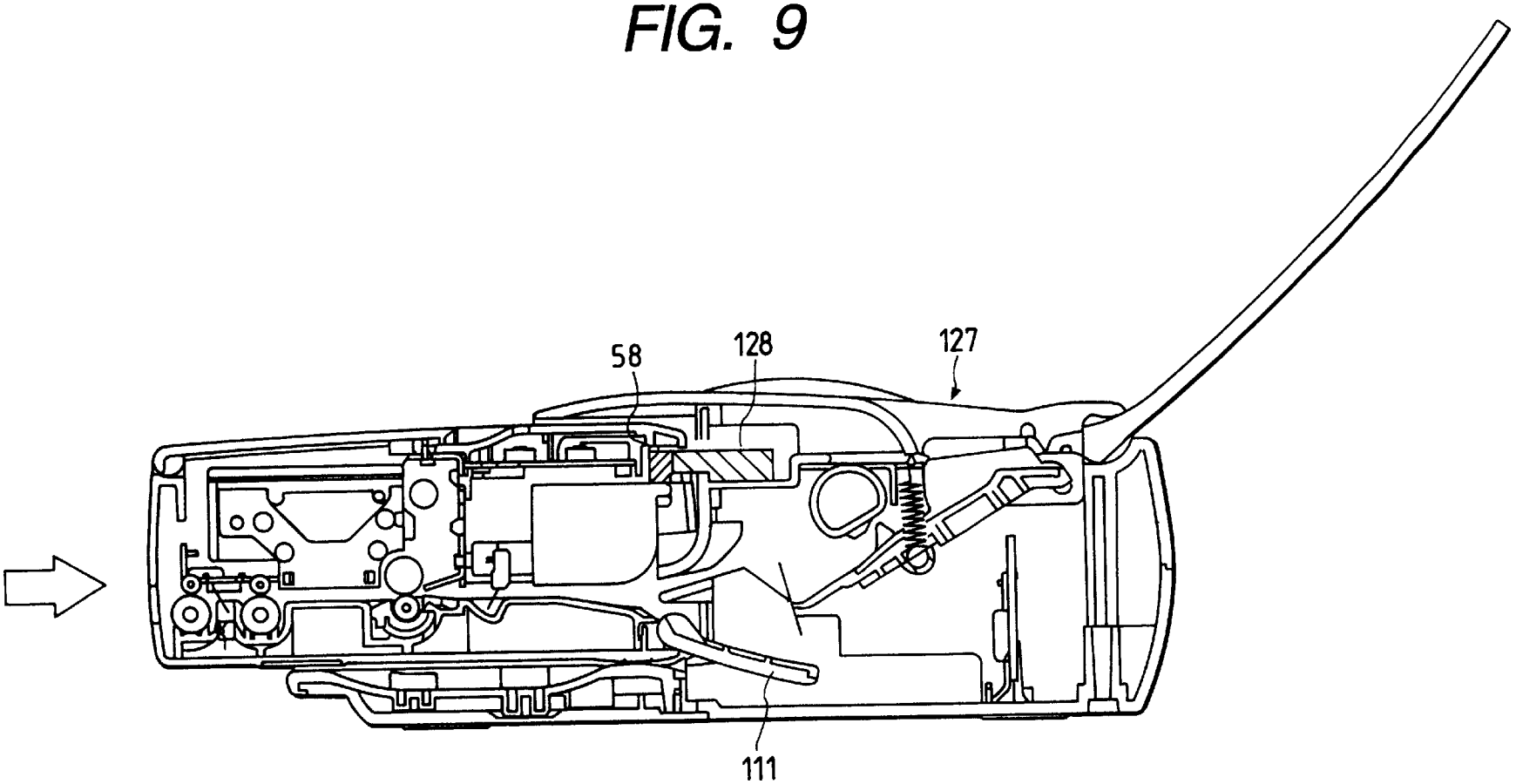
FIG. 9 is a sectional view to show a state in which an automatic sheet feeder (ASF) is mounted on the recording device as an embodiment of the present invention.

The device has an option connector 58 in the surface of the sheet feed port 121. The option connector 58 is covered by an option connector cover 126 in the unused state (see FIG. 2). One of options of this recording device is an automatic sheet feeder (ASF) illustrated in FIG. 9. The ASF 127 has an ASF connector 128 to be connected to the option connector 58. This recording device and the ASF 127 are slid relative to each other in the direction of the arrow in FIG. 9 to be incorporated. Since the sheet pass direction and the incorporating direction are identical at this time, a space for discharge of sheet is normally secured in the discharge direction at the installation place of the ASF 127. Therefore, mounting is easy. For example, if a method for connecting them in a direction orthogonal to the sheet path were employed, a space would be also necessary beside the ASF 127 and the installation place would be limited. In addition, since the sheet pass direction and the incorporation releasing direction are identical, a jammed sheet can be handled readily.

The ASF 127 has a conveying mechanism composed of various rollers, their driving sources, etc. for conveying the sheet and this conveying mechanism is arranged to be covered by an exterior cover. This exterior cover of the ASF 127 can also be constructed similarly to the exterior cover of the recording device described referring to FIG. 4.

Since the ASF has the option connector 58 in the same surface as the sheet feed port 121 when coupled with the recording device, connection to the ASF connector 128 is also achieved at the same time without care of the user as the occasion of incorporation, which can eliminate a work for connection and which can prevent troubles such as failure in connection, insufficient insertion of the connector, and so on.

This recording device incorporates a battery and is designed with consideration to the principal purpose for portable use.

Since lengths of palms range approximately from 70 mm to 120 mm, the thickness suitable for portability is not more than 60 mm, taking ease to grip into consideration. Therefore, the size of the device is set to the width of about 300 mm, the depth of about 110 mm, and the thickness of about 50 mm, which are dimensions that permit the device to be gripped by hand, so as to enhance the portability.

The portability is also enhanced as follows; the total weight of the recording device is reduced to about 900 g by the weight-reducing technology including the aluminum pinch rollers, hollow sheet feed rollers, hollow guide shafts, the lithium ion battery having good volume efficiency, and so on.

Figure 46A:
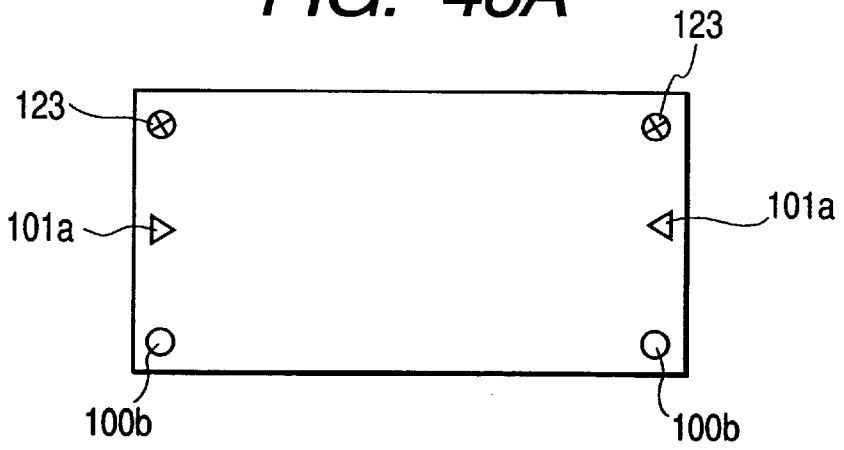
FIG. 46A, FIG. 46B, and FIG. 46C are diagrams to show arrangement examples of screws, claws, and projections in the housing of the recording device as an embodiment of the present invention.
Figure 46B:
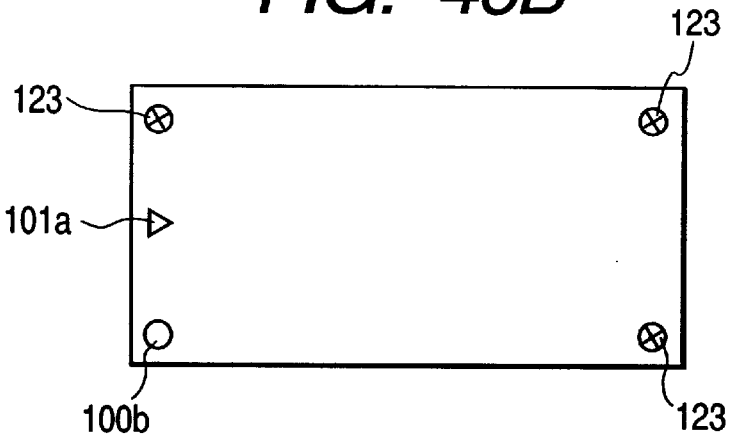
Figure 46C:
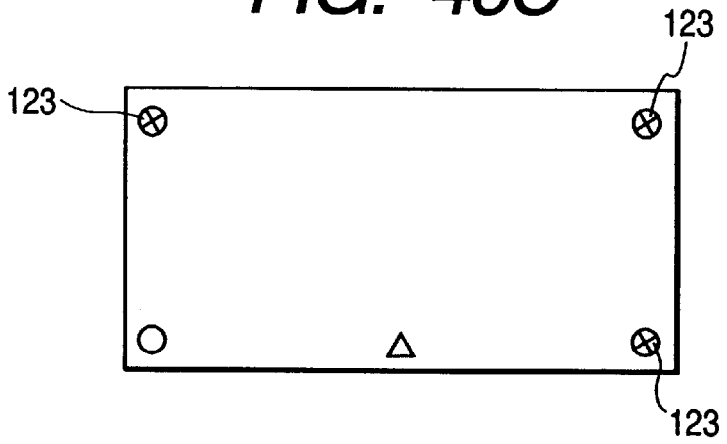
Figure 47:
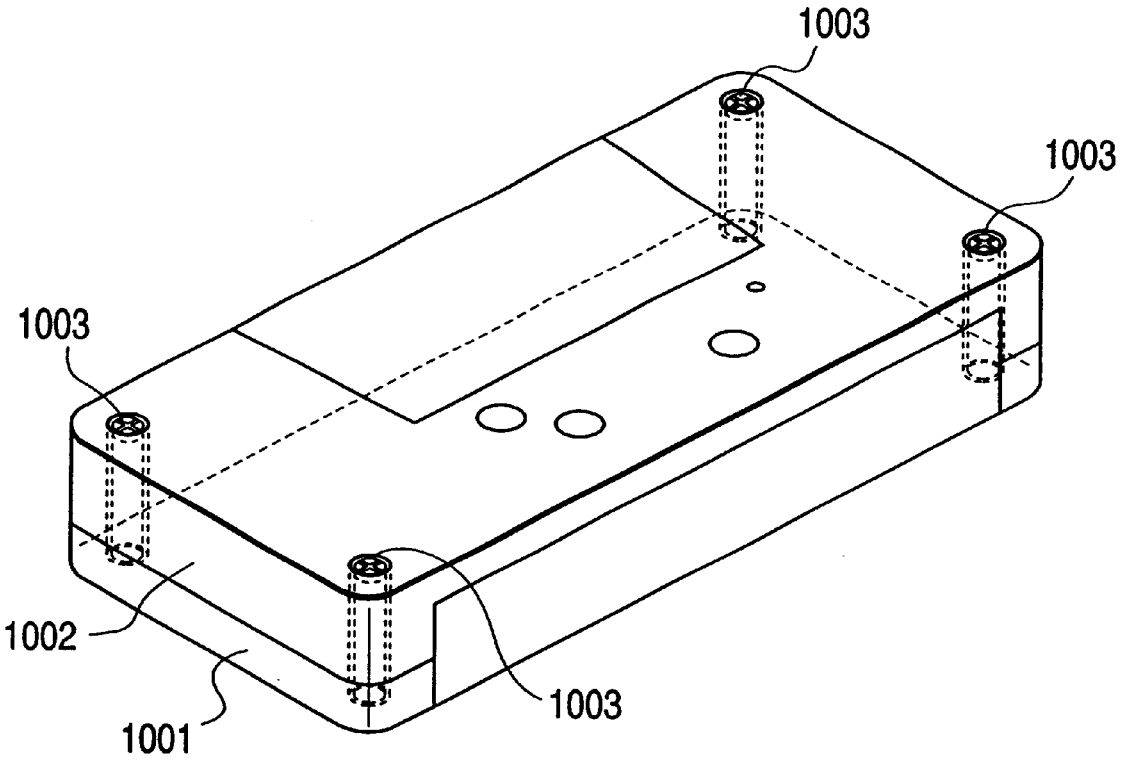
FIG. 47 is a diagram to show the appearance of the conventional recording device.

FIGS. 46A to 46C show some examples of arrangements of screws 123, projection(s) 101*a,* and claw(s) 100*b,* as top plan views of the recording device. The example illustrated in FIG. 46A is the arrangement described referring to FIG. 4 and other figures. Other arrangements may also be configured as follows; as illustrated in FIG. 46B, there is a claw portion 100*b* provided at one of the four corners of the housing, three screws 123 are tightened at the three remaining corners, and a projecting portion 101*a* is provided in an intermediate portion of the shorter side of the housing; or, as illustrated in FIG. 46C, the claw portion 100*b* and screws 123 are arranged in the same configuration as in FIG. 46B and the projection 101*a* is provided in an intermediate portion of the longer side of the housing.

[Overall Inside Structure]

Figure 10:
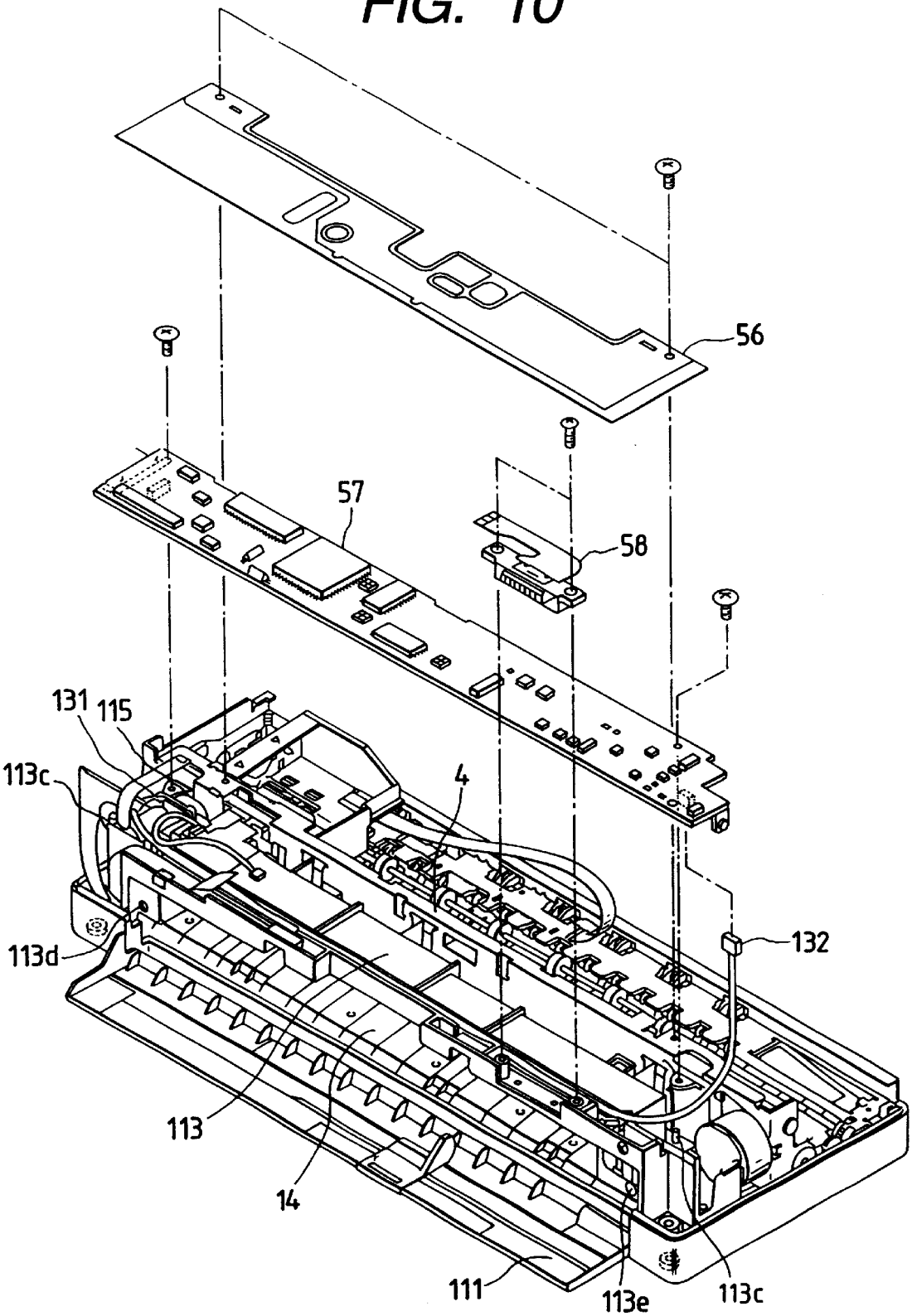
FIG. 10 is an exploded perspective view to show the internal structure of the recording device as an embodiment of the present invention.
Figure 11:
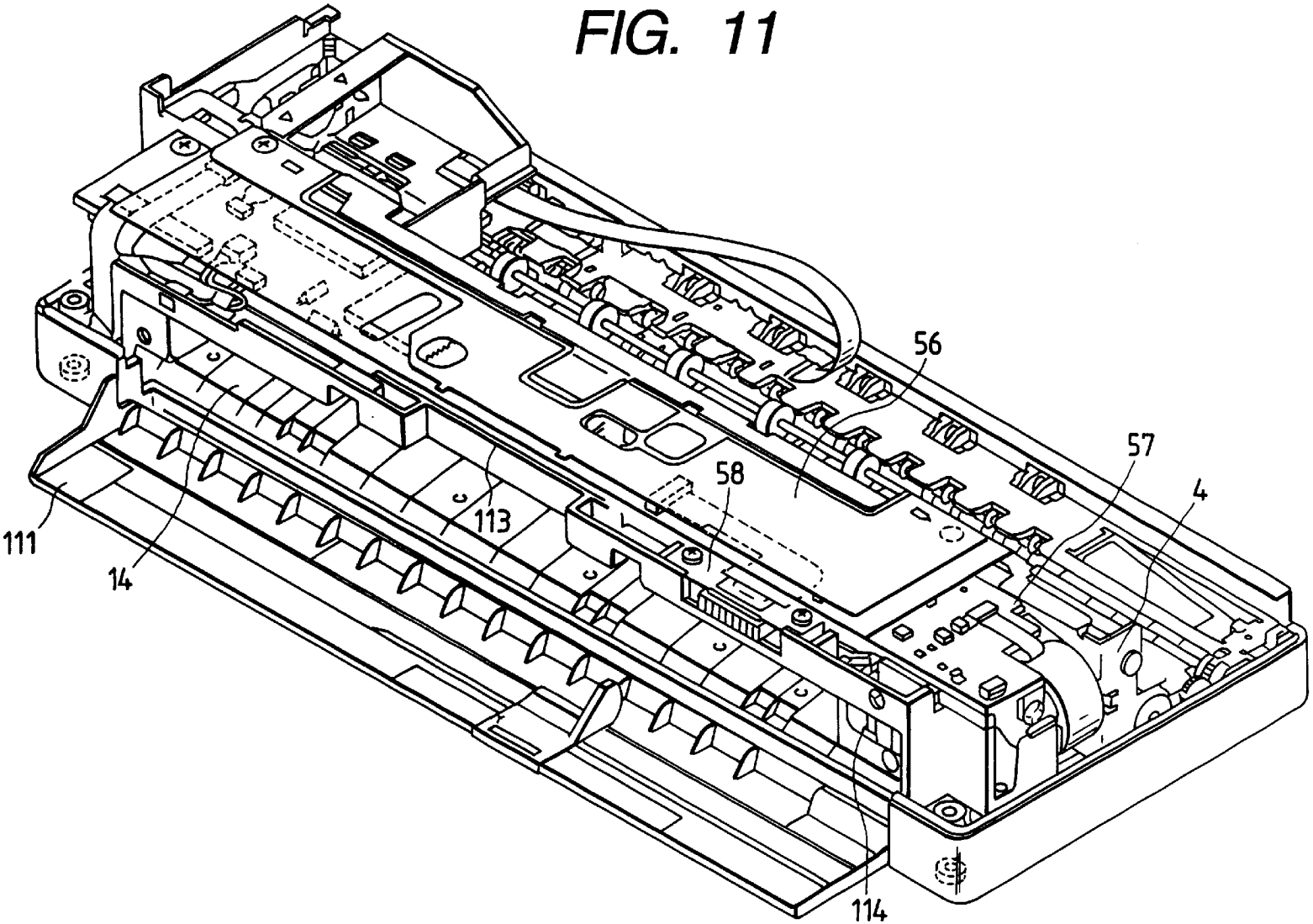
FIG. 11 is an exploded perspective view to show the internal structure of the recording device as an embodiment of the present invention.

FIG. 10 and FIG. 11 are exploded perspective views to show the inside structure of the recording device as an embodiment of the present invention.

In FIG. 10 and FIG. 11, a platen 14 constitutes the recovery system part described hereinafter, the lower part of the sheet feed section, and the like. A frame 4 made of aluminum for reduction of weight holds the carrier moving section described hereinafter, the upper part of the sheet feed section, and so on, thereby constituting the recording device.

The platen 14 and frame 4 are positioned by engagement between bosses of the platen 14 and cut portions of the frame 4 provided on the sheet discharge side in the left and right side surfaces and they are fixed by hooking the frame 4 on claw portions provided on the sheet feed side in the left and right side surfaces of the platen 14.

On the sheet feed side of the frame 4, a holder 113 illustrated in FIG. 10 and FIG. 11 is positioned at two locations of bosses not illustrated and it is fixed at three positions of claws provided in the upper part and at one position of a screw provided in the lower central part. This holder 113 has the function for detachably holding the battery, the function for holding the circuit board 57, the function for guiding an upper path during feed of recording sheet 22, and so on.

Figure 12:
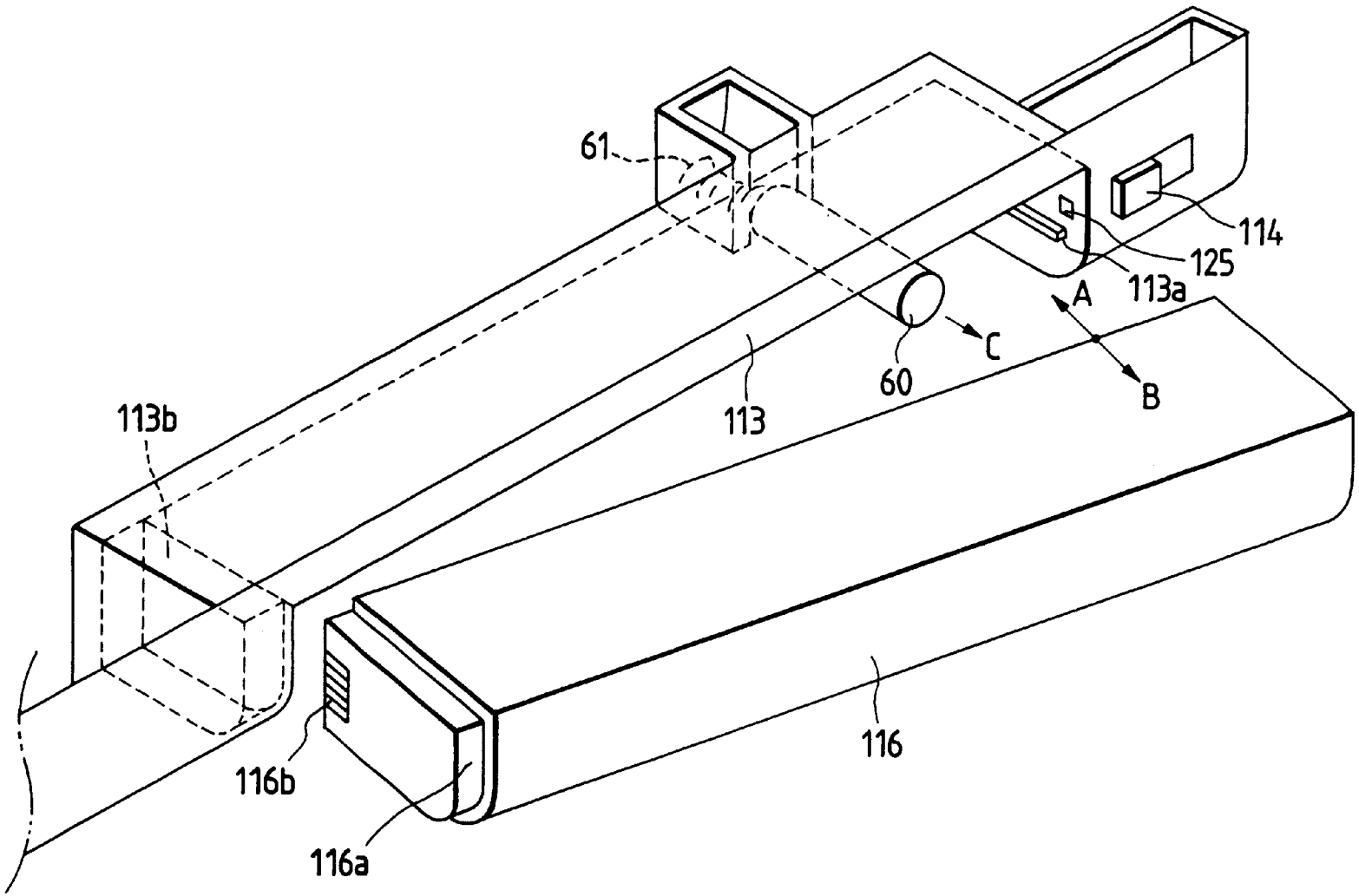
FIG. 12 is a perspective view to show an enlarged illustration of a battery holding structure of a substrate holder illustrated in FIG. 10 and FIG. 11.

First, the battery holding function of the holder 113 will be described, also using FIG. 12 and FIG. 13. FIG. 12 is a perspective view to show an enlarged view of the battery holding structure of the holder 113 and FIGS. 13A and 13B are perspective views to show the structure of the battery.

Outside a wall of the holder 113 on the left side when seen from the sheet feed side of the recording sheet 22, battery contacts 115 having four male terminals are retained in a soldered state to a battery substrate (not illustrated). The male terminals of the battery contacts 115 are projecting into a holder recess portion 113*b* for accommodating the battery 116. A battery cable 131 from the battery substrate (not illustrated) is connected through a battery connector 132 to the board 57.

In the opposite surface (on the right side) to the holder recess portion 113*b,* there are provided a holder rail 113*a* approximately parallel to the sheet pass direction in the holder 113, and a battery hook 125 arranged to move in and out as being slid. The battery hook 125 moves in and out in conjunction with sliding operation of a battery lock lever 114. The battery hook 125 is always urged in a projecting state by a battery hook spring (not illustrated).

Figure 13A:
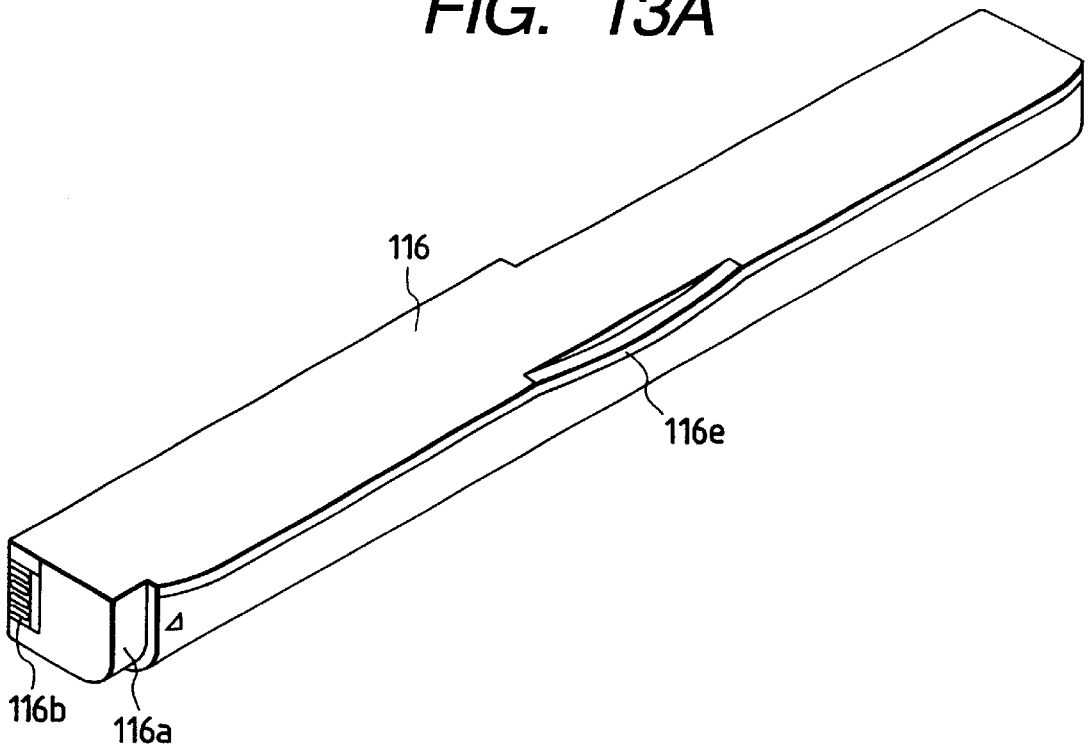
FIG. 13A and FIG. 13B are perspective views to show the structure of the battery illustrated in FIG. 12.
Figure 13B:
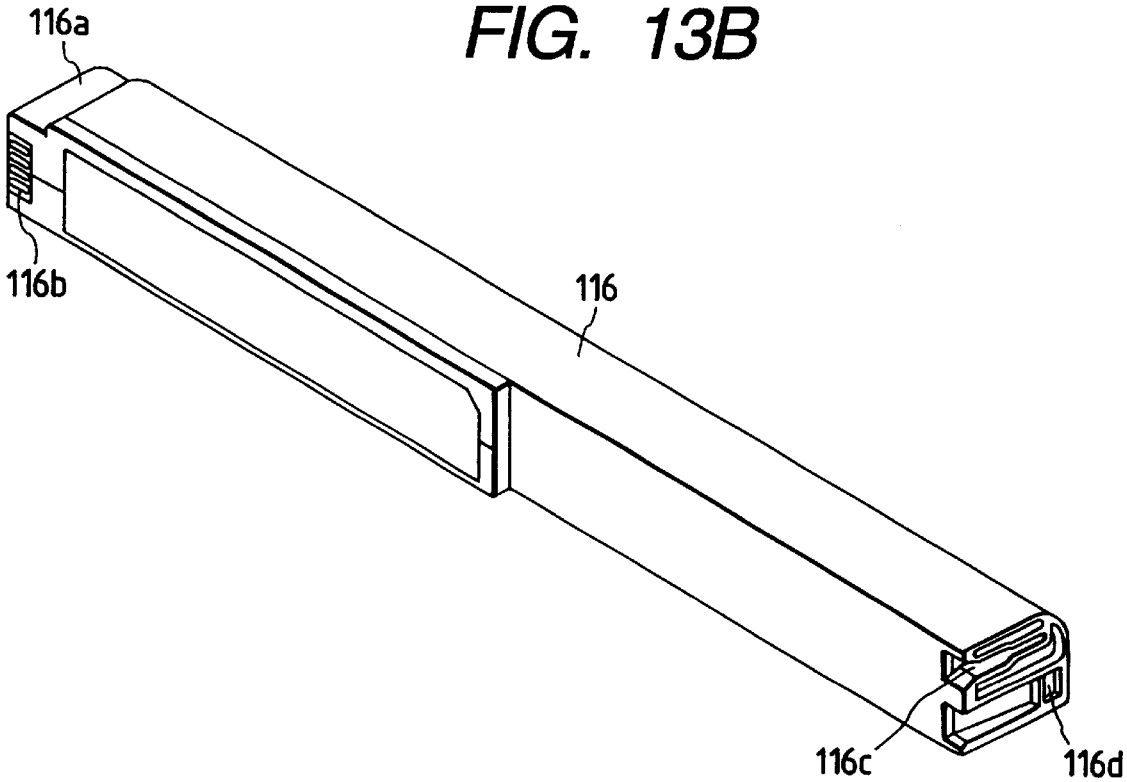

As also illustrated in FIGS. 13A and 13B, a battery step portion 116*a* is provided at the end of the battery 116, corresponding to the holder recess portion 113*b* of the holder 113, and battery female contacts 116*b* are formed at positions to be coupled to the battery contacts 115. At the other end a battery groove 116*c* is provided corresponding to the holder rail 113*a* and a battery recess portion 116*d* is provided corresponding to the battery hook 125.

In this structure the battery step portion 116*a* of the battery 116 is inserted into the holder recess portion 113*b* of the holder 113. Then the battery contacts 115 are coupled to the battery female contacts 116*b* and the battery 116 is turned in the direction of arrow A of FIG. 12 and is further turned up to the end while the holder rail 113*a* at the opposite end is put into the battery groove portion 116*c,* whereupon the battery hook 125 becomes fitted in the battery recess portion 116*d* by spring force of the battery hook spring (not illustrated) so as to fix the battery 116.

On the far side of the holder 113 where the battery 116 is stored and on the near side to the mount portion of the battery hook 125, a battery pop-up rod 60 is urged by a battery pop-up spring 61 in such a direction as to push the battery 116 out. When the battery lock lever 114 is slid against the force of the battery hook spring (not illustrated), the battery hook 125 moves in conjunction therewith to disengage the coupling with the battery recess portion 116*d* and the battery pop-up rod 60 pops up in the direction of arrow C in FIG. 12 because of the force of the battery pop-up spring 61, thereby pushing the battery 116 out by the force. Then the battery 116 is turned in the direction of arrow B of FIG. 12 about the contact portion between the battery contacts 115 and the battery female contacts 116*b*, whereby the battery 116 can be dismounted.

The battery 116 will be described briefly referring to FIGS. 13A and 13B. The battery 116 has battery cells (not illustrated) arranged in series inside and is closed by welding. Further, a battery rib 116*e* is provided in the front width in the upper part of the front of the battery 116 in order to prevent the dust from intruding when the sheet feed tray 111 is closed. The central part of this battery rib 116*e* is a little lowered downward in such an arcuate shape as to prevent a finger from touching it when the sheet feed tray 111 is opened.

Next described is the function for guiding the upper path on the occasion of feeding the recording sheet 22.

Figure 17:
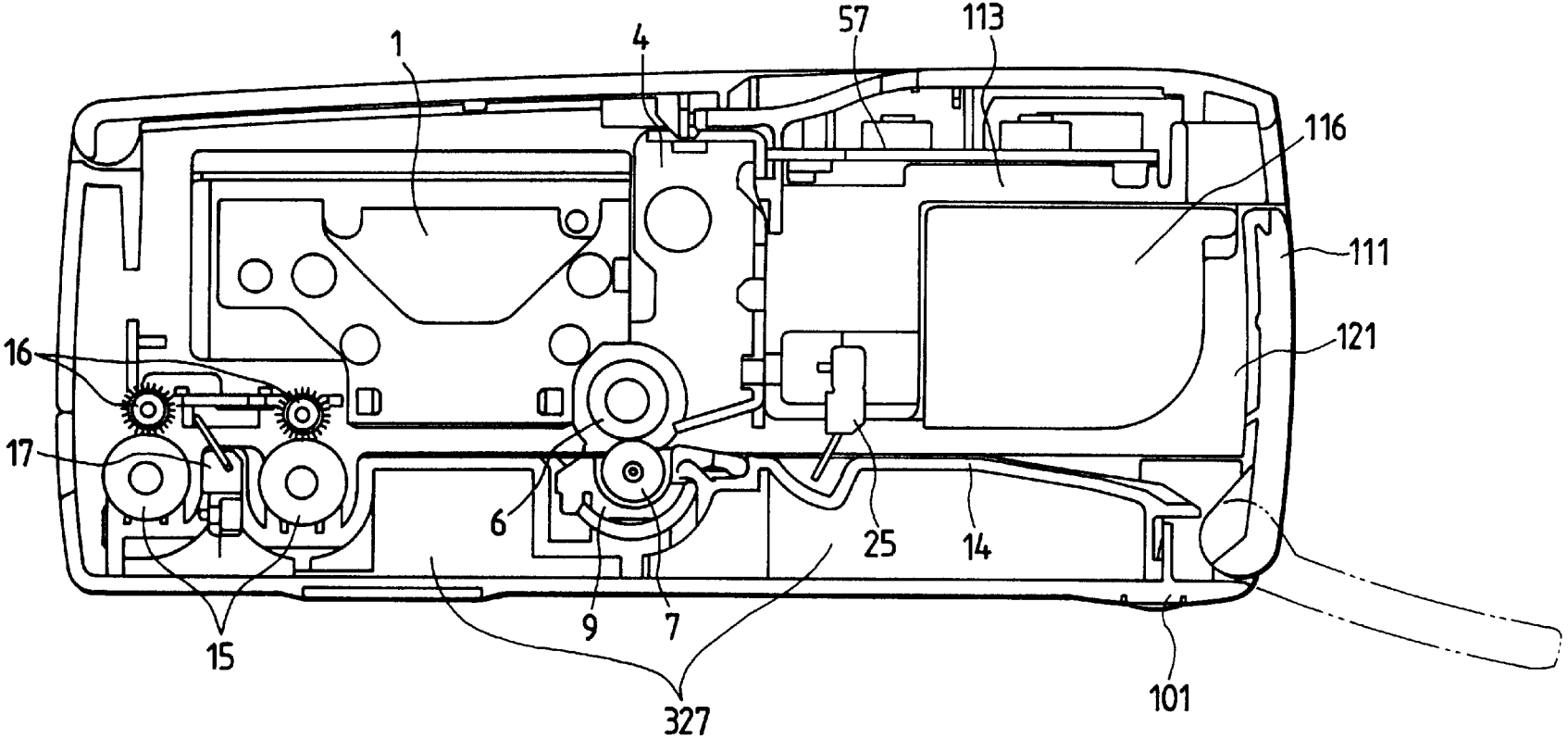
FIG. 17 is a sectional view of the recording device as an embodiment of the present invention.

As also shown in FIG. 17, the holder 113 and battery 116, when seen from the sheet feed side of the recording sheet 22, are so round in the front lower part as to facilitate the sheet feeding. Further inside thereof, the sheet feed path of the recording sheet 22 is formed by the platen 14 in the lower part and by the holder 113 and battery 116 in the upper part, these members also serving as a guide of the sheet feed path.

Further, as illustrated in FIG. 10, the holder 113 is provided with holder bosses 113*c* in the left and right upper portions this side on the sheet feed side, these holder bosses 113*c* being inserted into hole portions of the circuit board 57 to position and support the board 57. That side of the board 57 is fixed with screws at two positions left and right on the frame 4. The board 57 is grounded through this part. In addition, the option connector 58 is fixed and held on the holder 113 with two screws.

Further, as illustrated in FIG. 17, a paper sensor 25 is held in the lower part of the holder 113, i.e., on the sheet pass side where the recording sheet 22 passes.

A secondary coin battery (not illustrated) for retention of memory is held and accommodated in the part surrounded by the holder 113.

In FIG. 10, in the front part on the sheet feed side of the holder 113 there are a holder hole portion 113*d* on the left side and a holder elongate hole portion 113*e* on the right side, provided as positioning portions for the ASF 127.

Figure 14:
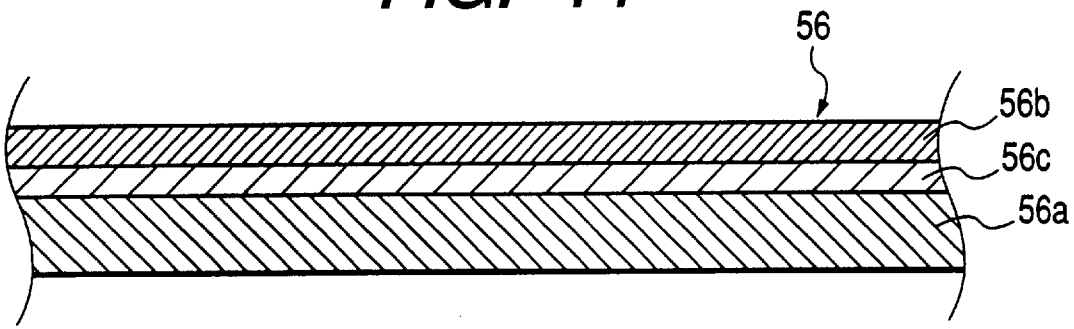
FIG. 14 is a sectional view to show the structure of a shield plate illustrated in FIG. 10 and FIG. 11.

Now, let us explain the shield plate 56 illustrated in FIG. 10, with reference to FIG. 14. FIG. 14 is a sectional view to show the structure of the shield plate 14.

The shield plate 56 is constructed in such structure that there is an aluminum foil 56*b* having an electrically conductive property in the upper part, there is a PET 56*a* having an electrically insulating property in the lower part, and the aluminum foil 56*b* and the PET 56*a* are bonded to each other by an adhesive layer 56*c*.

The shield plate 56, as illustrated in FIG. 10, is fixed at two positions to the frame 4 with screws electrical conduction with the frame 4 is achieved by contact of the screws with the aluminum foil 56*b* in the upper part of the shield plate 56. The frame 4 is electrically connected to the ground not illustrated.

Therefore, the shield plate 56 covers the upper surface of the board 57, thereby presenting the shielding effect of radiant noise radiated from the board 57.

Under low-humidity circumstances there is the possibility that static electricity is accumulated in the body of the user and atmospheric discharge takes place to the recording device when the user manipulates the recording device. This voltage could reach 40 kV in certain cases and, if discharged to the pattern 57*a* of the board 57, it could damage the devices on the board 57 so as to cause a malfunction. In such cases, since the board 57 is covered by the shield plate 56, the static electricity flows through the aluminum foil 56*b* to the ground, whereby the devices on the board 57 can be protected.

The thicknesses of the members forming the shield plate 56 are determined as follows; the thickness of the aluminum foil 56*b* of the shield plate 56 is t=50 $\mu$m, the thickness of the PET 56*a* of the shield plate 56 is t=100 $\mu$m, and the thickness of the adhesive layer 56*c* of the shield plate 56 is t=40 $\mu$m.

These thicknesses are determined according to the following. If the aluminum foil 56*b* of the shield plate 56 is thinner than the above thickness it will be difficult to handle in production and creases will appear therein. If the PET 56*a* of the shield plate is thinner than the above thickness creases will appear when it is fixed to the frame 4 with screws.

The shield plate 56 is made of self-extinguishing, flame-retardant materials.

Figure 15:
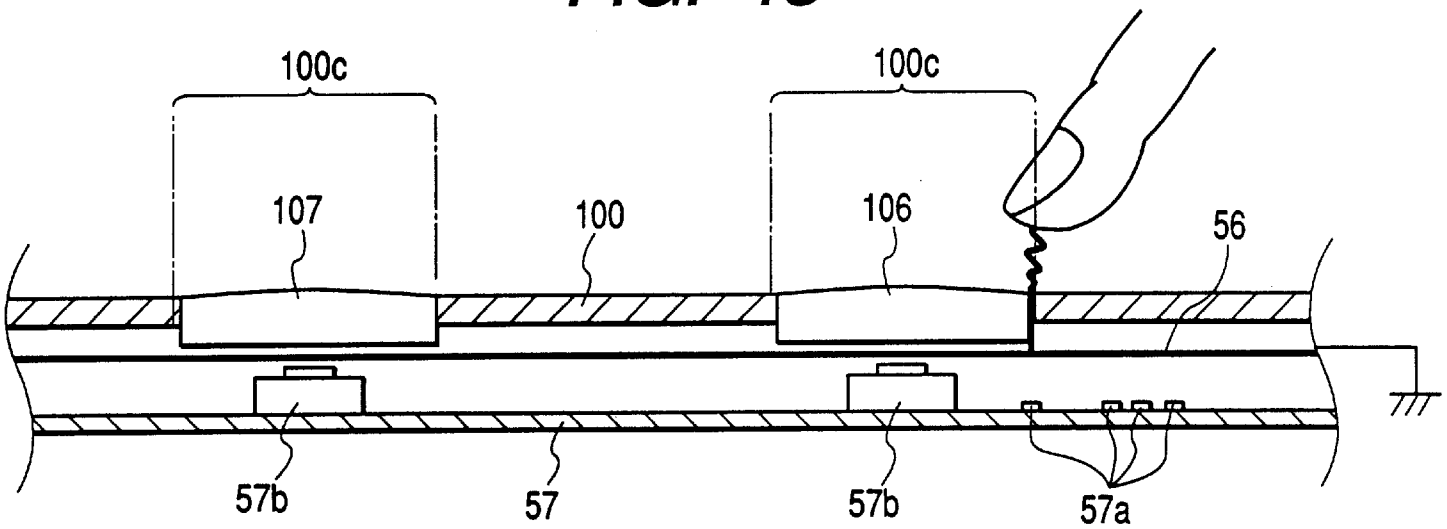
FIG. 15 is a sectional view to show the arrangement and structure of an upper case, a power switch, an error release switch, a shield plate, and a substrate in the recording device as an embodiment of the present invention.

We will explain the structure to show the arrangement of the upper-case 100, the power switch 106 and the error release switch 107, the shield plate 56, and the board 57 with reference to the sectional view of FIG. 15.

As illustrated in FIG. 15, the power switch 106 and the error release switch 107 are attached with elasticity so as to project their control surface out of hole portions 100*c* of the upper case 100.

Tact switches 57*b* are disposed through the shield plate 56 on the board 57 immediately below the power switch 106 and the error release switch 107. Accordingly, each of the tact switch 57*b* corresponding to the power switch 106 and the tact switch 57*b* corresponding to the error release switch 107, disposed above the board 57, is depressed through the shield plate 56. Similarly, a tact switch corresponding to a head replacement switch, not illustrated in FIG. 15, is also depressed through the shield plate 56.

The holes 100*c* are formed with a clearance of about 0.2 mm to the power switch 106 and to the error release switch 107 so as to avoid dimensionally interfering therewith.

In this structure, when the user with charge manipulates either of the switches, the static electricity is discharged through the clearance between the hole 100*c* of the upper case 100 and the power switch 106 or the error release switch 107. Since the shield plate 56 is electrically connected to the ground, the static electricity flows to the ground, so as to protect the devices and the pattern 57*a* on the board 57.

[Carrier Moving Section]

Figure 16:
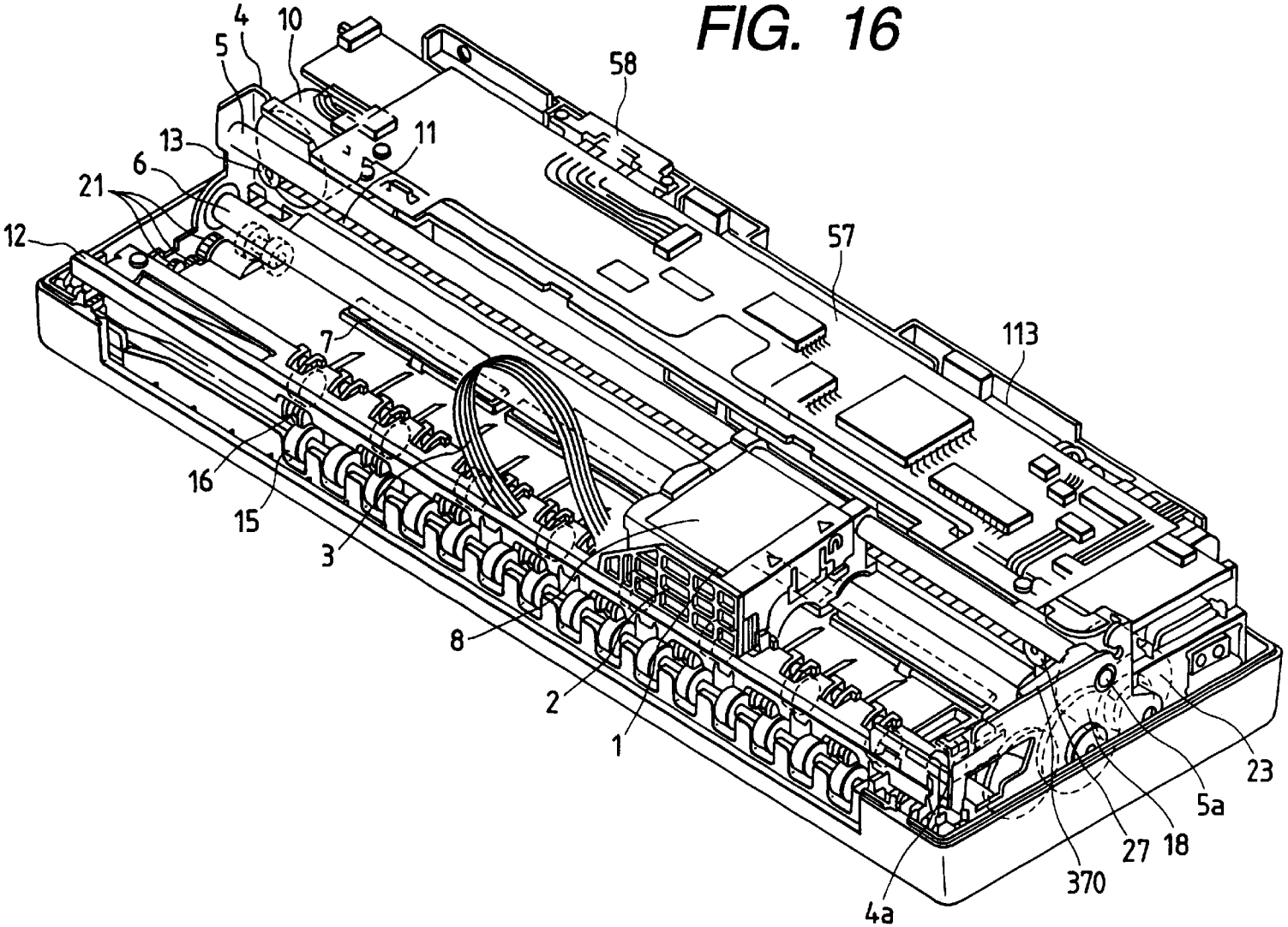
FIG. 16 is an exploded perspective view, seen from the sheet discharge side, of the internal structure of the recording device as an embodiment of the present invention.

FIG. 16 is an exploded perspective view of the inside structure of the recording device, seen from the sheet discharge side, as an embodiment of the present invention.

The present device is equipped with the carrier 2 for detachably holding the recording head cartridge 1 as illustrated in FIG. 16. The carrier 2 is supported so as to be slidable in the main scanning directions intersecting with or being orthogonal to the conveyance direction of the recording sheet not illustrated (which is a recording medium including a flexible sheet which is recordable, such as a plastic sheet) and along the surface of the recording sheet 22 on the guide shaft 5 and guide rail 12 fixed at the both ends on the frame 4 and arranged in parallel to each other.

The guide shaft 5 is a thin, hollow shaft of a pipe shape, inside one end of which a plug 5*a* is fixed, the plug 5*a* being provided with a groove portion for attachment of a lock arm 370 and for securing the guide shaft 5 to the frame 4.

The carrier 2 is coupled to a portion of a belt 11 stretched between a driving pulley 13 driven to rotate by a carrier motor 10 fixed to the frame 4 and a driven pulley (idle pulley) 27 supported through an unrepresented spring to the frame 4 so as to be slidable in a direction parallel to the guide shaft 5 and rotatable. When the carrier motor 10 is actuated, the belt 11 is driven to reciprocate the carrier 2 in the aforementioned directions along the guide shaft 5 and the guide rail 12.

An ink tank 8 is mounted on a detachable basis on the recording head cartridge 1. When ink is used up by recording, the ink tank 8 is replaced with another, so as to permit next recording.

The present device is further provided with a home position sensor (not illustrated) for detecting the position of the carrier 2 by detecting passage of the carrier 2 and a flexible cable 3 for transmitting an electric signal from the control board 57 to the recording head cartridge 1.

[Sheet Feed Section]

Next, the structure for conveying the recording sheet 22 will be described referring to FIG. 16.

The sheet feed roller 6 is supported so as to be rotatable on the frame 4 and the LF gear 18 is fixed to the shaft end of the sheet feed roller 6. This sheet feed roller 6 is made of a thin, hollow shaft of a pipe shape having the outer periphery coated with an urethane coating for decreasing the weight. This pipe shape measures the outside diameter of 7.561 mm, the inside diameter of 5 mm, and the thickness of the pipe of t=1.28 mm. These dimensions are determined based on trade-offs among the runout accuracy and peripheral tolerance in manufacturing, the reduction of weight, and strength issues of the frame 4 etc. in the event of a drop. Then the sheet feed roller 6 is rotationally driven through the LF gear 18 by the sheet feed motor 23.

FIG. 17 is a sectional view of the recording device as an embodiment of the present invention.

As illustrated in this figure, the lower side of the sheet conveyance surface is composed mainly of the platen 14. The platen 14 is incorporated along the inside wall of the lower case 101 and the area between the platen 14 and the lower case 101 is of a box structure having a space for storing a waste ink absorber 327 described hereinafter. In this state the platen 14 is fastened to the lower case 101 with screws, thereby correcting warpage of each component and enhancing the rigidity of the device.

On the surface of the platen 14 there are a plurality of projection-shape ribs formed along the conveyance direction of the recording sheet 22 in order to reduce sticking of the recording sheet 22 due to the static electricity and the sliding loads during conveyance.

A pinch roller 7, which is held by a pinch roller holder 9 rotatably attached to the platen 14, is urged against the sheet feed roller 6 from the bottom by an unrepresented spring and the unrepresented recording sheet pinched between the sheet feed roller 6 and the pinch roller 7 is conveyed by driving of the sheet feed motor 23 (see FIG. 16).

The diameter of the peripheral part of the pinch roller 7, which cooperates with the sheet feed roller 6 so as to pinch the recording sheet 22 between them, is a little smaller than that of the sheet feed roller 6; the outside diameter is 6 mm. A ratio of the outside diameter of a rotation shaft portion held by the pinch roller holder 9 to the diameter of the peripheral part of the pinch roller 7 is 2:15 and the diameter of the shaft is 0.8 mm. Further, the pinch roller 7 is made of aluminum, which is a lightweight metal. Since the pinch roller 7 is thus light in weight and low in rotation loads, it can feed the recording sheet 22 with little loss in conveyance thereof. Since the outside diameter of the pinch roller 7 and the outside diameter of the sheet feed roller 6 are almost equal, it is easier to guide the unrepresented recording sheet to the contact (nip) between the pinch roller 7 and the sheet feed roller 6 during the feeding operation of the sheet and this structure can thus reduce the force for pushing the leading end of the recording sheet into the nip.

The aforementioned peripheral part and shaft part of the pinch roller 7 made of aluminum are subjected to an Alodine process (Alodizing process), so as to reduce corrosion due to ink mist contained in the atmosphere inside the device because of the ink discharged from the recording head cartridge 1 and wear occurring after sliding against the pinch roller holder 9 over a long period. Therefore, there is little increase in the rotation loads on the pinch roller 7 even after long-term use.

On the opposite side to the sheet feed roller 6 with the recording head cartridge 1 in between, there are two lines of sheet discharge rollers 15 for discharging the recording sheet after recording to the outside of the device, attached to the platen 14. When driving force is transmitted through a train of idle gears 21 (see FIG. 16) from the sheet feed roller 6, the sheet discharge rollers 15 rotate in synchronism with the sheet feed roller 6. Spur wheels 16 attached to the guide rail 12 are placed above the sheet discharge rollers 15 and the sheet discharge rollers 15 are urged against the spur wheels 16 from the bottom by an unrepresented spring, whereby the recording sheet after recording is conveyed while being pinched between the sheet discharge rollers 15 and the spur wheels 16.

There is the paper sensor 25 on the sheet feed port 121 side opposite to the recording head cartridge 1 with the sheet feed roller 6 in between and there is a sheet discharge sensor 17 between the two lines of sheet discharge rollers 17, the sensors being arranged to detect whether a recording sheet is present or absent near each position.

Figure 18:
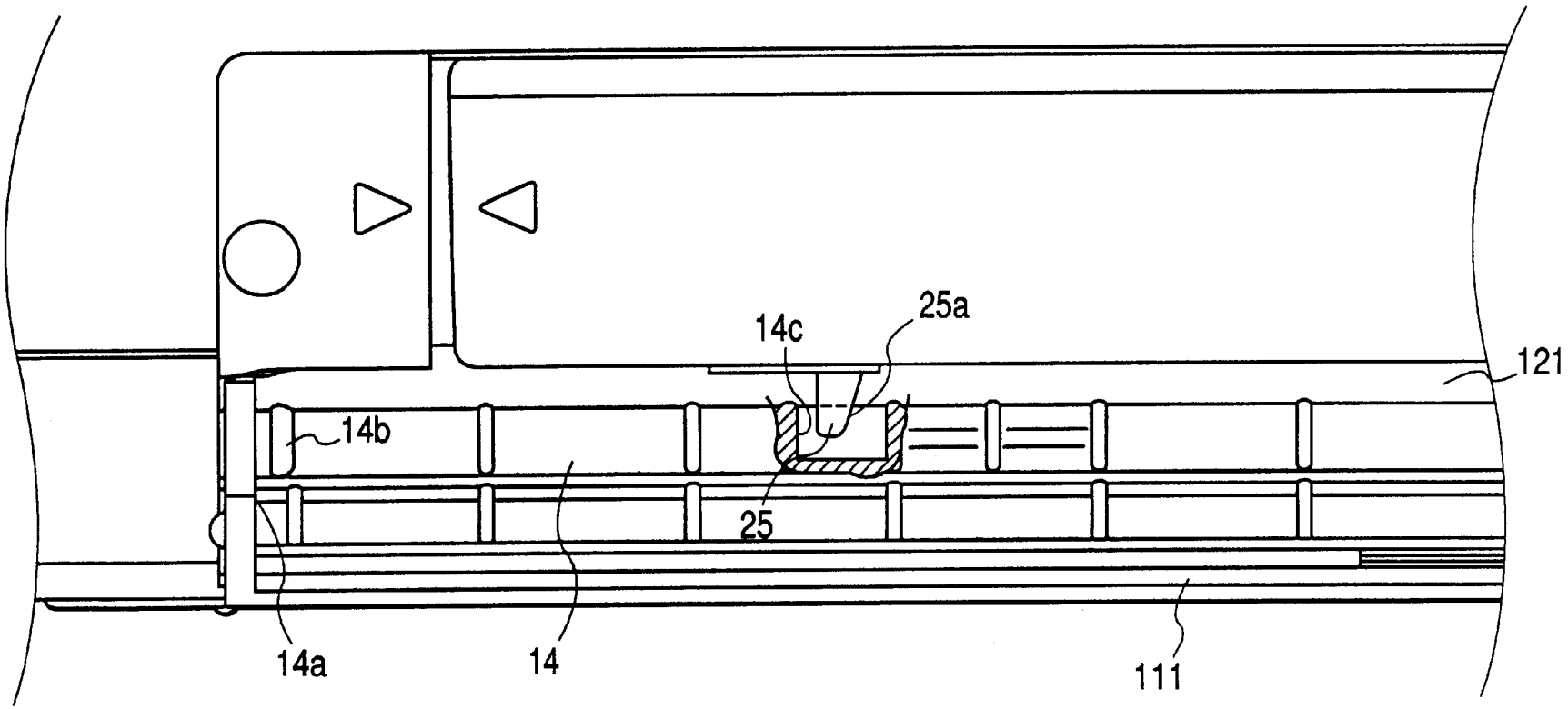
FIG. 18 is a front view to show the sheet feed port side of the recording device as an embodiment of the present invention.

FIG. 18 is a front view to show the sheet feed port side of the recording device as an embodiment of the present invention.

The platen 14 has a sheet guide portion 14*a*, which is used as a reference on the occasion of insertion of the recording sheet, at the left end thereof when seen from the sheet feed port side. There are a plurality of projection-shape ribs formed on the surface of the platen 14 and a rib 14*b* closest to the sheet guide portion 14*a* out of these ribs forms a gentle slope only in a slant surface on the opposite side to the sheet guide portion 14*a* in order to prevent the recording sheet from being caught thereby when shifted to the sheet guide portion 14*a*.

The platen 14 further has a recess portion 14*c* which receives the fore end of the paper sensor 25 when no recording sheet is inserted.

The paper sensor 25 has a taper portion 25*a* on the opposite side to the sheet guide portion 14*a*. This can prevent damage of the recording sheet or the paper sensor 25 in cases where the recording sheet is first inserted over the paper sensor 25 on the far side from the sheet guide portion 14*a* with respect to the paper sensor 25 and thereafter the recording sheet is shifted toward the sheet guide portion 14*a*.

[Recording Section]

The function of the present device as a recording device is to perform one-line recording on the recording sheet in such a manner that the recording head cartridge 1 ejects the ink according to a recording signal toward the lower surface of the device in FIG. 16 in synchronism with the reciprocating movement of the carrier 2. More specifically, this recording head cartridge 1 has small liquid discharge ports (orifices), liquid paths and energy acting portions provided in part of the liquid paths, and energy generating means for generating droplet-forming energy which is made to act to the liquid present in the acting portions.

The energy generating means for generating such energy can be selected from recording methods using electromechanical transducers such as piezoelectric devices or the like, recording methods using the energy generating means for radiating an electromagnetic wave such as a laser or the like to generate heat and ejecting liquid droplets by action of the heat, or recording methods using the energy generating means for heating the liquid by electro-thermal transducers such as heat-generating elements having heat-generating resistors and ejecting the liquid thereby.

Among them the recording heads used in the ink jet recording methods for ejecting the liquid by thermal energy can perform high-resolution recording, because the liquid discharge ports for ejecting the recording liquid to form the liquid droplets for discharge can be arrayed in high density. Among others, the recording heads using the electro-thermal transducers as energy generating sources are advantageous, because they can be compactified readily, they can be produced by fully making use of the recent technological progress in the semiconductor fields and the advantages of the IC technology and microprocessing technology considerably improved in reliability, high-density packaging thereof is easy, and the production cost thereof is inexpensive.

After one-line recording is completed by movement of the recording head cartridge 1, the recording sheet is fed by one line in the direction of the arrow illustrated as a conveyance direction on the recording sheet 22 in FIG. 3 by the sheet feed motor 23, and then recording of the next line is carried out.

[Recovery Section]

The present device has a recovery mechanism described below in order to remove the ink or foreign matter staying in the nozzles of the recording head cartridge 1. In addition, the device is arranged to carry out an operation called a predischarge operation for removing a small amount of foreign matter or ink remaining in the nozzles even after execution of this recovery operation or the like. The predischarge operation is an operation for carrying out the driving of the recording head for printing at a predetermined position except for the area on the recording sheet. The waste ink discharged by these operations is received by the waste ink absorber 327 (see FIG. 17) incorporated in the inner wall of the platen 14.

Figure 19:
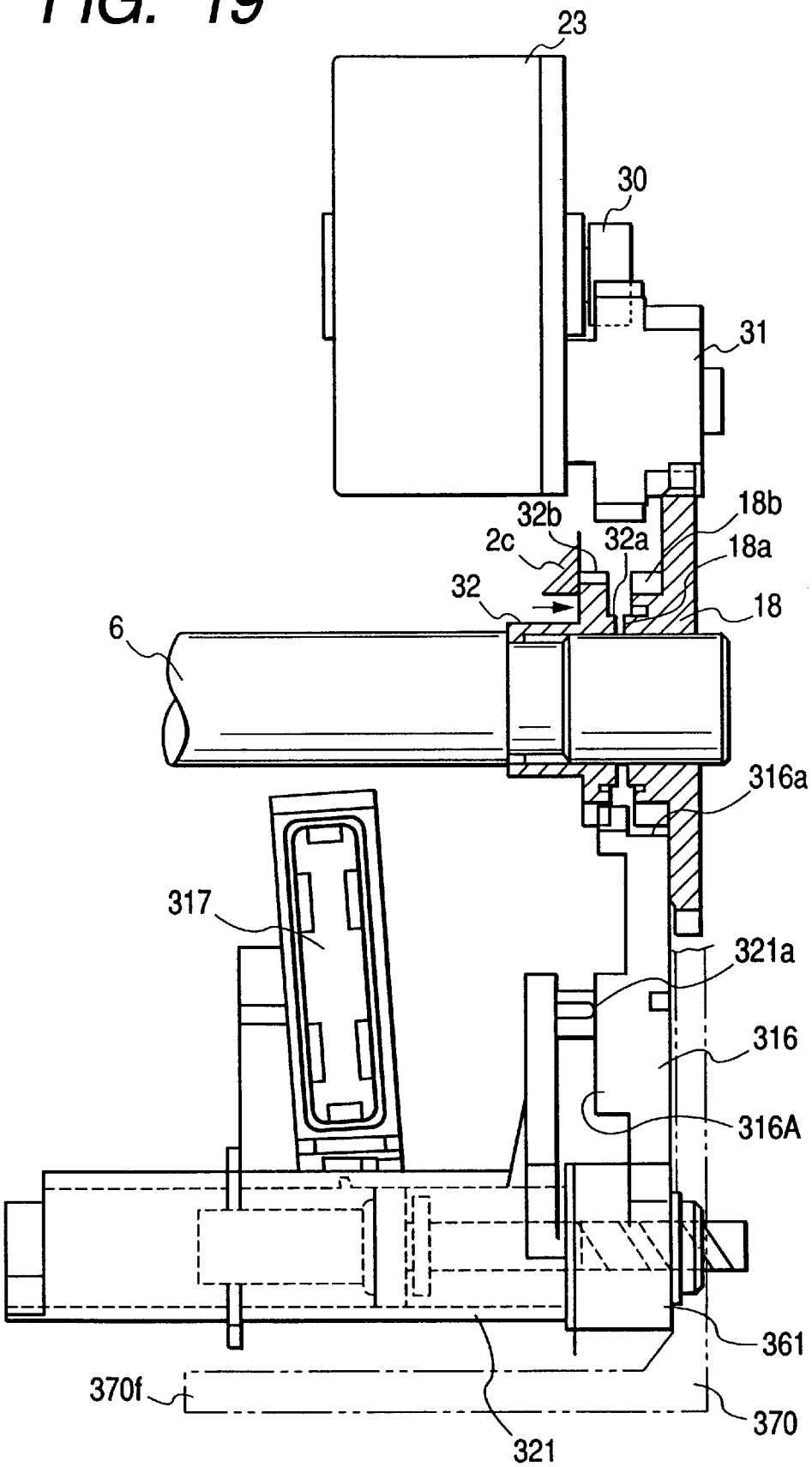
FIG. 19 is a diagram to show a piston drive transmission path of a recovery system from a sheet feed motor of the recording device as an embodiment of the present invention.

FIG. 19 is a diagram to show a piston drive transmission path of the recovery system from the sheet feet motor of the recording device as an embodiment of the present invention.

Rotation of the sheet feed motor 23 is transmitted via an LF motor gear 30 and an LF double gear 31 to the LF gear 18 to rotate the sheet feed roller 6. When the carrier 2 (see FIG. 16) reaches a non-recording area to make a clutch switching projection 2*c* formed in the carrier 2 push a trigger gear 32 (which is mounted so as to be coaxially slidable and rotatable on the sheet feed roller), the trigger gear 32 is moved toward the LF gear 18, whereby the driving of the LF gear 18 comes to be transmitted to the trigger gear 32 through the meshing shapes detailed hereinafter. Since the trigger gear 32 and pump gear 316 are in mesh with each other in this state, the driving is transmitted to the pump gear 316. The trigger gear 32 is normally apart from the LF gear 18 and the pump gear 316 has a tooth-lacking portion at the meshing position with the LF gear 18. Therefore, the driving is not transmitted from the LF gear 18 to the pump gear 316 in the normal state.

At the same time as engagement of the LF gear 18 with the pump gear 316, the carrier 2 moves to a capping position and a cap 317 closes the ink discharge ports of the recording head cartridge 1. The pump gear 316 moves a piston in a cylinder 321 through a cylinder gear 361 and in conjunction therewith, the ink is sucked through the cap 317 from the ink discharge ports of the recording head cartridge 1 into the cylinder 321, thereby recovering the ink discharge function of the recording head cartridge 1.

As described above, the transmission of the driving force from the sheet feed motor 23 to the pump gear 316 is controlled by the motion of the pump gear 316, the LF gear 18, the trigger gear 32, and the carrier 2.

Figure 20:
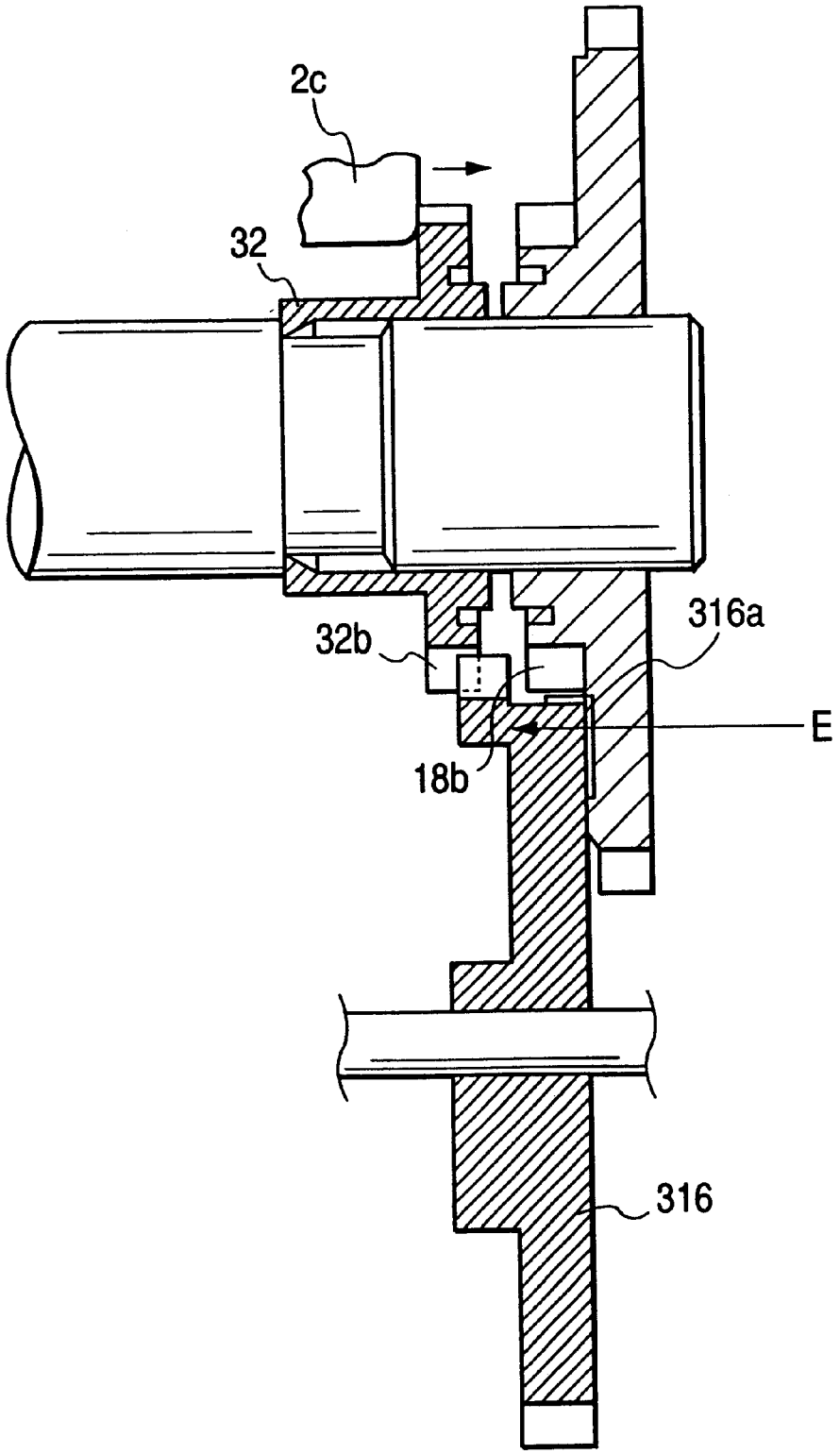
FIG. 20 is an enlarged view of the area around a switching mechanism portion of the recording device as an embodiment of the present invention.

FIG. 20 is an enlarged view of the part around the switching mechanism portion of the recording device as an embodiment of the present invention.

In FIG. 20, the trigger gear 32 is set so as to be coaxial with and slidable on the sheet feed roller. The trigger gear 32 and the pump gear 316 are in mesh with each other. Since the trigger gear 32 and the LF gear 18 are apart from each other in this state, the driving is not transmitted from the LF gear 18 to the trigger gear 32. Since the pump gear 316 is chipped in the meshing part with the LF gear 18 (or has no teeth there), it does not receive the driving force from the LF gear 18. As the carrier not illustrated is moved more toward the LF gear 18, the trigger gear 32 is further moved to the side of the LF gear 18, whereby the trigger gear 32 goes into contact with the LF gear 18.

Figure 21A:
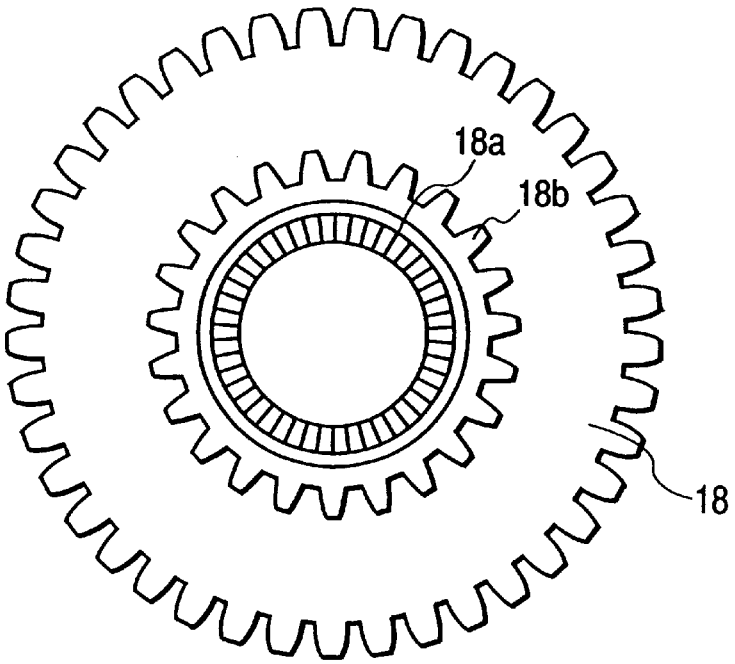
FIG. 21A, FIG. 21B, FIG. 21C, and FIG. 21D are diagrams to show meshing shapes of an LF gear and a trigger gear illustrated in FIG. 20.
Figure 21B:
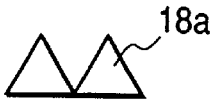
Figure 21C:
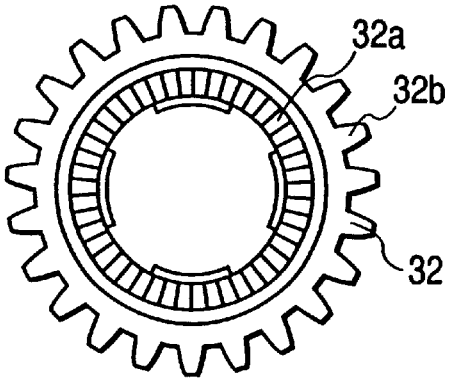
Figure 21D:
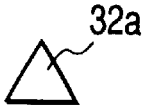

Contact surfaces of the respective gears (opposed surfaces to each other) are provided with respective tooth portions of a triangular shape to be engaged with each other. FIGS. 21A to 21D are diagrams to show the meshing shapes of the LF gear 18 and the trigger gear 32, wherein FIG. 21A is a drawing to show the shape of the contact surface of the LF gear 18 to be engaged with the trigger gear 32, FIG. 21B is a sectional view of the contact surface 18*a* of the LF gear 18 of FIG. 21A, FIG. 21C is a drawing to show the shape of the contact surface of the trigger gear 32 to be engaged with the LF gear 18, and FIG. 21D is a sectional view of the contact surface 32*a* of the trigger gear 32.

As illustrated in FIG. 21A and FIG. 21B, the shape of the contact surface 18*a* of the LF gear 18 is teeth of a triangular shape (hereinafter referred to as triangular teeth). The pitch thereof is equal to that of gear teeth 18*b* of the LF gear 18 and the roots of the triangular teeth are set to be aligned with threads of the gear teeth 18*b*. As illustrated in FIG. 21C and FIG. 21D, the shape of the contact surface 32*a* of the trigger gear 32 is triangular teeth which are the same as the shape of the contact surface 18*a* of the LF gear 18. The pitch of the triangular teeth is equal to that of gear teeth 32*b* of the trigger gear 32 and the threads of the triangular teeth are set to be aligned with the threads of the gear teeth 32*b*.

In the above structure, when the LF gear 18 and the trigger gear 32 go into contact with each other, the root portions of the triangular teeth of the contact surface 18*a* of the LF gear 18 go into mesh with the thread portions of the triangular teeth of the contact surface 32*a* of the trigger gear 32, so that the gear teeth 18*b*, 32*b* of the LF gear 18 and the trigger gear 32 become in phase. This permits the trigger gear 32 to rotate with rotation of the LF gear 18. Since the engagement between the pump gear 316 and the trigger gear 32 is not released even after the trigger gear 32 has been moved to the side of the LF gear 18, the pump gear 316 rotates with rotation of the trigger gear 32.

The indirect driving of the pump gear 316 through the trigger gear 32 by the LF gear 18, however, has the limit of driving force thereof.

Thus, a wide cut portion 316*a* extending in the radial direction is formed in the peripheral part of the pump gear 316, as illustrated in FIG. 20. More specifically, the pump gear 316 has a portion thicker than the trigger gear 32 and LF gear 18, and the periphery of the pump gear 316 has the cut portion 316*a* in which some of the teeth threaded are cut off from near the center in the axial direction to one end (in the direction of arrow E in FIG. 20).

Figure 22A:
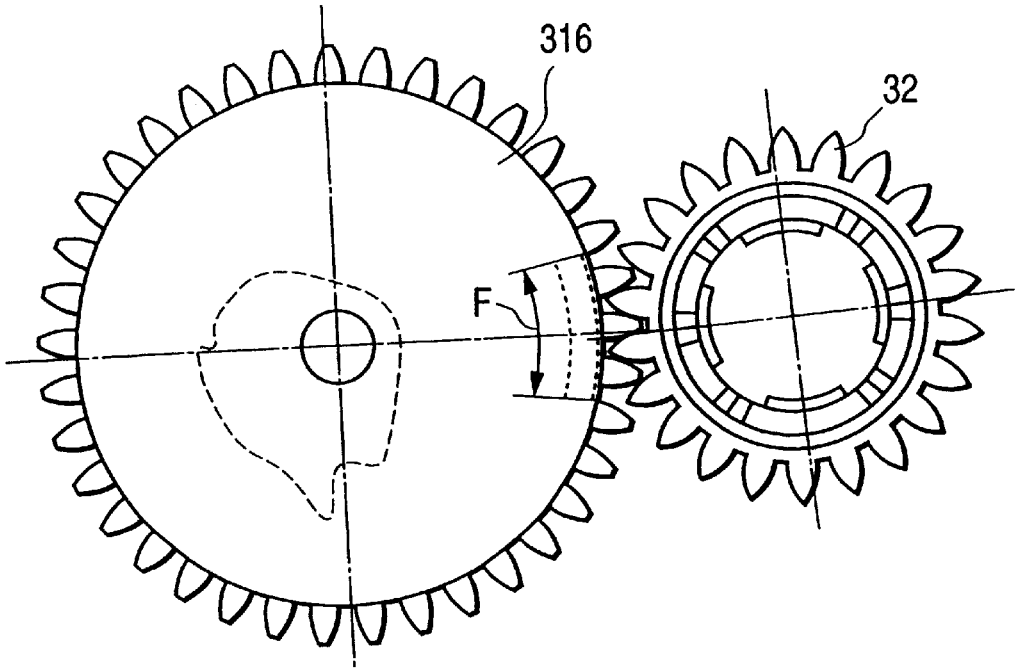
FIG. 22A and FIG. 22B are diagrams to show the structure and arrangement of a pump gear and a trigger gear illustrated in FIG. 20.
Figure 22B:
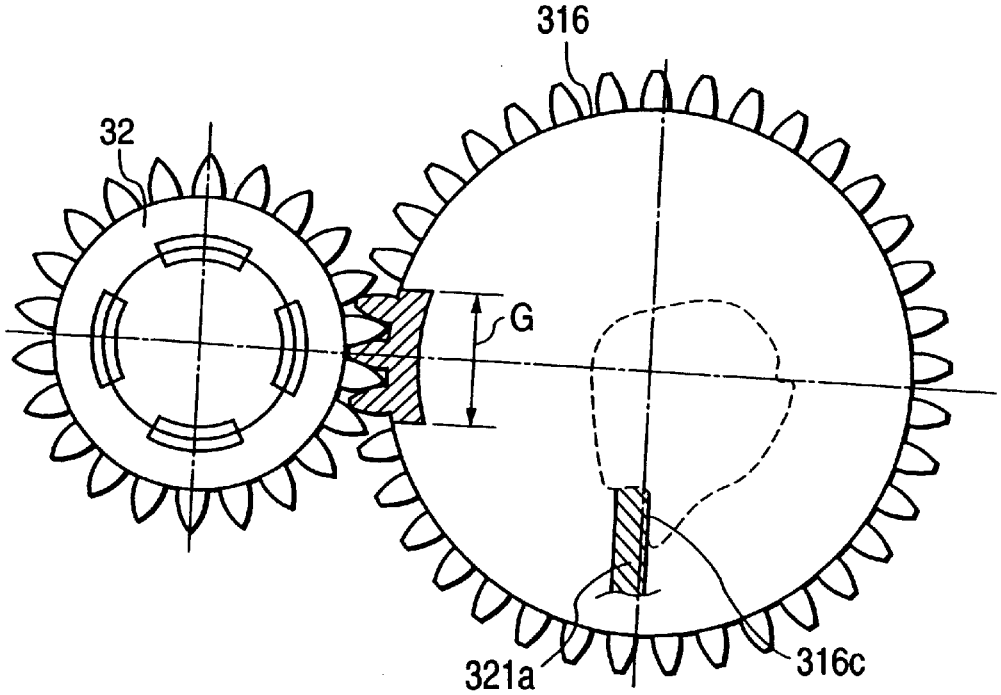

FIGS. 22A and 22B are diagrams to show the structure and arrangement of the pump gear 316 and the trigger gear 32, wherein FIG. 22A is a view from the right side of FIG. 20 and FIG. 22B is a view from the left side of FIG. 20. The LF gear 18 is omitted from these illustrations.

As illustrated in FIG. 22A, the width of the cur portion (the arrow F in FIG. 22A) is such a width that at least this cut portion is prevented from contacting the tooth portion of the LF gear 18 even if the pump gear 316 and the LF gear 18 are set at positions where they are to be engaged with each other.

However, if the trigger gear 32 is rotated a little to rotate the pump gear 316 and move the cut portion 316*a,* the pump gear 316 and the LF gear 18 will go into direct mesh with each other, thereby obtaining large driving force.

Even if in this state the carrier not illustrated is moved away from the LF gear 18 to release the engagement between the trigger gear 32 and the LF gear 18 by the mechanism detailed hereinafter, the driving force will still be transmitted thereafter, because the pump gear 316 and the LF gear 18 are in direct mesh with each other.

Since the trigger gear 32 is moved in the meshing state with the pump gear 316 to be freed from the engagement with the LF gear 18, the movement of the trigger gear 32 will not pose any issue such as collision of the tooth surfaces on that occasion.

The meshing state between the pump gear 316 and the trigger gear 32 becomes unnecessary when the pump gear 316 goes into mesh with the LF gear 18. Therefore, the necessary meshing area of the pump gear 316 with the trigger gear 32 can be set to be a meshing portion at least not less than the cut area as illustrated at least in FIG. 22B (the hatched portion along the arrow G in FIG. 22B).

This structure can decrease the tooth width in the other part than the meshing part of the pump gear 316 with the trigger gear 32 and thus permits another mechanical component or the like to be placed in that area.

Next, let us explain the engagement release mechanism for releasing the engagement between the trigger gear 32 and the LF gear 18 after the pump gear 316 and the LF gear 18 become in mesh with each other.

As described above, in the engaging state between the trigger gear 32 and the LF gear 18, the triangular teeth formed in the contact surfaces of the two gears are in mesh with each other. Even if the carrier not illustrated is moved from this state away from the trigger gear 32 and if the LF gear 18 is rotated further, the driving force will be transmitted directly between the pump gear 316 and the LF gear 18 and the driving force will not be transmitted to the trigger gear 32; therefore, the trigger gear 32 will tend to keep the engaging state with the LF gear 18 (though the engaging state could be released by vibration or the like in practice).

In order to release the transmission of the driving force from the LF gear 18 to the pump gear 316 from this state, the LF gear 18 is rotated in the reverse direction to the rotation heretofore. Then the cut portion (tooth-lacking portion) 316*a* of the pump gear 316 appears again, whereupon the trigger gear 32 again goes into mesh with the meshing gear part (the part G in FIG. 22B) of the pump gear 316 with the trigger gear 32. When the LF gear 18 is then rotated further, the direct transmission of driving is eliminated between the pump gear 316 and the LF gear 18, thereby terminating the rotation of the pump gear 316. However, since the trigger gear 32 is still in mesh with the LF gear 18 and is further rotated, the transmission of driving to the pump gear 316 is effected through the trigger gear 32. At this time, as illustrated in FIG. 22B, the pump gear 316, staying in the state at the tooth-lacking position, does not rotate, because an arm 321*a* (see FIG. 19) of the cylinder 321 is located against a recess wall surface 316*c* of the pump gear 316 to block rotation. This makes thrust force act to the trigger gear 32 along the teeth surfaces of the gear teeth of the pump gear 316, whereupon the trigger gear 32 moves away from the LF gear 18.

Next, let us explain the recovery means comprised of the cap, the cylinder, etc. in detail with reference to FIG. 23 to FIG. 27.

FIG. 23 to FIG. 28 are diagrams to explain the operation of the recovery system in the recording device as an embodiment of the present invention.

The cap 317 is made of chlorinated butyl rubber or another appropriate material with elasticity and is held integrally by a cap holder 341. Then the cap holder 341 is held so as to be rotatable on an arm portion 321A extending integrally from the cylinder 321.

The cylinder 321 has the piston 342 made of an elastic material such as rubber inside thereof. When a piston shaft 343 is actuated, negative pressure can be created inside the cylinder 321. The motion of the piston shaft 343 and the piston 342 will be detailed hereinafter.

The cap 317 is provided with a joint portion 317A formed integrally with the cap 317, and the cylinder 321 and the cap 317 are coupled with each other in a sealed state when this joint part 317A is pressed with an interference into joint part 321B provided in the cylinder 321.

An ink suction port 321C for establishing communication between the inside of the cylinder and the cap 317 is provided inside the joint part 321B provided in the cylinder 321.

Now, let us explain how to achieve and release the press contact of the cap 317 against the recording head cartridge 1 with reference to FIG. 23, FIGS. 24A and 24B, and FIG. 25.

The cap 317 held integrally by the cap holder 341 is coupled to the cylinder 321 in a hermetically closed state, as described above, and the cap holder 341 is held so as to be rotatable relative to the cylinder 321 on a cylinder arm 321A.

Figure 24B:
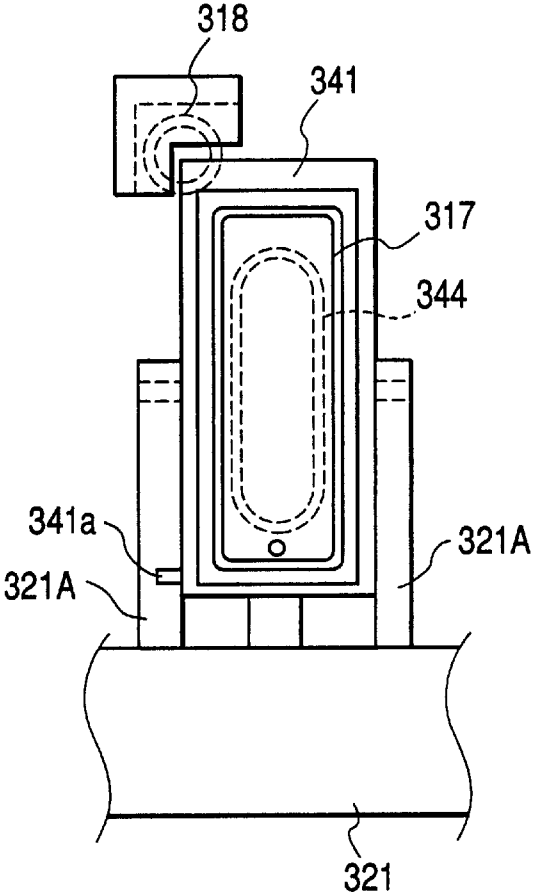
FIG. 24A and FIG. 24B are diagrams to explain the operation of the recovery system in the recording device as an embodiment of the present invention.
Figure 24A:
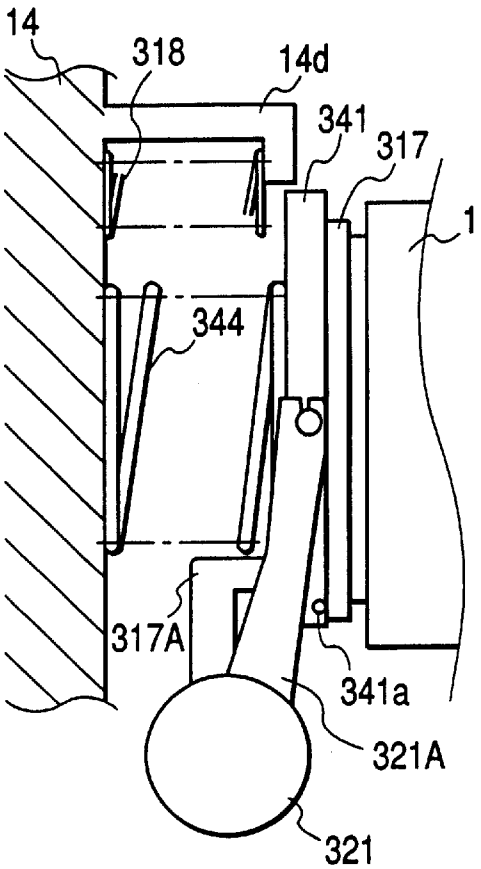

Although the cap 317 and the cylinder 321 are coupled through the joint parts 317A and 321B, the joint part 317A does not block the rotation of the cap holder 341 at all, because the joint part 317A is made of the elastic material, for example chlorinated butyl rubber, so as to be integral with the cap 317 and because it is free to deform in an L-shape (see FIGS. 24A and 24B).

As illustrated in FIGS. 24A and 24B, below the cap holder 341 an irregular-shape compression cap spring 344 is placed between the platen 14 and the cap holder 341, so that it always urges the cap holder 341 toward the recording head cartridge. Here, the cylinder 321 is supported so as to be rotatable on the cylinder shaft, by the platen 14.

Accordingly, the cylinder 321 and the cap 317 are given the rotational force about the cylinder shaft by the irregular-shape compression cap spring 344.

Figure 23:
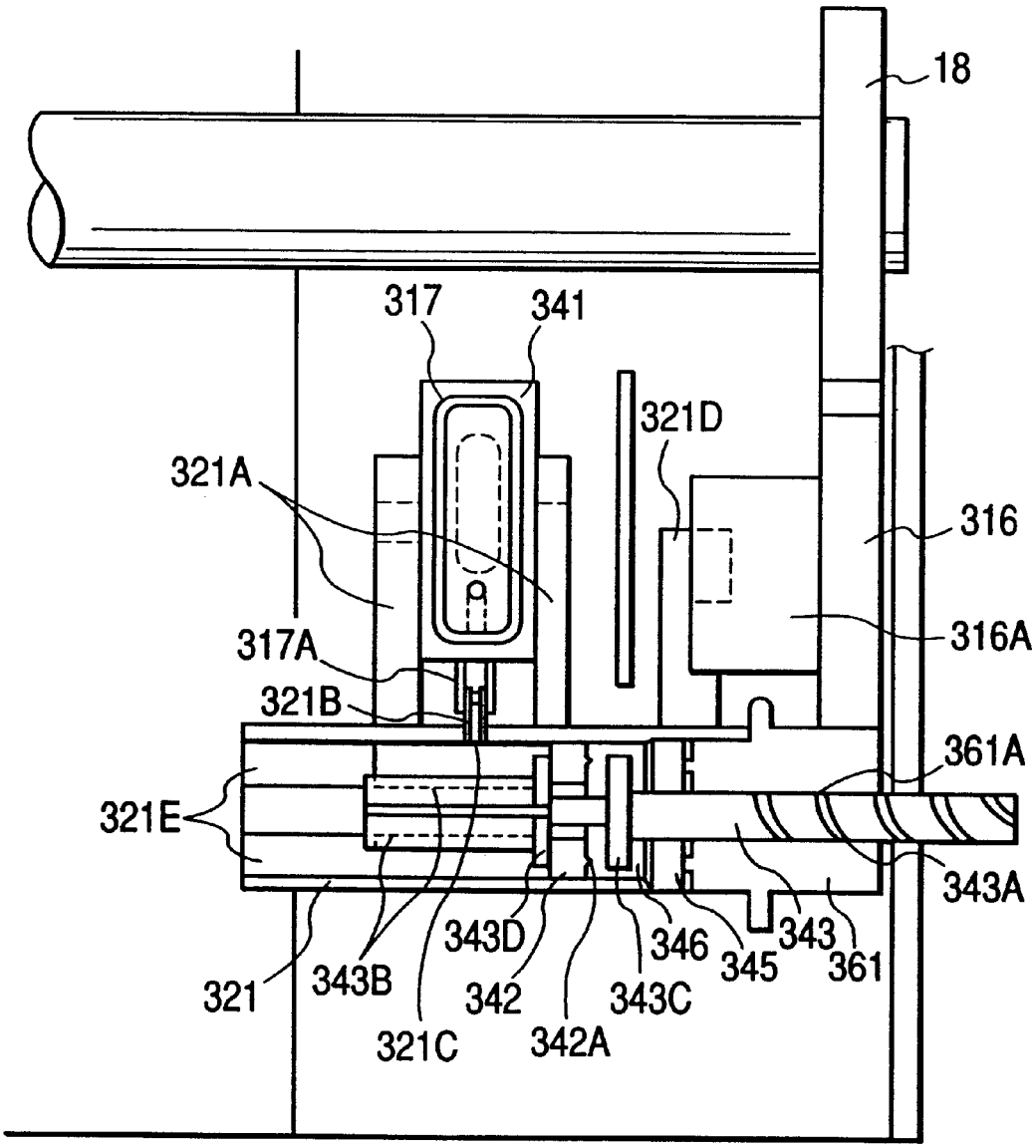
FIG. 23 is a diagram to explain the operation of the recovery system in the recording device as an embodiment of the present invention.

The cylinder 321 has a cylinder control portion 321D formed integrally therewith, as illustrated in FIG. 23, and the tip end of the cylinder control portion 321D abuts against a cap control cam portion 316A which is a first cam member of the pump gear 316. Therefore, the rotation of the cylinder 321 is controlled by the cap control cam portion 316A of the pump gear 316 through the cylinder control portion 321D. Namely, vertical motion of the cylinder control portion 321D along the cap control cam portion 316A of the pump gear 316 can implement capping and uncapping of the cap 317 with respect to the recording head cartridge 1 through the cylinder 321.

Figure 25:
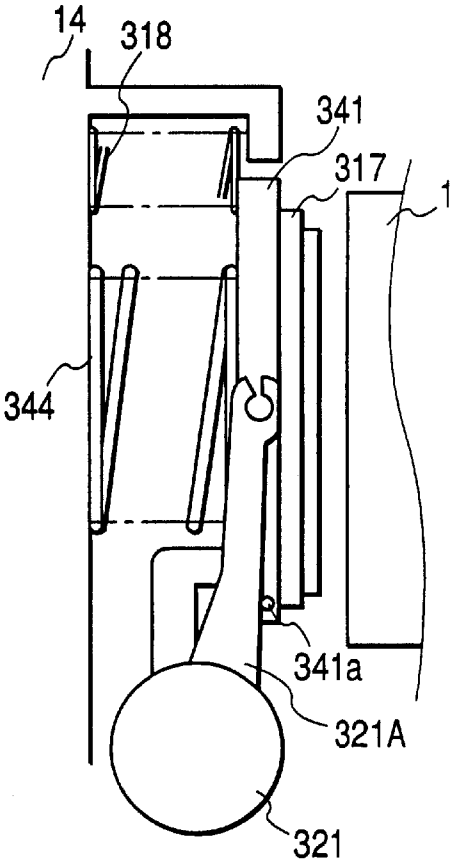
FIG. 25 is a diagram to explain the operation of the recovery system in the recording device as an embodiment of the present invention.

FIGS. 24A and 24B show a state in which the cap 317 is pressed against the recording head cartridge 1 and FIG. 25 does a released state of the cap from the press state. In FIGS. 24A and 24B another cap control spring 318 is further provided between the platen 14 and the cap holder 341, and the total length of the cap control spring 318 is limited by a spring regulating portion 14*d* of the platen 14 so as to be apart from the bottom surface of the cap holder 341. The cap control spring 318 does not affect the press state of the cap 317 at all accordingly.

FIG. 25 shows a state in which the cylinder 321 is rotated through rotation of the pump gear 316 so as to make the cap 317 apart from the head cartridge. In this state the cap control spring 318 is in contact with the bottom surface of the cap holder 341 to give the cap holder 341 clockwise rotation force. In conjunction therewith the cap holder 341 is rotated clockwise, but the rotation is stopped when a stopper 341*a* provided in a projecting state on the cap holder 341 comes to contact the cylinder arm 321A.

If the position of the stopper 341*a* is so set that the cap 317 and the recording head cartridge 1 become parallel to each other at this time, the relation between the cap 317 and the recording head cartridge 1 can be always maintained in parallel on the occasion of uncapping.

The effects of the above arrangement are as follows; since the posture during uncapping becomes stable, the cap 317 can be kept out of contact with the recording head cartridge 1 because of inclination of the cap 317 and the cap holder 341 even if a moving amount for the uncapping of the cap 317 is set small; therefore, the scale of the device can be decreased.

The pump gear 316 is arranged to be capable of being connected to the LF gear 18 on a selective basis, the driving force of the sheet feed motor (not illustrated) is transmitted through the gear train not illustrated to the LF gear 18, and thereafter with the clutch operation through the motion of the carrier 2 the driving force transmitted to the LF gear 18 is transmitted to the pump gear 316. If the clutch operation were not carried out by the carrier 2 the transmission of the LF gear 18 would be interrupted, so as to fail to transmit the driving force to the pump gear 316, because the pump gear 316 is provided with the tooth-lacking portion in part.

The motion of the piston shaft 343 and the piston 342 will be described below.

In FIG. 23, the pump gear 316 is coupled with the cylinder gear 361. Namely, when the carrier 2 performs the clutch operation described above, the driving force of the LF gear 18 is transmitted to the pump gear 316 and further to the cylinder gear 361. Further, a boss 361A provided on the inner wall of the cylinder gear 361 is fitted in a lead groove 343A formed in the piston shaft 343 and guides 321E formed in the cylinder 321 are fitted in grooves 343B formed at the fore end of the piston shaft 343 to stop rotation of the piston shaft 343, whereby rotational motion of the pump gear 316 can be converted to linear motion of the piston shaft 343.

The piston shaft 343 is provided with two flange portions 343C, 343D formed integral with the shaft.

The piston 342 of the so-called doughnut shape made of an elastic material such as silicone rubber, NBR rubber, or the like and having a through hole in the center is set between these flange portions 343C, 343D. Of course, the cylinder 321 and piston 342 are of a cylindrical shape, the outside diameter of the piston 342 is greater than the inside diameter of the cylinder 321, and there is a certain interference (approximately in the range of about 0.2 mm to 0.5 mm). Accordingly, the inside wall of the cylinder and the outside wall of the piston can be maintained in a sealed state even during movement of the piston 342.

A cylinder seal 345 is also of the doughnut shape, the outside diameter of the cylinder seal 345 also has the seal property against the inside diameter of the cylinder, and the inside diameter of the cylinder seal 345 keeps the seal property against the piston shaft 343. A cylinder washer 346 is stopped at a stop portion provided in the cylinder 321. A rib 342A is provided in the side surface of the piston 342 throughout the entire periphery and opposite to the flange 343C, and the inside diameter of the piston 342 is larger than the outside diameter of the piston shaft 343, so as to create a backlash.

The width of the piston 342 is smaller than the distance between the two flange portions provided in the piston shaft 343. These backlashes are provided for discharge of sucked ink and will be detailed hereinafter.

The initial state of the pump is such that the piston shaft 343 is at the raised position as illustrated in FIG. 23, i.e., that the piston 342 is also pushed by the flange 343D to be located at the position illustrated in FIG. 23.

When the MPU then supplies a suction signal, the carrier 2 performs the latch operation to transmit the driving from the LF gear 18 to the pump gear 316 and to the cylinder gear 361, and the rotation of the cylinder gear 361 is converted to the linear motion of the piston shaft 343.

Figure 26:
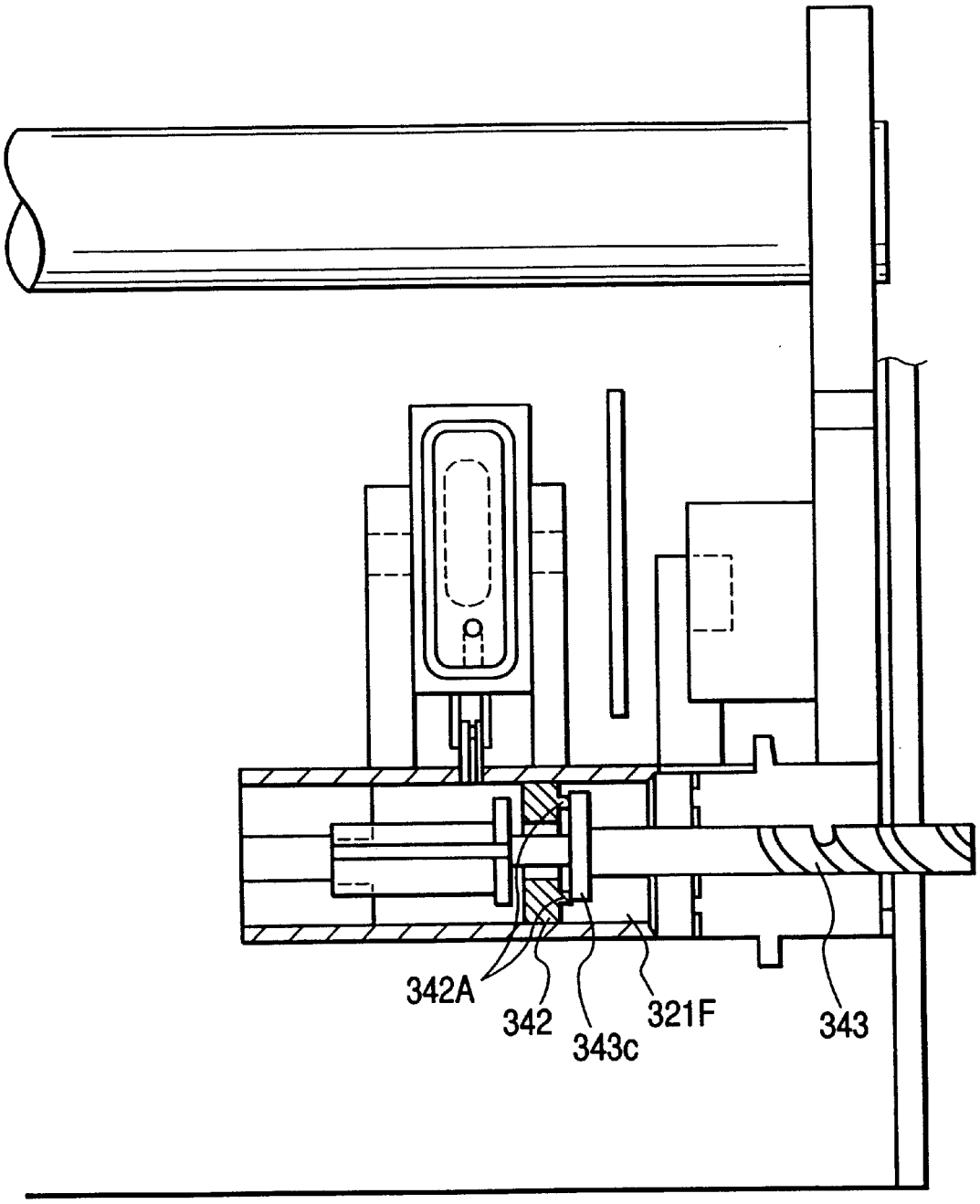
FIG. 26 is a diagram to explain the operation of the recovery system in the recording device as an embodiment of the present invention.
Figure 27:
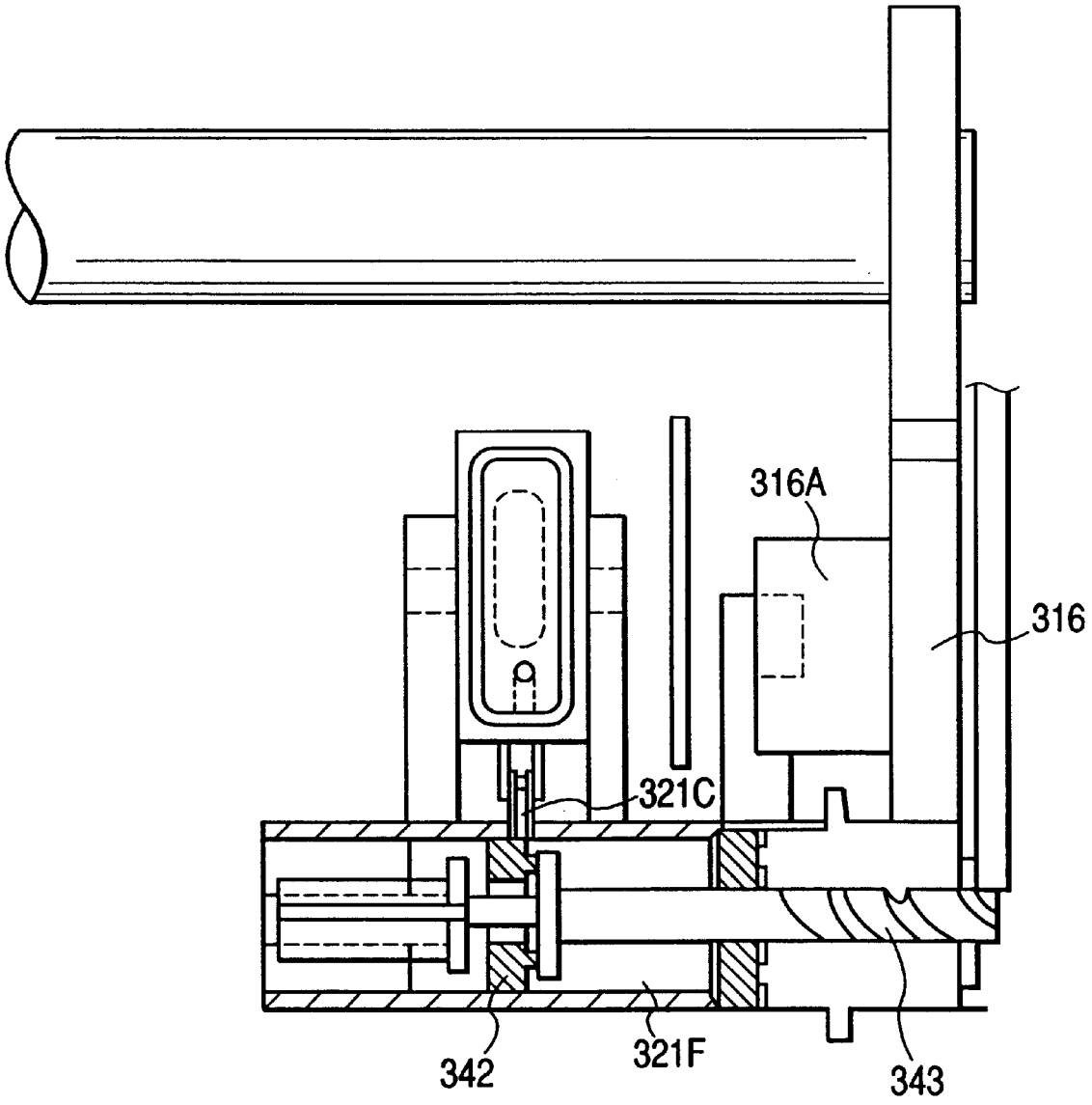
FIG. 27 is a diagram to explain the operation of the recovery system in the recording device as an embodiment of the present invention.

When the piston shaft 343 is moved to the left in FIG. 23, the flange portion 343C comes to be pressed against the rib 342A on the side surface of the piston 342 as illustrated in FIG. 26 and the piston 342 turns the space 321F on the right side in FIG. 26 into a hermetically closed state.

When the piston shaft 343 is further moved to the left in FIG. 26, the space 321F increases the volume while being kept in the hermetically closed state, so that the space 321F gradually goes into a pressure below the atmospheric pressure (a state of negative pressure). This negative pressure gradually becomes greater with movement of the piston shaft 343 (piston 342) and becomes maximum when the end of the side surface of the piston 342 passes the ink suction port 321C (see FIG. 27).

The reason is that when the space 321F becomes in communication with the ink suction port 321C, the ink or air flows from the outside into the space 321F through the ink suction port 321C and the cap 317, so as to cancel the negative pressure of the space 321F. Here, suction of the ink becomes possible by forming the cap control cam portion 316A provided in the pump gear 316 so that the cap 317 can come to hermetically close the recording head cartridge when the piston 342 passes the ink suction port 321C.

Figure 28:
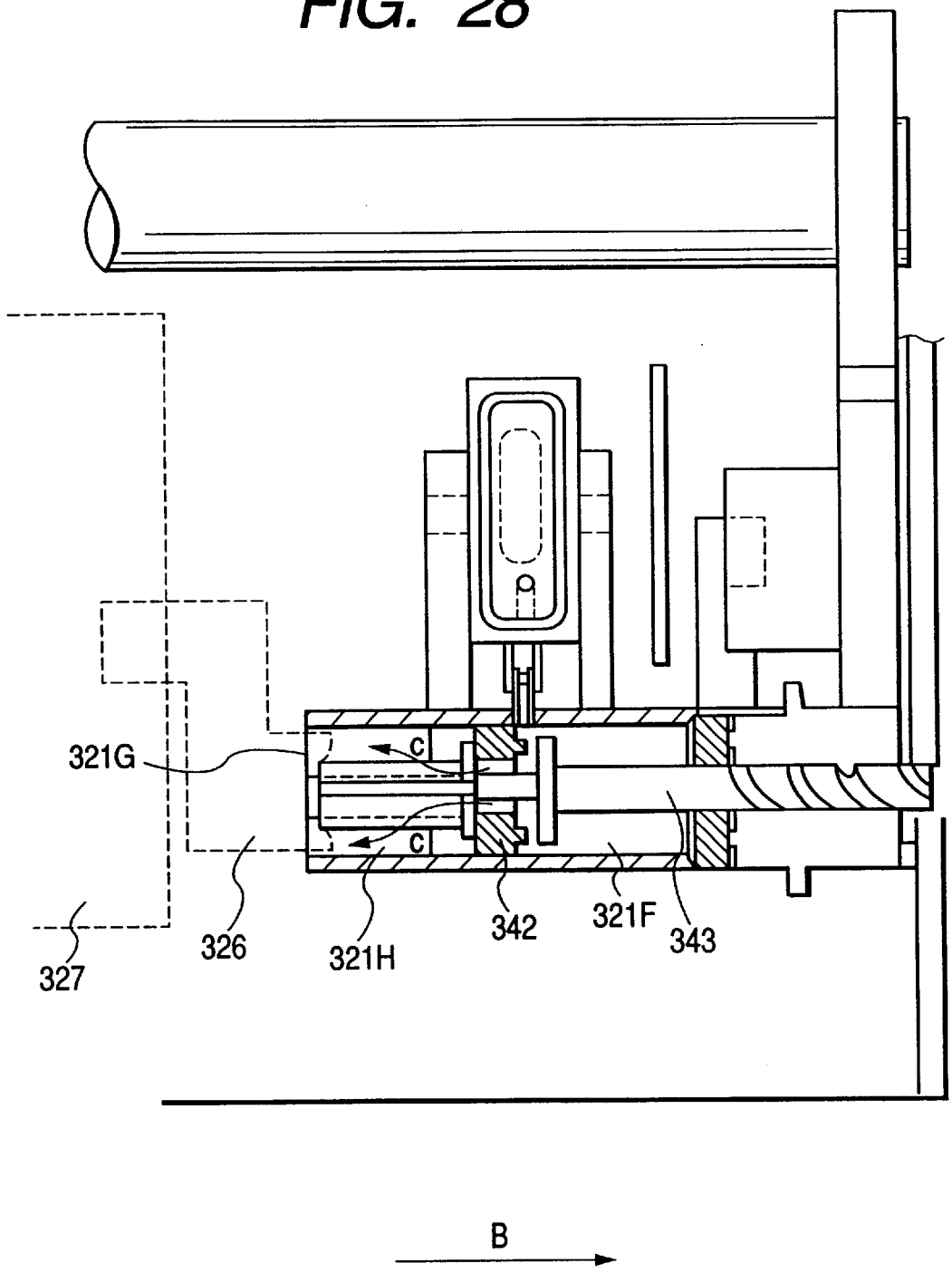
FIG. 28 is a diagram to explain the operation of the recovery system in the recording device as an embodiment of the present invention.

Next, let us describe the discharge of the ink in the cylinder 321 referring to FIG. 28. As described previously, the ink sucked from the recording head cartridge 1 stays in the space 321F inside the cylinder 321. Then the motor is rotated backward to lift the piston shaft 343 up (in the direction of the arrow B in FIG. 28). Since the width of the piston 342 is smaller than the distance between the flanges 343C, 343D of the piston shaft 343 and since the inside diameter of the piston 342 is larger than the outside diameter of the piston shaft 343, the ink staying in the space 321F flows through the gap between the piston 342 and the piston shaft 343 with the lifting-up motion of the piston shaft 343 (the piston 342) to move into the space 321H on the left side of the piston 342 in FIG. 28 (the flow of arrows C in FIG. 28). As the reciprocating operation of the piston shaft 343 (the piston 342) is carried out repeatedly, the ink is gradually discharged through the end 321G of the cylinder 321 accordingly.

A cylinder absorber 326 is inserted into the cylinder end 321G. The cylinder absorber 326 is made of cellular sponge selected from materials with a good transfer property of ink. Namely, the cylinder absorber 326 is demanded to have such performance as to discharge the ink present in the cylinder 321 to the outside efficiently and is thus made of a melamine-resin-based foam material in the present embodiment.

The cylinder absorber 326 is in contact with the waste ink absorber 327 stored in the platen 14. The waste ink absorber 327 is selected from materials with high ink retaining performance, for example, such as laminate sheets of paper or polymer absorbers.

Because of this structure, the waste ink sucked from the recording head cartridge 1 flows through the cylinder 321 and the cylinder absorber 326 to the waste ink absorber 327 to be retained there.

It is confirmed experimentally that in the present embodiment the volume of the waste ink absorber 327 itself is 120 cubic centimeters and an amount of the ink retained there is approximately 70% thereof, i.e., 84 cubic centimeters.

Now, let us explain the operation for fixing the carriage while the pump gear controls the lock arm as an arm member, referring to FIGS. 16, 19 and FIG. 29 to FIG. 32.

Figure 29:
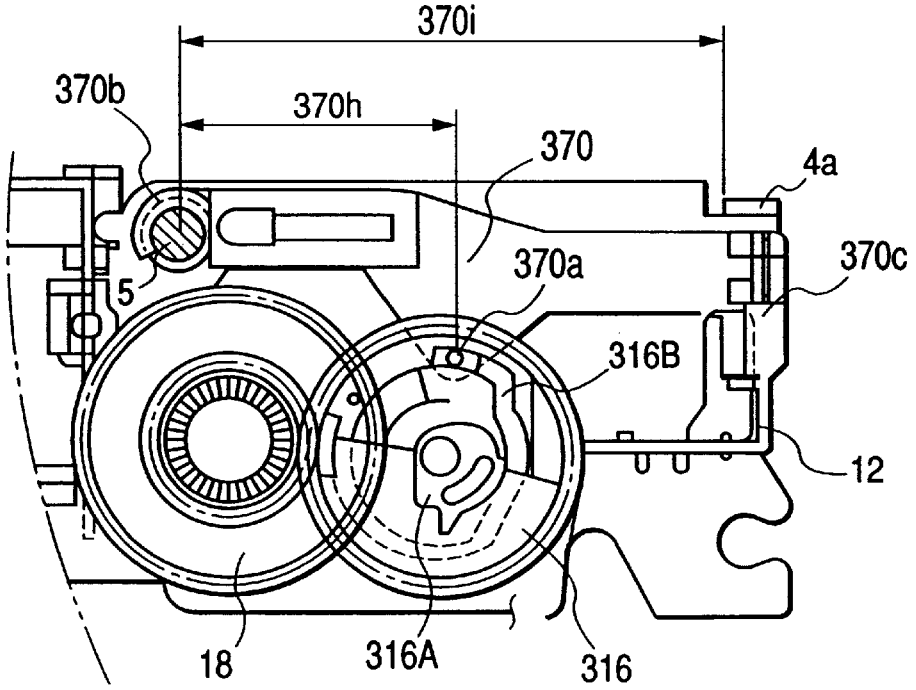
FIG. 29 is a view, seen from the left side of FIG. 19, of an unlocking state of a lock arm in the recording device as an embodiment of the present invention.
Figure 30:
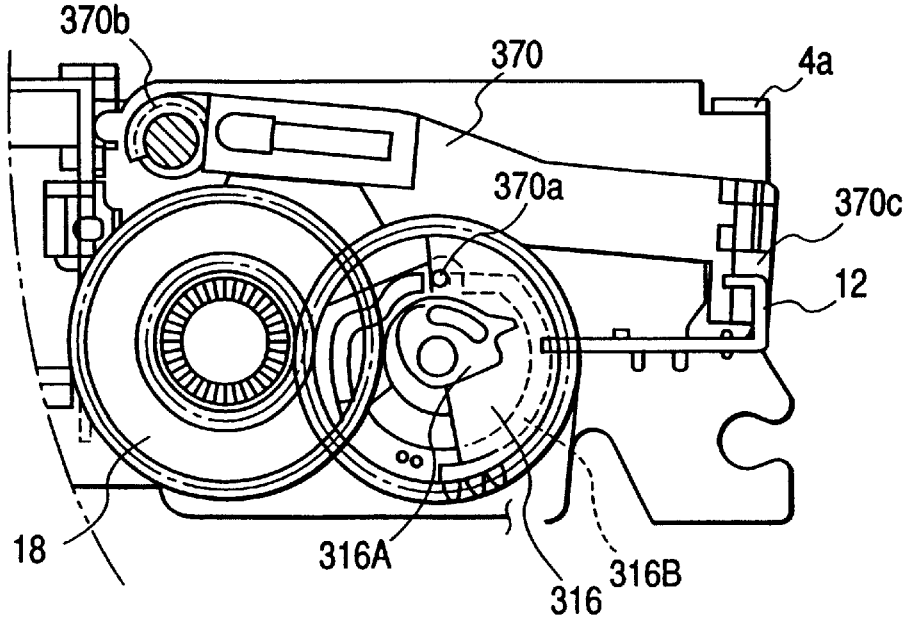
FIG. 30 is a view, seen from the left side of FIG. 19, of a locking state of the lock arm in the recording device as an embodiment of the present invention.
Figure 31:
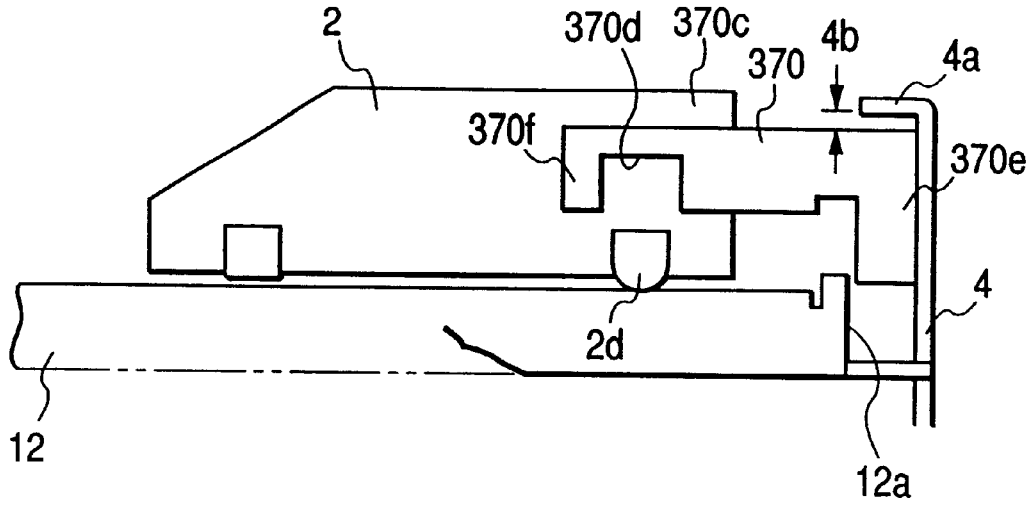
FIG. 31 is a view, seen from the bottom side of FIG. 19, of a carriage-released state by the lock arm in the recording device as an embodiment of the present invention.
Figure 32:
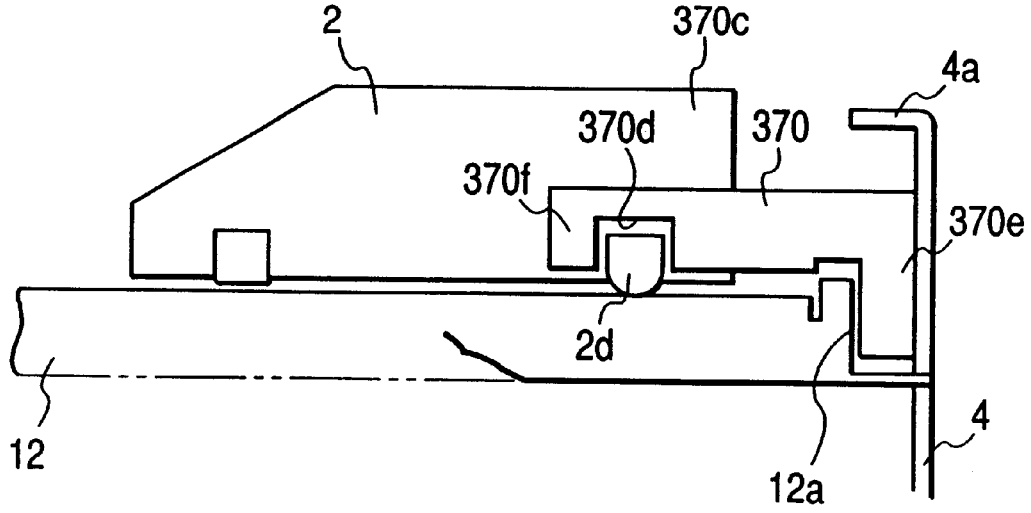
FIG. 32 is a view, seen from the bottom side of FIG. 19, of a carriage-fixed state by the lock arm in the recording device as an embodiment of the present invention.

FIG. 29 is a left side view of FIG. 19 to show a lock-arm-released state in the recording device as an embodiment of the present invention, FIG. 30 is a left side view of FIG. 19 to show a lock-arm-fixed state in the recording device as an embodiment of the present invention, FIG. 31 is a bottom side view of FIG. 19 to show a carriage-released state by the lock arm in the recording device as an embodiment of the present invention, and FIG. 32 is a bottom side view of FIG. 19 to show a carriage-fixed state by the lock arm in the recording device as an embodiment of the present invention.

As described previously in the description of the operation of the recovery system, the cap control cam portion 316A for controlling the opening/closing of the cap 317 through the arm portion 321*a* of the cylinder 321 is provided in the surface of the pump gear 316 on the left side of FIG. 19, while a lock control cam portion 316B, which is a second cam member to engage the boss portion 370*a* of the lock arm 370 and to control the fixing and releasing of the carrier 2 by the lock arm 370, is formed in a groove shape in the surface of the pump gear 316 on the right side of FIG. 19.

In FIG. 29 and FIG. 30 the boss portion 370*a* of the lock arm 370 and the lock control cam portion 316B of the pump gear 316 are in an engaged state.

As illustrated in FIG. 16 and FIG. 19, the lock arm 370 is disposed on the right side of the device and in the range approximately equal to the width of the gear train including the LF gear 18 and the pump gear 316 etc. and it is set outside the moving range of the carrier 2 carrying the recording head cartridge 1.

The mount state of the lock arm 370 will be detailed below referring to FIG. 29 and FIG. 30.

A rotation center portion 370*b* of the lock arm 370 is formed in a bearing shape in an open state in part and is supported so as to be rotatable relative to the guide shaft 5. The assembling method thereof is as follows; the aforementioned open portion provided in the rotation center portion 370*b* is forced onto the guide shaft from above to be incorporated and supported, because the rotation center portion 370*b* has elasticity. The aforementioned boss portion 370*a* is provided near the center of the lock arm 370 and is engaged with the lock control portion 316B of the pump gear 316. Further, the lock arm 370 extends from the rotation center portion 370*b* toward the boss portion 370*a* to form a lock portion 370*c*.

The lock portion 370*c* of the lock arm 370 is a portion formed in an L-shape after the elongated part from the rotation center portion 370*b* toward the boss portion 370*a*, as shown in FIG. 16 and FIG. 19. As illustrated in FIG. 31 and FIG. 32, the lock portion 370*c* has a carriage fixing portion 370*d* shaped so as to be capable of engaging with a lock projection 2*d* provided in the carrier 2 and a regulating portion 370*e* capable of engaging in the space between an arm engaging portion 12*a* of the guide rail 12 and the frame 4.

The fixed and released states of the carrier 2 by the lock arm 370 will be explained below referring to FIG. 29 and FIG. 31.

The state of FIG. 29 of the pump gear 316, as described in the above description of the transmission of driving and the recovery system, is the initial state, i.e., the state in which the driving force of the LF gear 18 is not transmitted to the pump gear 316 and in which the cap (not illustrated) is released by the cap control cam portion 316A.

The lock arm 370 is in a state in which the boss portion 370*a* is lifted up by the lock control portion 316B of the pump gear 316 about the rotation center of the rotation center portion 370*b*, so that the lock portion 370*c* is also located up. In this state the engagement relation between the L-shaped portion of the lock portion 370*c* and the carrier 2 is shown in FIG. 31. The carriage fixing portion 370*d* is located above the lock projection 2*d* of the carrier 2 and the carrier 2 is in a movable state.

Next, let us explain the state in which the carrier 2 is fixed by the lock arm 370, referring to FIG. 30 and FIG. 32.

As described in the aforementioned description of the driving transmission and the recovery system, the state of FIG. 30 of the pump gear 316 is the capping state and the lock arm 370 is moved down with the boss portion 370*a* being lowered by the pump gear 316 and the lock control portion 316B, so that the lock portion 370*c* is also located down.

In this state the engagement relation between the L-shaped portion of the lock portion 370*c* and the carrier 2 is illustrated in FIG. 32. The carriage fixing portion 370*d* is in a state in which it is engaged with the lock projection 2*d* of the carrier 2, the carrier 2 is in an unmovable state, and the arm engaging portion 370*e* is also located at the position where it is placed between the engaging portion 12*a* of the guide rail 12 and the frame 4.

This makes it possible to stop the carrier 2 with certainty by the lock portion 370*c* of the lock arm 370 even if the carrier 2 is forced to move. In addition, stable operation can be performed without exerting excessive force on the aforementioned rotation center portion 370*b* and boss portion 370*a*.

The tip portion 370*f* of the lock arm 370 is located on the left side of the cap 317, as illustrated in FIG. 16 and FIG. 19.

For example, if the carrier 2 is forced to move to the cap position where the carrier 2 is not located at the cap position and where the cap is in the capping state for some reason, there will arise the possibility that the carrier 2 and the recording head cartridge 1 will damage the cap 317 or that the cap 317 will damage the recording head cartridge 1, because the cap is in a projecting state. Therefore, when the fore end 370*f* of the lock arm 370 is formed in the extending structure as illustrated in FIG. 16 and FIG. 19, the movement regulating portion 370*e* can prevent the lock projection 2*d* of the carrier 2 from moving to the right cap position, whereby the aforementioned damage can be avoided.

In FIG. 29 to FIG. 32, the frame 4 is provided with an arm stopper 4*a* and the arm stopper 4*a* of the frame 4 is located above the lock arm 370 with a clearance 4*b* with respect to the upper surface of the lock arm 370 in an unlocked state in FIG. 31.

Figure 35:
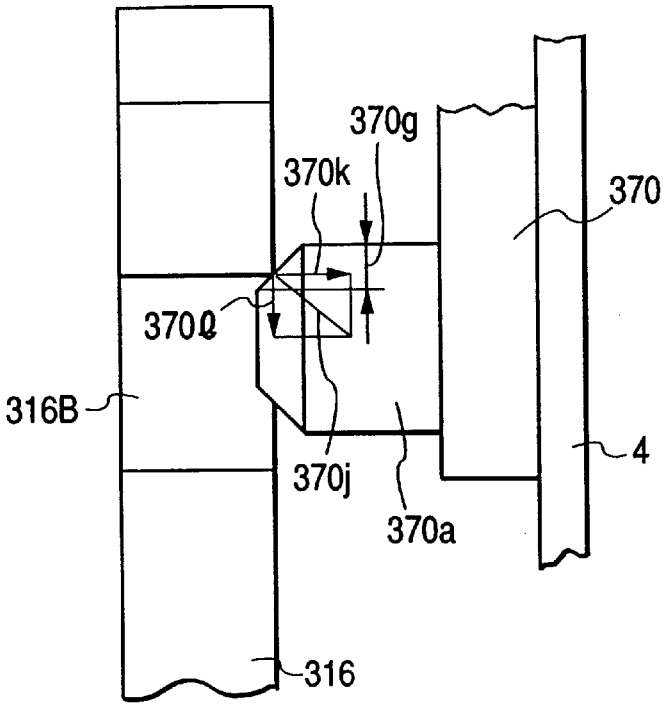
FIG. 35 is an enlarged sectional view of the state illustrated in FIG. 34.

This clearance 4*b* is set in the relation of 370*g*×(370*i*/370*h*)>4*b* where 370*g* is a distance of chamfer at the tip end of the boss portion 370*a* of the lock arm as illustrated in FIG. 35, 370*h* is a distance from the center of rotation of the lock arm 370 to the center of the boss portion 370*a* as illustrated in FIG. 29, and 370*i* is a distance from the center of rotation of the lock arm 370 to the arm stopper 4*a* similarly.

Now, let us consider a case where drop impact or the like is imposed on the recording device.

Since such an event normally occurs in a non-operating state of the recording device, the lock arm 370 is in the state to fix the carrier 2, i.e., in the state illustrated in FIG. 30 and FIG. 32. Particularly, if the recording device is dropped with the upper surface thereof down, strong inertial force will act upward in FIG. 32 to the lock arm 370 (experiments showed that the acceleration of 150 to 200 G was exerted even in the case of the drop of 30 cm).

The boss portion 370*a* of the lock arm 370 can stand certain force by the engagement with the lock control cam portion 316B of the pump gear 316, but over the withstand limit, in order to prevent breakage of the boss portion 370*a*, the pump gear 316 and the platen 14 supporting the shaft thereof are elastically deformed so that the boss portion 370*a* pushes the pump gear 316 away so as to be disengaged from the lock control cam portion 316B.

Figure 33:
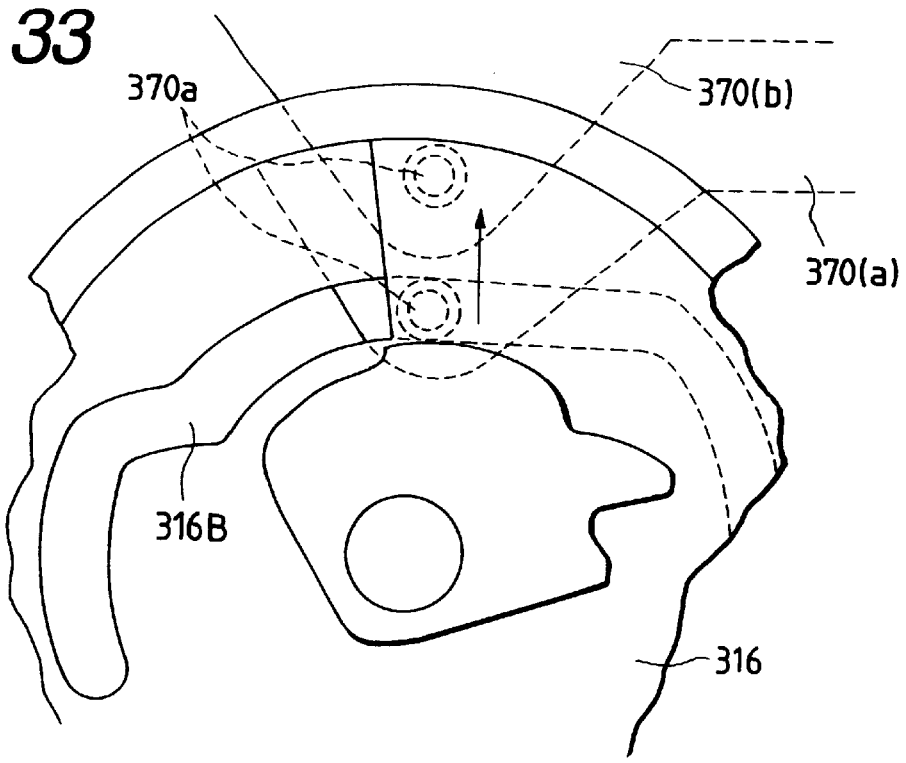
FIG. 33 is a view, seen from the left side of FIG. 19, of the locking state of the lock arm and a disengaged state by external force in the recording device as an embodiment of the present invention.
Figure 34:
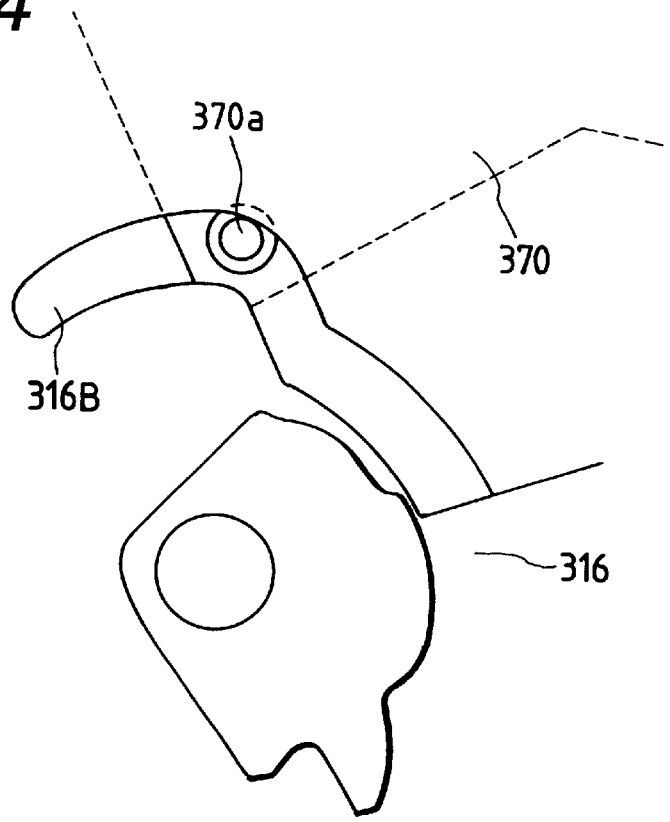
FIG. 34 is a view, seen from the left side of FIG. 19, of a state in which the lock arm returns to a designed position in the recording device as an embodiment of the present invention.

The description of that event will be given using FIG. 33, FIG. 34, and FIG. 35. FIG. 33 and FIG. 34 are enlarged views of the part of pump gear 316.

In FIG. 33, the position of the pump gear 316 corresponds to the state in which the carrier 2 is secured with the lock arm 370 and reference symbol 370(*a*) indicates the position of the lock arm 370 in a normal state.

When the aforementioned impact is imposed, the boss portion 370*a* of the lock arm 370 is disengaged from the lock control cam portion 316B and the lock arm 370 moves up in FIG. 33 (in the direction of the arrow in FIG. 33). However, the lock arm 370 comes to contact the arm stopper 4*a* to stop there, so that it moves to the position indicated by reference symbol 370(*b*) in FIG. 33 and stops there.

When the user turns on the power supply in this state, the recording device first performs the cap opening operation in order to effect initialization. Namely, the pump gear 316 is rotated clockwise. That state is illustrated in FIG. 34.

It is seen that although the boss portion 370*a* of the lock arm 370 is off the lock control cam portion 316B, part of the chamfer at the tip portion of the boss portion 370*a* is always in the lock control cam portion 316B from the relation of the clearance 4*b* of the arm stopper 4*a* described above. FIG. 35 shows that state in cross section.

Since one side of the lock arm 370 is supported by the frame 4, the lock arm 370 is not inclined, but the pump gear 316 is pushed away by the boss portion 370*a*. Further, part of the chamfer at the tip portion of the boss portion 370*a* is in the lock control cam portion 316B.

The force 370*j* exerted at that time on the lock arm 370 because of the repulsion of the pump gear 316 can be decomposed into force A 370*k* and force B 370*l*, the force B 370*l* being such force as to move the lock arm 370 down.

As the pump gear 316 further rotates clockwise in this state, dynamic friction takes place between the fore end of the boss portion 370*a* and the contact surface of the lock arm control portion 316B, whereby the boss portion 370*a* of the lock arm 370 can move down to return into the lock control cam portion 316B.

Therefore, the above structure can provide the recording device that can return to the normal condition by the next power-on operation even if the user should drop the recording device accidentally, and can provide the compact, lightweight, and highly reliable recording device, because the strength of the boss portion 370*a* of the lock arm 370, the pump gear 316, and the platen 14 does not have to be increased too much.

Figure 36:
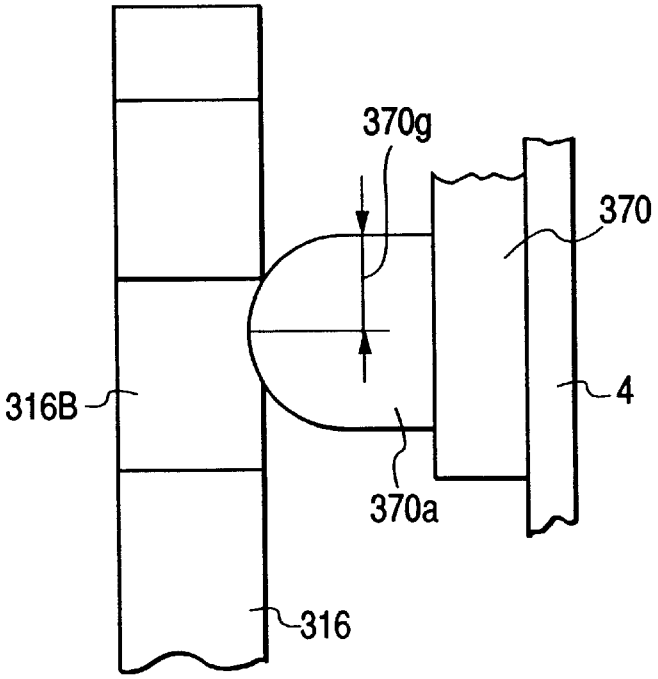
FIG. 36 is a diagram to show a modification of tip part of a boss portion illustrated in FIG. 35.

FIG. 36 shows a modification of the boss portion 370*a* in which the tip end of the boss portion 370*a* is a spherical surface. In this case the radius corresponds to the distance 370*g* of the chamfer at the tip end. It is a matter of course that the chamfer does not always have to be a chamfer on the periphery of the cylindrical boss, but it may be a chamfer shape at one ridge of a prism. A necessary condition is that a chamfer shape of a certain amount exists in the regulated direction by the stopper.

The present device has the following structure capable of accurately detecting an amount of waste ink sucked out of the recording head cartridge 1 by the aforementioned recovery means and received in the waste ink absorber 327.

The following areas are allocated in EEPROM 509 (see FIG. 45) on the control board 57:

4-byte area for integrating the amount of the ink discharged by the predischarge operation in units of 1 ng ($10^{-9}$ g) (hereinafter referred to as a predischarge counter);

2-byte area for integrating the amount of ink expected to vapor with a lapse of time, which is a predetermined percentage of the amount of the ink discharged by the recovery operation, in units of 10 mg ($10^{-2}$ g) (hereinafter referred to as a vaporized amount counter);

2-byte area for integrating the amount of ink considered not to vapor in future, which is a predetermined percentage of the amount of the ink discharged by the recovery operation, in units of 10 mg ($10^{-2}$ g) (hereinafter referred to as a non-vapored amount counter);

1-byte area for storing the time having elapsed from the preceding calculation of the waste ink amount to the present time in units of one minute (hereinafter referred to as a waste ink timer).

The total amount of waste ink stored in the waste ink absorber 327 at each time is obtained as the sum of values of the vapored amount counter, the non-vapored amount counter, and the predischarge counter.

When the predischarge is carried out at timing during the recovery operation, before the sheet feed operation, during the recording operation, or the like, the total predischarge amount according to the number of discharge shots for each nozzle and the discharge amount per shot is added to the predischarge counter.

Figure 37:
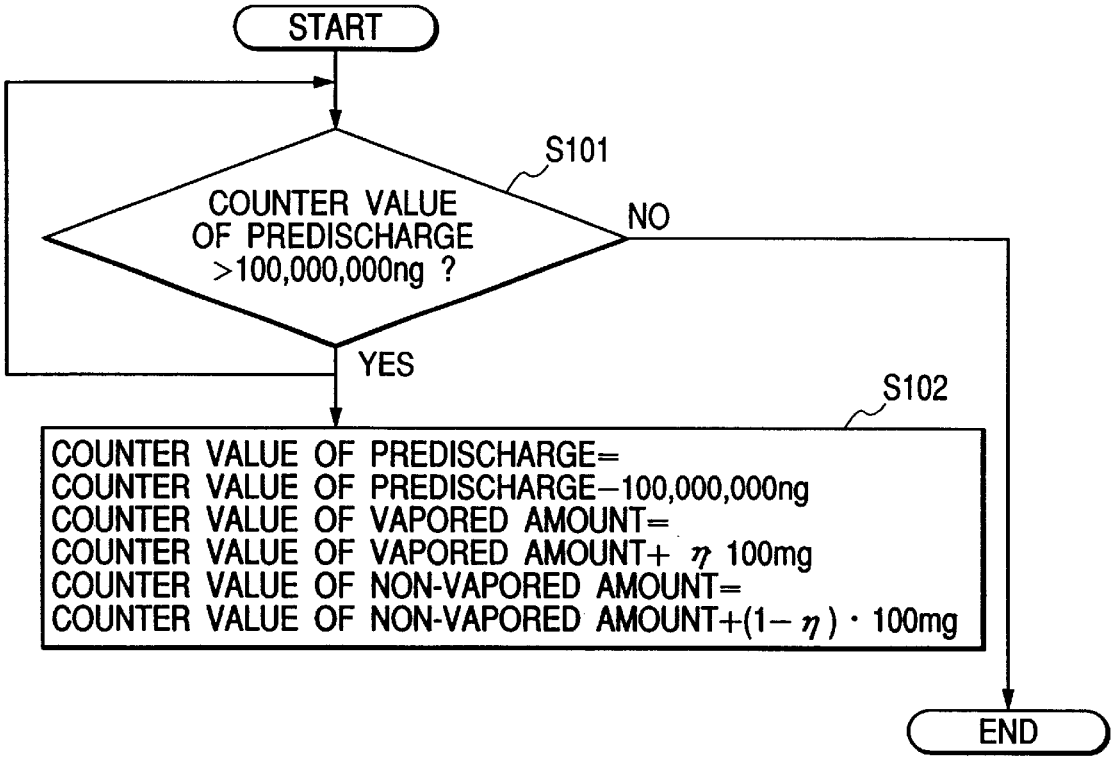
FIG. 37 is a flowchart for checking a counter value of a predischarge counter in the recording device as an embodiment of the present invention.

The predischarge counter is one capable of integrating the amount up to about 4,000 mg, but it is arranged so that, as illustrated in the flowchart to check the predischarge counter value illustrated in FIG. 37, the counter value is divided into a vapored amount and a non-vapored amount at a predetermined ratio at the time when the predischarge counter amount exceeds 100,000,000 ng (100 mg) and they are added respectively to the vapored amount counter and to the non-vapored amount counter.

When the ink is discharged by the recovery operation, preliminary stored discharge amounts are added respectively to the vapored amount counter and to the non-vapored amount counter, according to the type of the recording head cartridge 1 and the type of the recovery operation.

Figure 38:
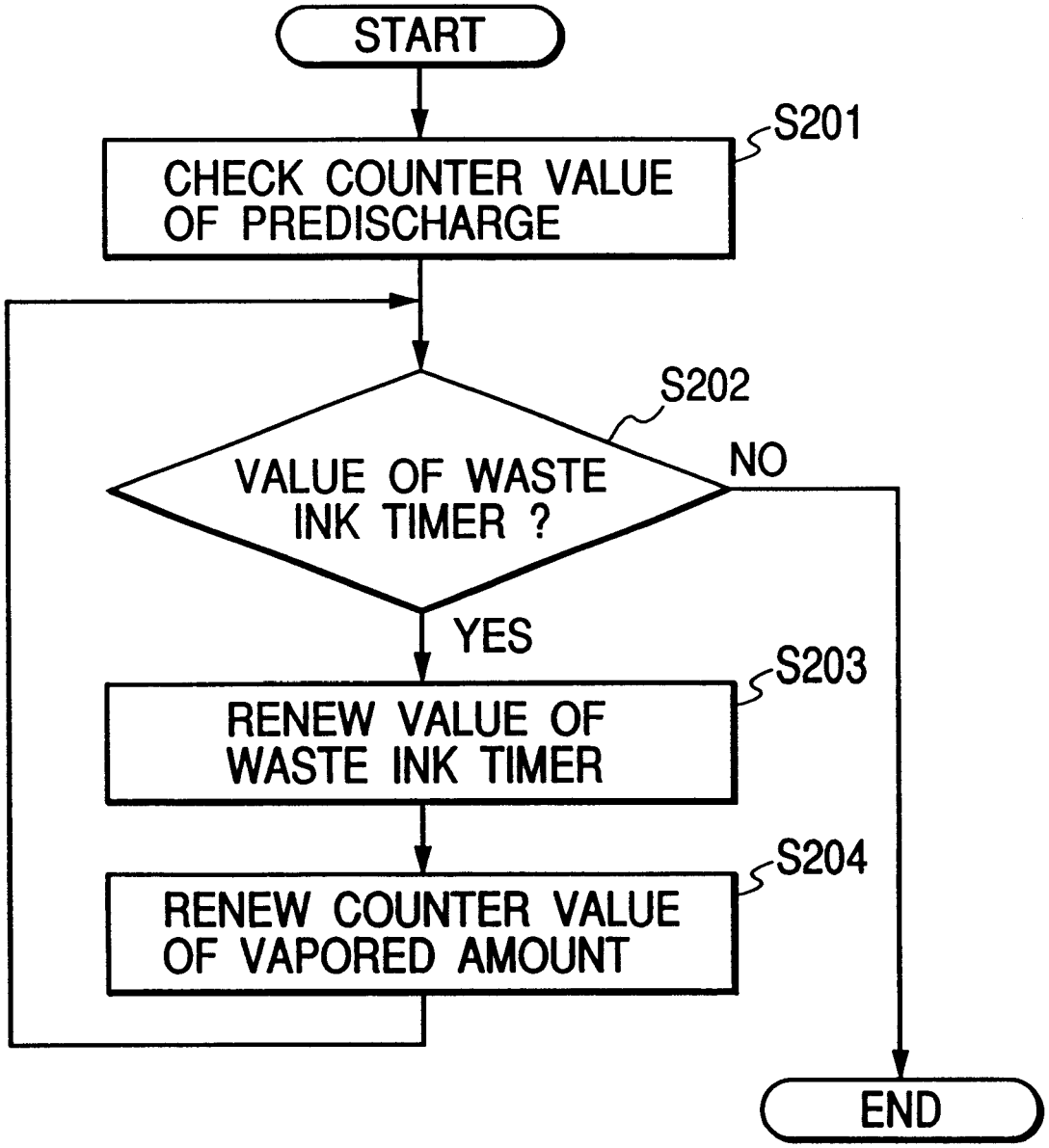
FIG. 38 is a flowchart for calculating a waste ink vapored amount in the recording device as an embodiment of the present invention.

FIG. 38 is a flowchart for calculating the vapored amount of the waste ink in the present device.

At the timing when the power of the device is turned on, at the timing when the device is reset, or at the timing when the recovery operation is to be carried out, step S202 is carried out to determine whether a value of the aforementioned waste ink timer exceeds a predetermined time T and then step S203 is carried out to renew the value of the waste ink timer to a value resulting from subtraction of the predetermined time T. Further, step S204 is carried out to calculate a value of the vapored amount counter by subtracting an amount of the ink assumed to vapor within this predetermined time, and the flow returns to step S202 to repeat the above procedures.

After that, a new total amount of waste ink is calculated by adding an amount of waste ink discharged by the operation intended to be carried out at present according to the aforementioned procedure.

The following equation is used for the calculation of the amount of ink assumed to vapor within the aforementioned predetermined time T.

$$\text{(amount of vapored ink per predetermined time T)} = k1 \times \text{(value of vapored amount counter/value of non-vapored amount counter)}$$

Therefore, the value of the vapored amount counter after a lapse of the predetermined time is expressed by the following.

$$\text{value of vapored amount counter} = \text{value of vapored amount counter} \times (1 - k1/\text{value of non-vapored amount counter})$$

Figure 39A:
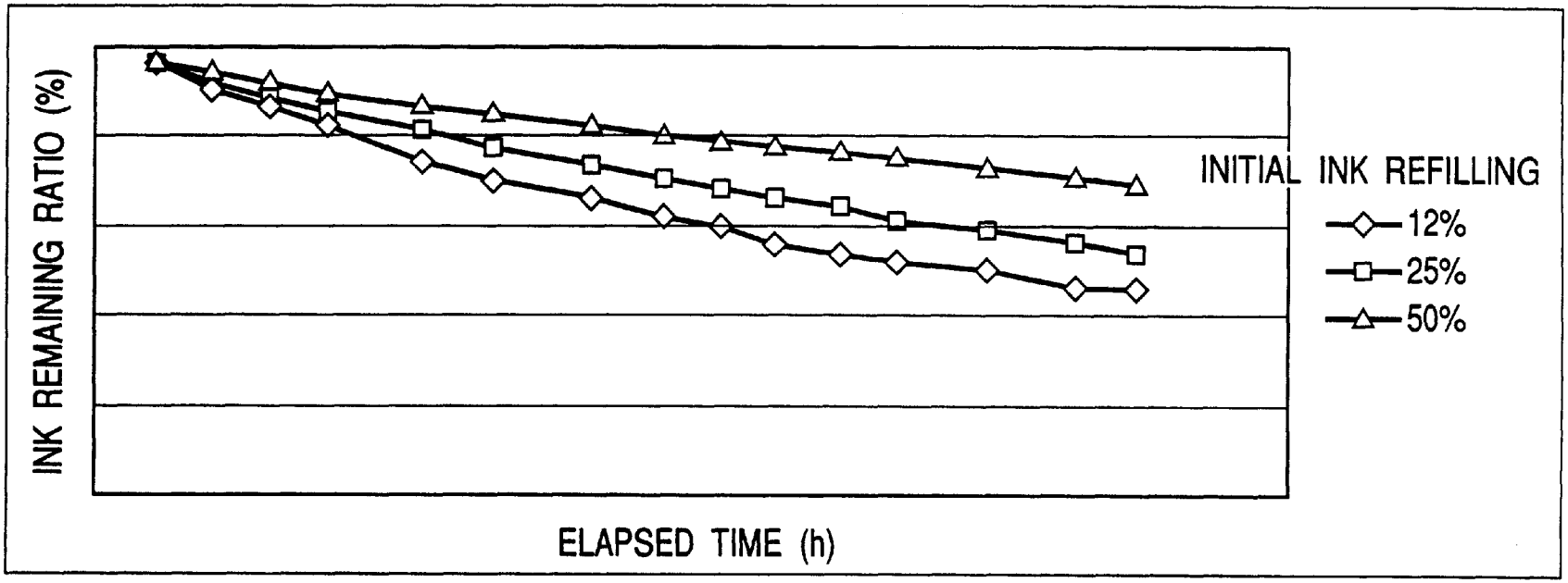
FIG. 39A and FIG. 39B are characteristic diagrams to show plots of waste ink vaporing.
Figure 39B:
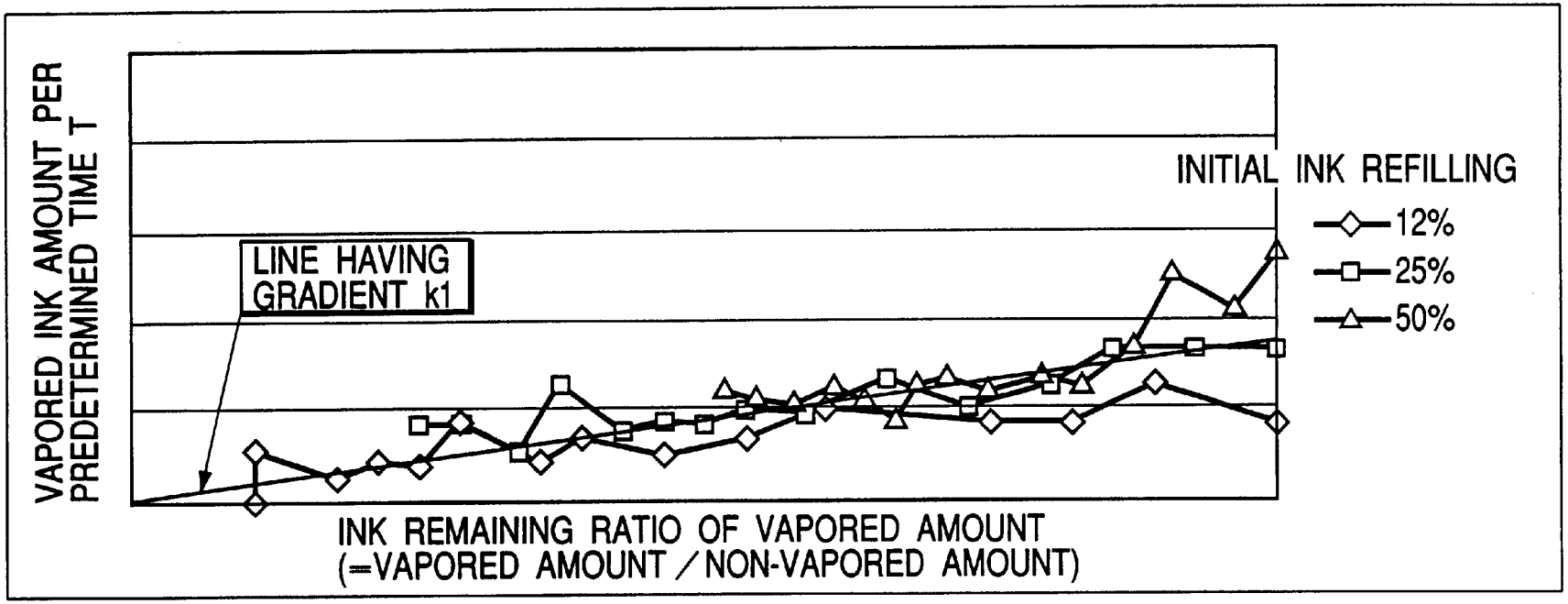

Here, k1 is a factor of evaporation determined from FIG. 39A and FIG. 39B which show the result of experiments to obtain the evaporation characteristics of the ink and the waste ink absorber 327 used in the present device.

FIG. 39A shows ink remaining ratios (ratios by weight) where the waste ink absorber 327 of the present device is filled with ink in the percentage 50%, 25%, or 12% of the receivable ink amount, about 84 g, and is made to stand. FIG. 39B shows amounts of vapored ink per the predetermined time T, against ratios of amount of vapored ink expected to vapor with a lapse of time to amount of non-vapored ink considered not to vapor in future, which is the predetermined percentage of the above filled ink (i.e., against ink remaining ratios of vapored amount).

The above vapored ink amount calculating equation is obtained by approximating these plots to a straight line with a gradient k1.

It is noted that the amount of ink discharged into the waste ink absorber 327 may also be measured directly using a weight meter or a flow meter.

When the total amount of waste ink calculated according to the above procedures exceeds a predetermined waste ink warning amount, the user is notified of that fact by buzzer sound generated from the control board 57 and by lighting of a lamp; however, the present device becomes able to be used by resetting the warning by manipulation of the user. If the total amount of waste ink decreases with a lapse of time to below the aforementioned waste ink warning amount the notification to the user will be terminated, so as to become able to be used in the normal operation.

If the total amount of waste ink further increases to exceed a predetermined waste ink error amount, the user will be notified of that fact by the buzzer sound generated from the control board 57 and by lighting of the lamp. However, the present device becomes able to be used where the total amount of waste ink decreases with a lapse of time to become below the above waste ink error amount and where the warning is reset by manipulation of the user as in the case of the above waste ink warning. When the total amount of waste ink further decreases with a lapse of time to become below the above waste ink warning amount, the notification to the user is stopped to make the device able to be used in the normal operation.

By the above structure to detect the amount of the waste ink received in the waste ink absorber 327 with accuracy, the drop of waste ink can be prevented in the carried state without increasing the volume of the device.

Since the storage area necessary for the above detection is minimum, the capacity of EEPROM 509 does not have to be increased, whereby increase can be prevented in the volume of the device and in the cost.

[Head Mount Section]

Next described are the heads that can be mounted on the present device.

In the above description the present invention was described with the example in which the recording head cartridge 1 was detachably mounted on the carrier 2 of the present recording device, and that point will be described in further detail, referring to FIG. 40, FIG. 41, FIG. 42, and FIG. 43.

Figure 41:
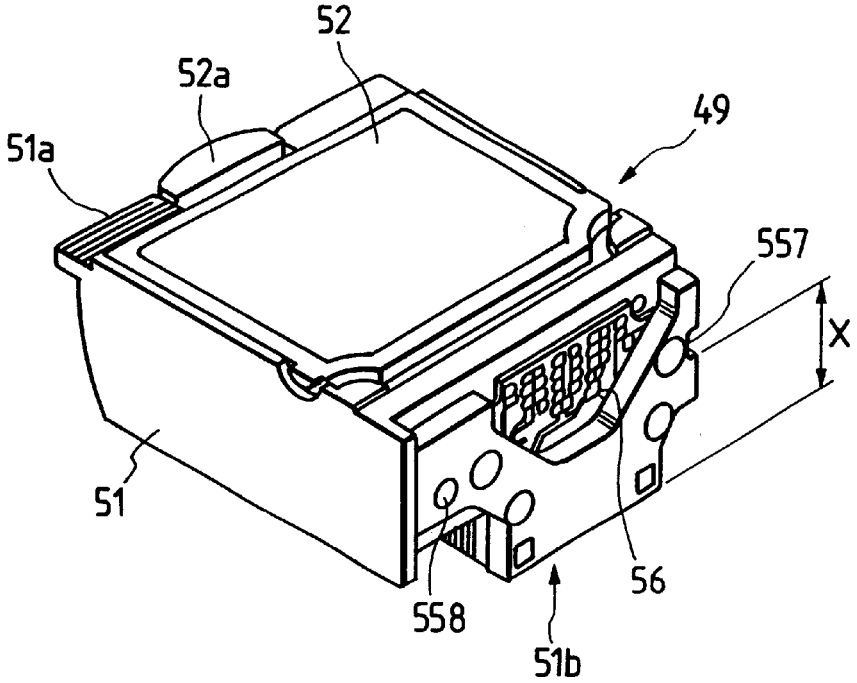
FIG. 41 is a perspective view of a monochrome recording head portion used in the recording device as an embodiment of the present invention.
Figure 42:
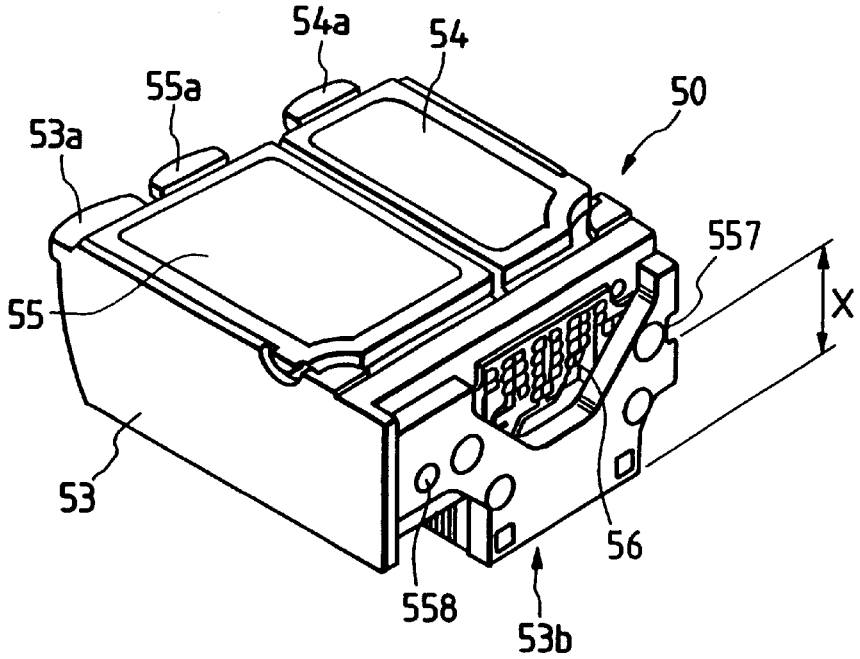
FIG. 42 is a perspective view of a color recording head portion used in the recording device as an embodiment of the present invention.
Figure 43:
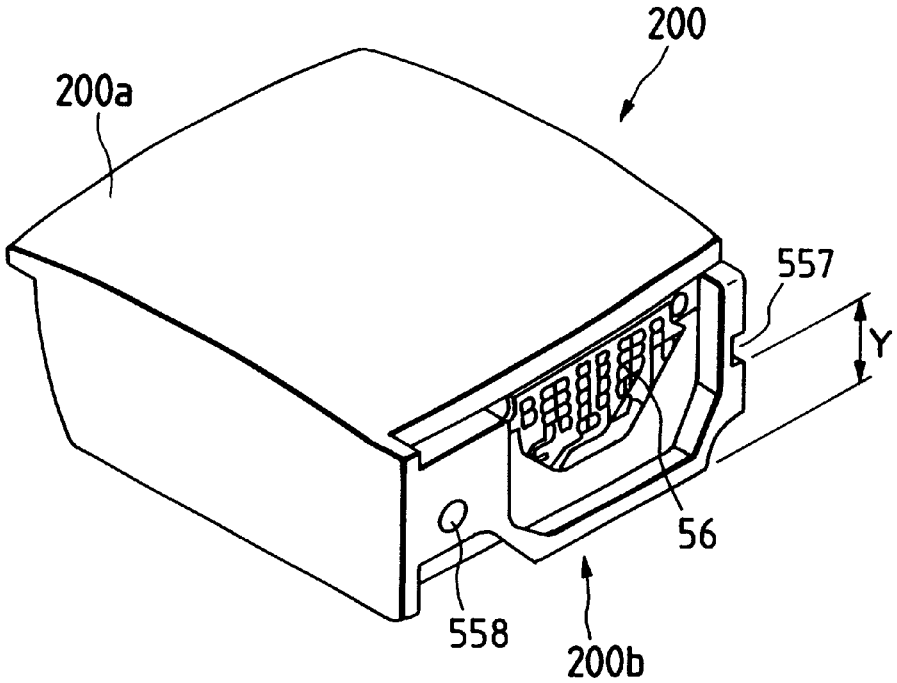
FIG. 43 is a perspective view of a scanner head used in the recording device as an embodiment of the present invention.

Specifically, the recording head cartridge 1 can be either of two types of a monochrome recording head portion 49 illustrated in FIG. 41 and a color recording head portion 50 illustrated in FIG. 42. Further, a scanner head 200, capable of reading an original inserted instead of the recording sheet 22, as illustrated in FIG. 43 can also be mounted on the carrier 2. Therefore, either one of the totally three types of head portions can be mounted on the carrier 2 of the present device.

In the following description a head portion will be used for generally calling the three types of the monochrome recording head portion 49, the color recording head portion 50, and the scanner head 200.

Figure 40:
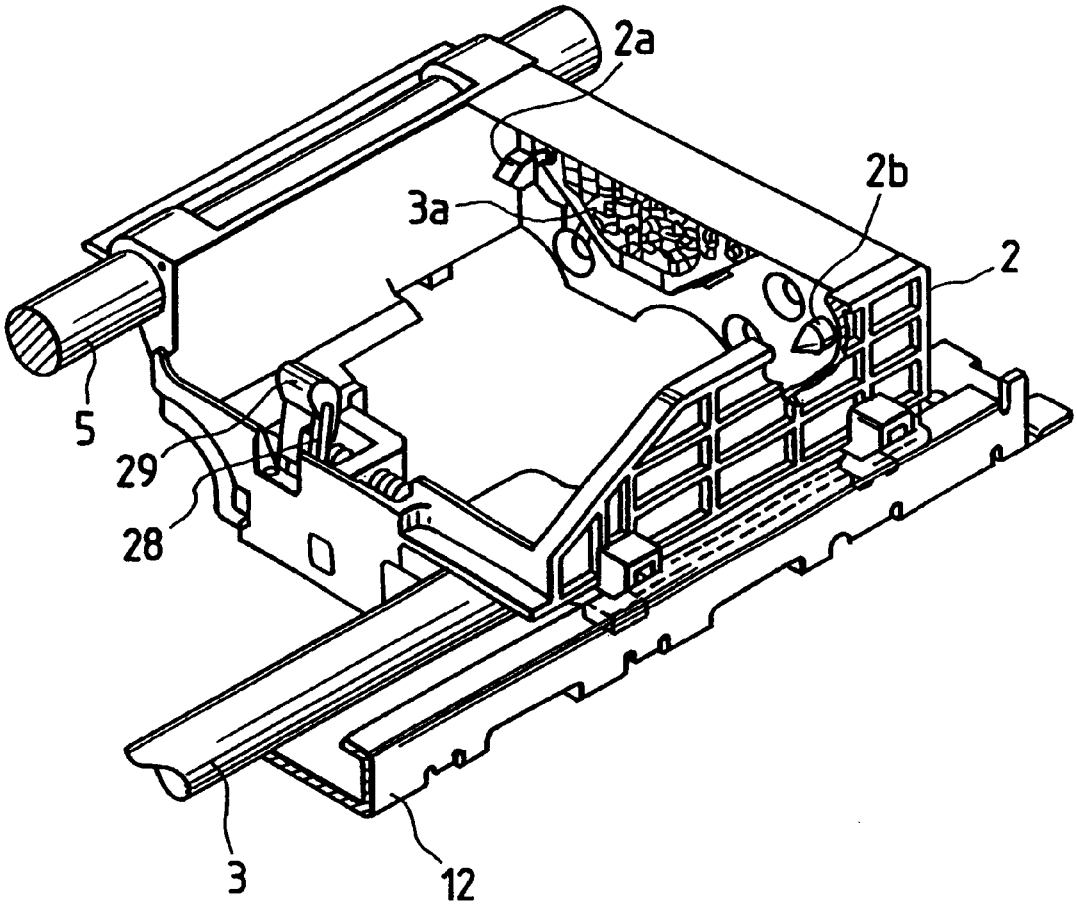
FIG. 40 is a perspective view of carrier 2 on which the head portion illustrated in FIG. 16 is not mounted.

First described referring to FIG. 40 is the arrangement for detachably mounting the above three types of head portions.

FIG. 40 is a perspective view of the carrier 2 from which the head portion illustrated in FIG. 16 is dismounted.

A cable terminal portion 3*a* of a flexible cable 3 is installed at one end of the carrier 2. When either of the monochrome recording head portion 49, the color recording head portion 50, and the scanner head 200 is mounted on the carrier 2, a head terminal portion 56 of each head portion (see FIG. 41, 42, or 43) comes to contact the cable terminal portion 3*a,* whereby electrical connection is established to the head portion.

Two head portion positioning projections 2*a,* 2*b* are integrally formed in a surface of the carrier 2 in which the cable terminal portion 3*a* is located. In the state in which the head portion is mounted on the carrier 2, the head portion positioning projection 2*a* is fitted in a positioning notch 557 on the head portion side while the head portion positioning projection 2*b* in a positioning hole 558 on the head portion side, thus accurately positioning the head portion with respect to the carrier 2.

Further, a contact spring 28 is placed at a position of the carrier 2 opposite to the cable terminal portion 3*a* and a head guide 29 molded of a resin is fixed to the tip end thereof. Namely, the head guide 29 is elastically supported on the carrier 2.

In the state in which the head portion is mounted on the carrier 2, the head guide 29 urges the head portion to the side of the cable terminal portion 3*a,* thereby implementing electrical connection between the cable terminal portion 3*a* and the head terminal portion.

The head guide 29 has the function to enable detachment/attachment by being bent during replacement of the head portion and to keep the head portion mounted from being dismounted upward.

As constructed in this structure, on the occasion of replacement of the head portion the user places the head portion so that the side of the head terminal portion 56 of the head portion is opposed to the cable terminal portion 3*a* of the carrier 2 and then depresses the upper surface of the head portion down, whereby the head guide 29 becomes bent and mounting of the head portion is completed with click feeling. At that time electrical connection is also completed.

For dismounting the head portion, the user pulls a head portion mounting/dismounting operation portion 51*a,* 53*a,* or 200*a* provided in the head portion by finger, whereupon the head guide 29 becomes bent so as to permit the head portion to be dismounted from the carrier 2.

[Head Portion]

The aforementioned head portions will be described below referring to FIG. 41, FIG. 42, and FIG. 43.

FIG. 41 is a perspective view of the monochrome recording head portion 49 for only monochromatic printing (normally black). In FIG. 41, reference numeral 51 designates a monochrome recording head cartridge, and a discharge port surface 51*b* having a nozzle portion for discharging the ink for recording is formed in a portion of this recording head cartridge 51 on this side. Numeral 56 denotes a head terminal portion for receiving an electric signal for discharge. When an electric signal is supplied from the main body of the recording device to the monochrome recording head cartridge 51 through the head terminal portion 56, the ink is discharged downward in FIG. 41 from the nozzles provided in the discharge port surface 51*b* to effect recording. Numeral 557 represents a positioning notch and 558 a positioning hole. These position notch 557 and positioning hole 558 are designed to fit the head portion positioning projections 2*a,* 2*b* provided in the carrier 2, so as to assure the positioning relative to the carrier 2.

Numeral 52 represents a monochrome ink tank which retains ink inside. The monochrome ink tank 52 is detachably fixed to the monochrome recording head cartridge 51 by a latch portion 52*a* integrally and elastically formed in the monochrome ink tank 52. A flow path of ink is created through a detachable joint portion not illustrated between the monochrome ink tank 52 and the monochrome recording head cartridge 51.

Therefore, if the ink is used up because of recording and no ink remains in the monochrome ink tank 52, the monochrome ink tank 52 is dismounted from the monochrome recording head cartridge 51 with bending the latch portion 52*a* and a new monochrome ink tank 52 is mounted, whereby recording can be carried on.

FIG. 42 is a perspective view of the color recording head portion 50 for color recording.

Here is described only differences from the monochrome recording head portion 49 illustrated in FIG. 41. In the discharge port surface 53*b* there are provided four types of independent nozzle groups for respectively discharging four colors of yellow, magenta, cyan, and black for effecting color recording. Numeral 54 represents a black ink tank, this black ink tank 54 retaining black ink inside and being connected to the nozzle group of black provided in the aforementioned discharge port surface 53*b* through a detachable joint portion not illustrated.

Numeral 55 indicates a color ink tank, the inside of the color ink tank 55 being divided into three independent volumes, each of the three volumes storing the yellow ink, the magenta ink, or the cyan ink. The color ink tank 55 is also arranged similar to the black ink tank 54 in such an arrangement that the yellow tank is connected to the yellow nozzle group, the magenta ink to the magenta nozzle group, and the cyan ink to the cyan nozzle group, through each of three detachable joint portions not illustrated.

Reference symbol 54*a* stands for a latch portion for replacement of the black ink tank 54 and reference symbol 55*a* for a latch portion for replacement of the color ink tank 55.

As described above, when the color recording head portion 50 is mounted on the carrier 2 of the printer section, it becomes possible to perform color recording and also possible to replace only the black ink tank 54 when the black ink is used up or to replace only the color ink tank when either or all of the yellow, magenta, and cyan is used up.

FIG. 43 is a perspective view of the scanner head 200. The detailed description thereof will be given hereinafter.

In FIGS. 41 and 42, symbol X represents the distance from the positioning notch 57 to the discharge port surface 51*b,* 53*b,* which is a common value to the monochrome recording head cartridge 51 and the color recording head cartridge 53 and which is about 13 mm in the case of the present embodiment. In contrast with it, in the case of the scanner head 200 illustrated in FIG. 43, symbol Y indicates the distance between the notch 57 and a surface of a reading portion 200*b,* which is set smaller than the distance X and which is about 9 mm in the present embodiment.

From this Y value, a vertical difference between the position of the discharge port surface and a horizontal line of the reading portion surface is calculated as 4 mm, which is the difference between 13 mm and 9 mm described above.

Therefore, when the scanner head 200 is mounted, the cap and blade are prevented from touching the reading portion surface 200*b* of the scanner head 200 even during execution of the capping operation and wiping operation.

As a consequence of the construction as described above, the reading surface 200*b* can be prevented from being stained by the cap and blade stained with ink, when the scanner head 200 is mounted.

[Scanner Section]

Next, let us explain the scanner section which is one of the features of the recording device of the present invention.

Figure 44A:
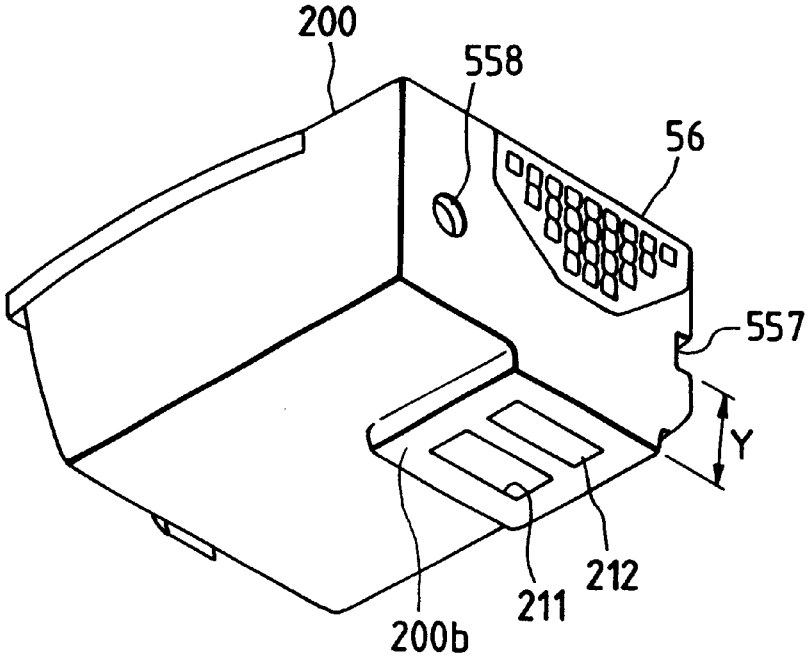
FIG. 44A and FIG. 44B are a schematic, sectional view and a perspective view of the scanner head used in the recording device as an embodiment of the present invention.
Figure 44B:
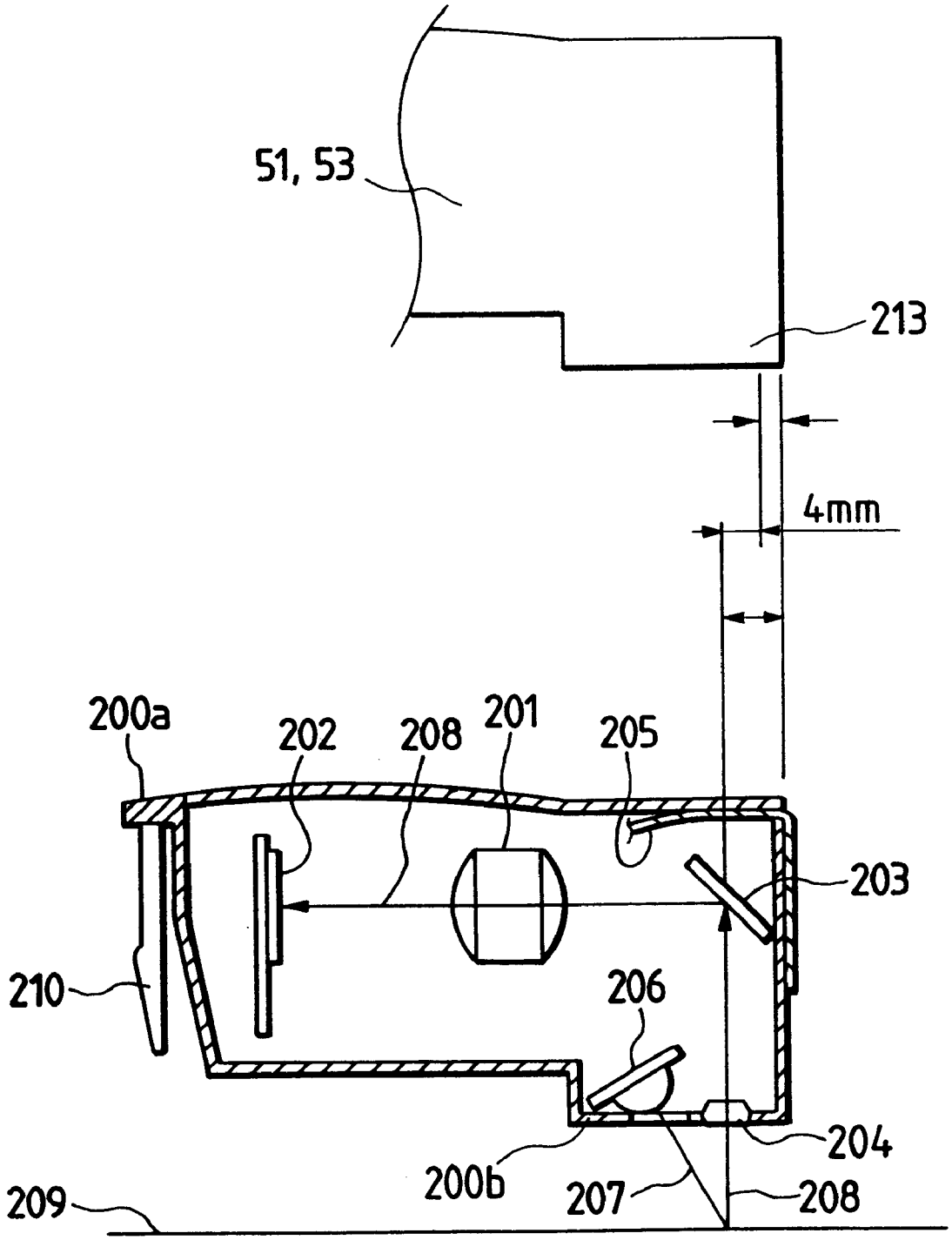

FIG. 44A and FIG. 44B are a schematic sectional view and a perspective view of the scanner head 200.

In FIG. 44A and FIG. 44B, reference numeral 206 designates an LED for illumination to illuminate an original surface 209. LED light 207 emitted from the LED 206 travels through an LED aperture portion 211 to illuminate the original surface 209 and image light 208 from the original surface 209 travels through a field lens 204 disposed at a sensor aperture portion 212. An optical path of the light is then bent at a right angle by a mirror 203 to travel through an imaging lens 201 to be focused on a sensor 202.

The center of the sensor aperture portion 212 deviates more than the distance of the ink discharge port 213 of the monochrome recording head cartridge 51 and the color recording head cartridge 53 from the positioning contact surface of each recording head cartridge with the carrier 2; the deviation is about 4 mm in the present embodiment.

The LED 206 and sensor 202 are electrically connected and drawn out to the outside by a wiring board 205. Electrodes are formed in the head terminal portion 56 of the wiring board 205 and are kept in press contact with the electrodes of the unrepresented carrier, whereby signals can be guided to the control circuit on the main body side.

The outside shape of the scanner head 200 is the same as the shape of the recording head cartridge 1 with the ink tank 8 mounted. The scanner head 200 can be mounted on the carrier 2 through a latch of claw portion 210 which is part of the exterior, as the recording head cartridge 1 was. When the scanner head 200 is dismounted, the head portion mounting/dismounting control portion 200*a* is pulled up to unlock the latch of the claw portion 210, whereby the scanner head can be dismounted readily.

When the scanner head 200 is mounted on the carrier 2, the MPU 500 described below (see FIG. 45) automatically discriminates the scanner and goes into a scanner mode.

Receiving a scanner read signal from the host computer or the like, the MPU 500 conveys a read original to a predetermined position by driving of the sheet feed motor 23, similar to the recording sheet 22, then lights the LED 206, and thereafter reads the image signals while driving the carrier motor 10.

Here, the driving speed of the carrier motor 10 can be changed depending upon either of original read modes of the scanner head 200. Each mode is a combination of a read resolution with gradation of each read value. The device has the resolving power of 360 dpi in the main scanning direction which is the sheet conveying direction, the resolution of the sensor 202 of the scanner head 200 is 360 dpi in the sub-scanning direction which is the moving direction of the carrier 2, and output can be obtained in 64 gradation tones. For example, there are a mode of reading in 64 tones at 360 dpi in the main scanning direction and 360 dpi in the sub-scanning direction, a mode of reading in two tones at 90 dpi in the main scanning direction and 90 dpi in the sub-scanning direction, and a mode of reading at the resolution of 200 dpi in the main scanning direction with consideration to compatibility with FAX. Since data processing and transfer operations take a lot of time in modes of large data amount such as the mode of reading in 64 tones at 360 dpi in the main scanning direction and 360 dpi in the sub-scanning direction, the driving speed of the carrier is set slower; whereas the driving speed of the carrier is set faster in the mode of reading in two tones at 90 dpi in the main scanning direction and 90 dpi in the sub-scanning direction.

After completion of reading of one line, the original is fed by one line by the sheet feed motor 23 and reading of the next line is carried out. This operation is repeatedly carried out before the end of the original arrives.

As described above, the recording device of the present embodiment is arranged to perform the recording on the recording sheet 22 with the recording head cartridge 1 and the reading of original with the scanner head 200. It is, therefore, noted that when the recording sheet 22 is stated in the description of the present invention, it also includes the original except for the cases of the description concerning only the recording.

[Circuit Section]

Figure 45:
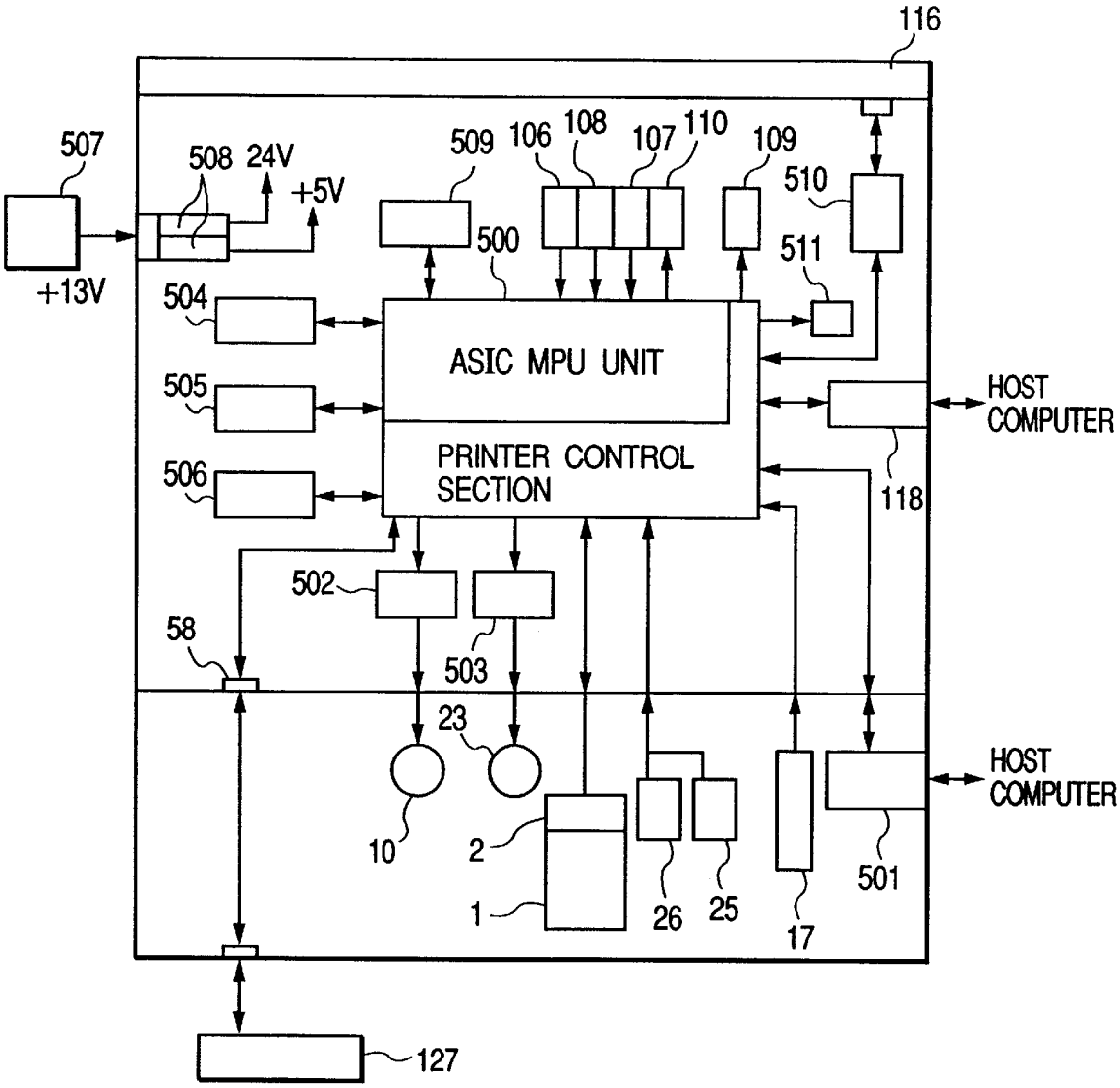
FIG. 45 is a block diagram to show an electric configuration of the recording device as an embodiment of the present invention.

FIG. 45 is a block diagram to show the electric configuration of the present recording device.

In FIG. 45, reference numeral 500 designates an ASIC in which the MPU part and printer control part are integrated. Numeral 504 represents a flash ROM which stores programs for controlling the whole of the recording device, numeral 505 a mask ROM storing character fonts etc., and numeral 506 a DRAM used as a work area of the ASIC 500 and as a buffer of signal. Numeral 509 denotes an EEPROM, this EEPROM 509 being a rewritable ROM which can retain the contents without supply of power. Therefore, information written in this EEPROM 509 includes information of setting carried out by the user during power on, the amount of used ink, the integral amount of waste ink staying inside the recording device, and so on.

Numeral 508 indicates a DC-DC converter, the DC-DC converter 508 converting a voltage from an adapter 507 to a power-supply voltage used in the recording device. The adapter 507 converts the ac voltage for home-use of 100 V to a dc voltage of 13 V.

The recording device incorporates a battery 116 in order to enable use under outdoor circumstances where the home-use power supply is not available. Since the recording device incorporates a battery charging circuit 510, the battery can be charged without the necessity for preparing a separate charger.

Numeral 502 designates a carrier motor driver for driving of the carrier 2 and numeral 503 a sheet feed motor driver for driving the sheet feed roller 6. Each of the carrier motor driver 502 and the sheet feed motor driver 503 performs control of a motor in response to a control signal outputted from the ASIC 500.

Numeral 106 represents a power switch for turning on the power supply of the main body, numeral 108 a head replacement switch for moving the carrier 2 to a replacement position, 107 an error release switch, 110 a power lamp, 109 an error lamp, and 511 a buzzer.

Numeral 118 indicates an interface connector and numeral 501 an infrared module. For example, signal communication with an external device such as a host computer or the like is carried out through the interface connector 118 and the infrared module 501. The interface connector 118 is connected through a wire to the host computer. The infrared module 501 is a serial communication port with infrared light and is faced to an infrared port of the host computer to permit input/output of signal with infrared light.

The option connector 58 is prepared for communication with the option ASF 127.

An HP sensor 26 is a sensor of a photo-interrupter type, which detects an edge part of the carrier 2 to detect the position of the carrier 2. The paper sensor 25 and discharge sheet sensor 17 are contact-type sensors, which detect presence or absence of a recording sheet in the recording device.

As described above, since the present embodiment adopts the structure in which the projections are provided in the partition surface of the cover members and the coupling of the engagement structure is made firmer by tightening with screws, it can accomplish the recording device and the sheet material conveying device with the external cover being capable of being assembled in the decreased number of parts and coupled in the strength resistant to the portable use. Since the number of screws can be minimum, the spaces for the screws are also decreased, whereby the scale of the whole device can be decreased.

What is claimed is:

1. A recording apparatus comprising:

a drive mechanism section for effecting recording on a recording material;

first and second cover members divided from each other by at least one separation surface, said first cover member having a fulcrum at said separation surface and said first cover member being rotatable relatively to said second cover member with respect to said fulcrum;

a first engagement mechanism for engaging said first cover member with said second cover member by moving said first cover member and said second cover member in a direction approaching each other, said first engagement mechanism being provided on said first and second cover members approaching to each other and separating from each other when said first and second cover members rotate with respect to said fulcrum; and a second engagement mechanism for engaging said first cover member with said second cover member by moving said first cover member and said second cover member in a direction by separating from each other, said second engagement mechanism being provided on said first and second cover members at a portion opposed to said first engagement mechanism with respect to said fulcrum.

2. The recording apparatus according to claim 1, wherein said first engagement mechanism is a fastening member for fastening said first cover member and said second cover member.

3. The recording apparatus according to claim 1, wherein said second engagement mechanism has a pawl portion provided on said first cover member or said second cover member and a hook portion engaging with said pawl portion.

4. The recording apparatus according to claim 3, wherein said claw portion and said hook portion are arranged to go into close fit to each other because of the engagement in said first engagement structure.

5. The recording apparatus according to claim 1, wherein the entire thickness of said first and second cover members is not more than 60 mm.

6. The recording apparatus according to claim 1, wherein an outer cover comprising said first and second cover members removably contains a battery as an electrical power source for said recording apparatus.

7. The recording apparatus device according to either one of claims 1 to 6, comprising conveying means for conveying said recording material, and head holding means for holding a recording head arranged to discharge ink to effect recording on said recording material.

8. The recording apparatus device according to claim 7, wherein said recording head comprises an electro-thermal transducer for generating thermal energy for discharge of the ink.

9. A recording apparatus comprising:

a drive mechanism section for effecting recording on a recording material;

first and second cover members divided from each other by at least one separation surface;

a projection provided at said separation surface of said first cover member, said first cover member being rotatable relatively to said second cover member with respect to said projection as a fulcrum around an axis parallel to said separation surface;

a pawl portion provided on said second cover member so that said first cover member approaches and separates from said first cover member when said first and second cover members rotate at said projection as a fulcrum;

a hook portion provided on said first cover member to engage with said projection; and a fastening member for fastening said first cover member and said second cover member, said fastening member being provided on said first and second cover members at a portion opposed to said pawl portion with respect to said projection, wherein said fastening member fastens said first and second cover members so that said first cover member is moved and in a direction separating from said second cover member on a side where said pawl portion is provided with respect to said axis so as to engage said first cover member with said second cover member.

* * * * *

UNITED STATES PATENT AND TRADEMARK OFFICE

CERTIFICATE OF CORRECTION

PATENT NO. : 6,250,827 B1
DATED : June 26, 2001
INVENTOR(S) : Takashi Nojima et al.

It is certified that error appears in the above-identified patent and that said Letters Patent is hereby corrected as shown below:

Column 5,
Line 60, "sections" should read -- section --.

Column 8,
Line 29, "there are" should read -- there is --.

Column 11,
Line 60, "screws" should read -- screws and --.

Column 12,
Line 27, "upper-case" should read -- upper case --.

Column 17,
Line 19, "cur" should read -- cut --.

Signed and Sealed this

Fifth Day of March, 2002

*Attest:*

*Attesting Officer*

JAMES E. ROGAN
*Director of the United States Patent and Trademark Office*